US007322143B2

(12) United States Patent
Rohrbaugh et al.

(10) Patent No.: US 7,322,143 B2
(45) Date of Patent: Jan. 29, 2008

(54) SEMIAUTOMATIC HANDGUN

(75) Inventors: Karl Rohrbaugh, Blue Point, NY (US); Steven F. Reuter, Bohemia, NY (US); Anthony Reda, Lynbrook, NY (US); Geoff Gliebe, Wantagh, NY (US)

(73) Assignee: Rohrbaugh Firearms Corp., New York, NY (US)

( * ) Notice: Subject to any disclaimer, the term of this patent is extended or adjusted under 35 U.S.C. 154(b) by 337 days.

(21) Appl. No.: 10/825,706

(22) Filed: Apr. 16, 2004

(65) Prior Publication Data

US 2005/0011349 A1 Jan. 20, 2005

Related U.S. Application Data

(63) Continuation-in-part of application No. 10/367,127, filed on Feb. 14, 2003, now abandoned.

(51) Int. Cl.
*F41C 23/10* (2006.01)
*F41A 19/51* (2006.01)

(52) U.S. Cl. ..... 42/71.02; 42/69.02; 89/147; 89/163

(58) Field of Classification Search ..... 89/147, 89/163; 42/69.02, 71.02
See application file for complete search history.

(56) References Cited

U.S. PATENT DOCUMENTS

| | | | | | |
|---|---|---|---|---|---|
| 2,921,503 | A | * | 1/1960 | Browning | 89/195 |
| 3,656,249 | A | * | 4/1972 | Raville | 42/69.03 |
| 3,756,120 | A | * | 9/1973 | Roy | 89/163 |
| 4,173,169 | A | * | 11/1979 | Yates et al. | 89/132 |
| 4,275,640 | A | * | 6/1981 | Wilhelm | 89/147 |
| 4,342,169 | A | * | 8/1982 | Lichtman | 42/11 |
| 5,654,519 | A | * | 8/1997 | Albrecht et al. | 89/163 |

OTHER PUBLICATIONS

The Complete Encyclopedia of Pistols and Revolvers; p. 85; published in 2003.*

* cited by examiner

*Primary Examiner*—Stephen M. Johnson
(74) *Attorney, Agent, or Firm*—Adams & Wilks

(57) ABSTRACT

A semiautomatic handgun has a frame, a barrel mounted on the frame and having a chamber for receiving a cartridge, a slide mounted on the frame and over the barrel and longitudinally movable relative to the frame and the barrel, a firing mechanism for striking the cartridge, and a trigger for releasing the firing mechanism. The barrel has a peripheral wall portion extending from the chamber, a cylindrical portion forming a front terminal end of the barrel, and a conical portion disposed between and contiguous with each of the peripheral wall portion and the cylindrical portion.

16 Claims, 39 Drawing Sheets

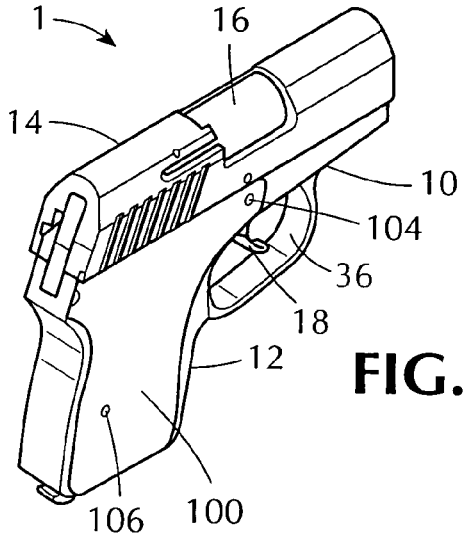
FIG. 1
FIG. 2A
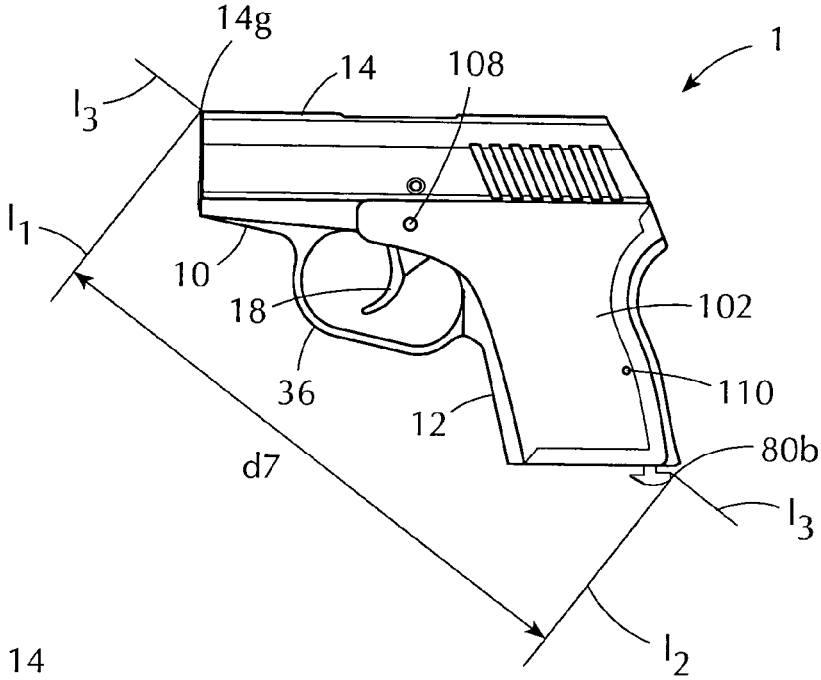
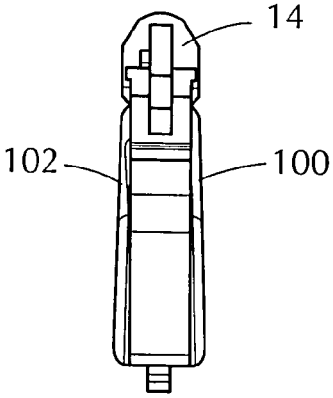
FIG. 2B
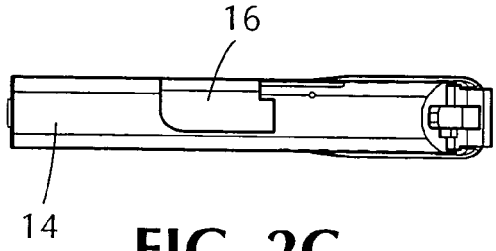
FIG. 2C

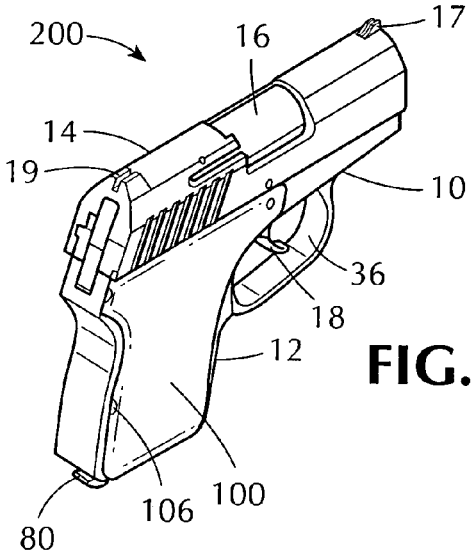
FIG. 37
FIG. 38A
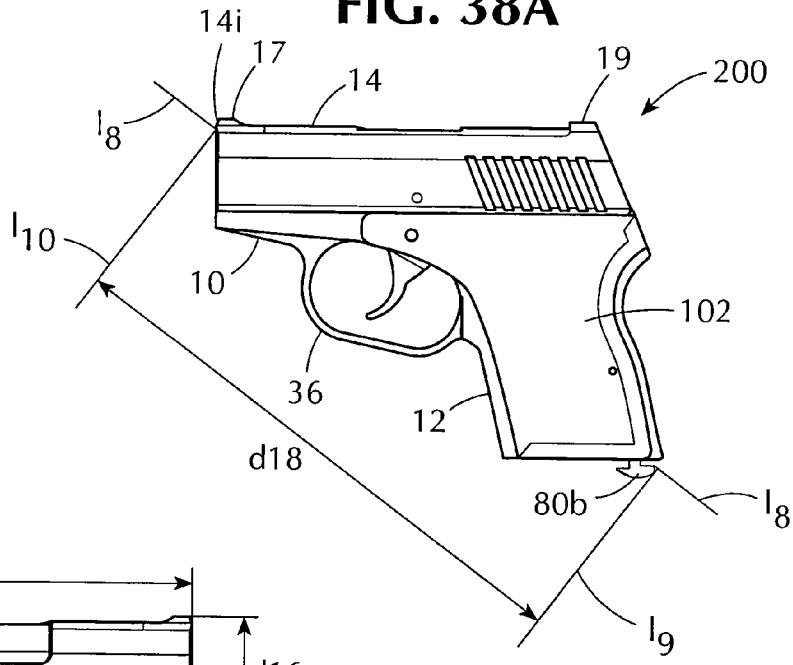
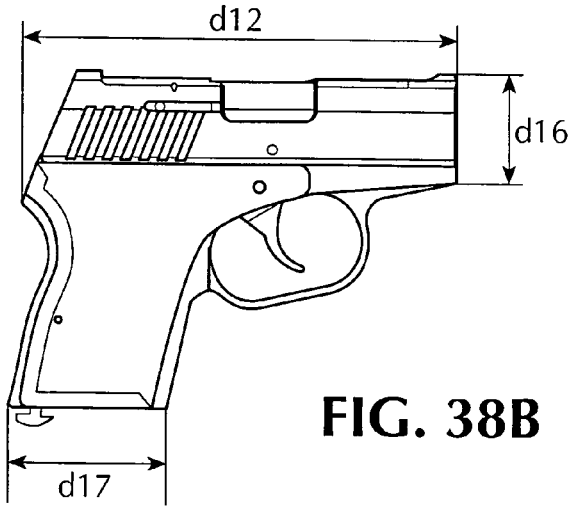
FIG. 38B

SEMIAUTOMATIC HANDGUN

RELATED APPLICATION

The present application is a continuation-in-part application of U.S. patent application Ser. No. 10/367,127 filed Feb. 14, 2003, now abandoned.

BACKGROUND OF THE INVENTION

1. Field of the Invention

The present invention pertains generally to firearms and, more particularly, to a semiautomatic handgun which has an increased rate of firing capability and reduced recoil action when fired and which is of a size small enough to be carried in a pocket or other concealed location.

2. Background of the Invention

There are many uses for handguns that include sport, police and military use, and personal self-defense. In the sport known as action or combat shooting, an individual is presented with a series of targets that simulate combat and/or self-defense scenarios. Another type of shooting sport is fixed-target shooting. Police and military personnel also participate in these sports as part of training exercises. In these activities the objective is to hit the target or targets as many times as possible in a given period of time with as high an accuracy as possible. The preferred (and in some sports required by rule) handgun for these activities is of the semiautomatic type wherein each round (bullet) is automatically loaded from a magazine into the gun barrel.

The design of firearms in recent years, and in particular handguns, has required the use of fewer moving parts to thereby make the handgun more reliable. With fewer moving parts in handguns, the cost of manufacture is significantly reduced, assembly/disassembly and maintenance are greatly simplified, and there is less chance of failure of such parts, resulting in an optimum design for the handgun characterized with high reliability and efficacy. In addition to improving the reliability and efficacy of handguns, the use of fewer moving parts results in a handgun which is light and compact, leading to more comfortable usage of the handgun and to the ability of conveniently concealing the handgun for self-defense purposes.

Conventional handguns, however, are complex in construction and operation and add additional components which substantially increase the overall weight of the handgun. Thus, in conventional handguns, since the number of moving parts is not sufficiently reduced to a minimum, there is no significant reduction in the cost of manufacture, weight and degree of compactness of the handgun. Furthermore, assembly/disassembly and maintenance of conventional handguns is complex, and the interaction of the components thereof lacks reliability and simplicity. Still further, the manufacture of conventional handguns is complex and expensive since such guns require the use of specialty tooling for the fabrication of the components thereof.

Moreover, because of inherent size limitations, small-sized handguns currently available have very limited fire power and very poor accuracy and tend to be relatively heavy and difficult to hold. Such handguns are typically 0.22, 0.25 or 0.32 caliber and have barrels which are no more than about two inches long. Accuracy is limited not only by the shortness of the barrel, but also by a tendency of the muzzle to rise when the gun is fired. Furthermore, because of the complexity of the action and the need to expel the casings of spent cartridges, it is very difficult to design a small-size handgun which can be fired semiautomatically.

Two important characteristics of semiautomatic handguns are minimum recoil and minimum cycle-time (i.e., the time between successive firings of the handgun). Other important factors are the gun weight and fire power. When a gun is fired the explosion of the gunpowder in the ammunition casing or shell creates a forward force on the bullet that propels the bullet out of the gun barrel. Basic physics requires that an equal and opposite force be exerted rearward by the bullet on the gun. This force is referred to as recoil. The portion of the recoil that is sensed by the gun user is referred to as "felt" recoil. The felt recoil is less than the total recoil because semiautomatic guns contain a spring or springs which absorb some of the energy released when the gun is fired.

Furthermore, as is well known, recoil of any handgun increases as the handgun, or that part of it which recoils, is decreased in weight or the power of the ammunition that is fired is increased. The physical reason is that a given cartridge will develop a characteristic amount of recoil momentum, for a particular length of barrel, regardless of the type of the handgun in which it is fired. This recoil momentum results in an increase in the energy of recoil which is proportional to the square of the recoil momentum and varies inversely with the mass of the recoiling part. In other words, doubling the recoil momentum by increasing the power of the cartridge will quadruple the recoil energy of the handgun. Reducing the recoiling mass, on the other hand, by fifty percent will double the recoil energy. Therefore, since reducing the weight of a handgun and increasing the power of the ammunition substantially increases the handgun's recoil, recoil is a critical problem in stability of light-weight handguns when firing powerful ammunition.

Moreover, because the gun barrel wherein the recoil force is applied is usually slightly above the wrist of the user, a moment is created about the wrist that tends to rotate the gun barrel upward after firing. In a semiautomatic handgun the result is that the handgun must be re-aimed before it can be fired again. Excessive recoil can also lead to wrist injury after repeated use. It can be appreciated, therefore, that minimal felt recoil is a desirable attribute for handguns since it will reduce the time required to re-aim the handgun.

The present invention overcomes many of the disadvantages inherent in the manufacture, assembly/disassembly, use and maintenance of conventional handguns.

SUMMARY OF THE INVENTION

It is an object of the present invention is to provide a semiautomatic handgun of lightweight, compact and economical construction which facilitates manufacture.

It is another object of the present invention to provide a semiautomatic handgun which is small enough to be carried in a pocket or otherwise concealed on the body of a person.

It is another object of the present invention to provide a semiautomatic handgun in which specialty tooling for the manufacture thereof is kept to a minimum.

It is another object of the present invention to provide a semiautomatic handgun in which the number of moving components is reduced to a minimum and the interaction of these components is reliable and simple.

It is another object of the present invention to provide a semiautomatic handgun having a double-action trigger and firing assembly which allows for a smoother, simpler and more consistent trigger action providing improved firing accuracy.

It is another object of the present invention to provide a semiautomatic handgun having constructional features which provide for improved assembly and disassembly of the components thereof.

It is still another object of the present invention to provide a semiautomatic handgun which can be operated by smooth, consistent trigger action providing improved accuracy.

It is still another object of the present invention to provide a semiautomatic handgun that reduces felt recoil and significantly reduces the cycle-time.

The foregoing and other objects of the present invention are carried out by a semiautomatic handgun having a frame and a barrel mounted on the frame. The barrel has a tubular portion defining a chamber for receiving a cartridge and a generally conical portion contiguous with the tubular portion. A slide is mounted on the frame and over the barrel and is longitudinally movable relative to the slide and the barrel. A trigger releases a firing mechanism for striking the cartridge.

In one embodiment, the semiautomatic handgun is a 9 mm semiautomatic handgun having an overall length of about 5.05 inches, an overall height of about 4.04 inches, and an overall thickness of about 0.925 inches. Preferably, the 9 mm semiautomatic handgun has an unloaded weight of about 12.9 ounces.

The semiautomatic handgun further comprises a grip for receiving the hand of a shooter. A line extending perpendicular to a central axis of the barrel intersects the grip at a preselected angle such that the barrel will be aligned axially with the forearm of the shooter when the grip is held in the hand with the top of the shooter's wrist level with the top of the forearm. Preferably, the preselected angle is in the range of about 9 to 11 degrees.

The trigger is pivotally mounted on the frame for movement between a rest position and a depressed position. A hammer is pivotally mounted on the frame in spaced relation to the trigger. A trigger bar is pivotally connected to the trigger and extends into operative relation with the hammer for cocking the hammer when the trigger is moved to the depressed position. A biasing member has a first end connected to the frame and a second end connected to the trigger bar for biasing the trigger bar in a direction into operative relationship with the hammer and in a direction for returning the trigger to the rest position from the depressed position.

The frame has a first boss and a second boss adjacent the first boss. The biasing member preferably comprises a torsion spring having a first loop portion encircling the first boss of the frame, a second loop portion extending from the first loop portion at the first end of the torsion spring and resting on the second boss of the frame, at least one coil, and a foot portion connected to the coil at the second end of the torsion spring and connected to the trigger bar.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings:

FIG. 1 is a rear perspective view of a semiautomatic handgun according an embodiment of the present invention;

FIGS. 2A-2F show the semiautomatic handgun according to the present invention, where FIG. 2A is a left view in side elevation, FIG. 2B-2E are rear, top, bottom and front views, respectively, and FIG. 2F is a right view in side elevation;

FIGS. 17A and 17B are front and rear perspective views, respectively, FIGS. 17C-17D are left and right views in side elevation, respectively, and FIGS. 17E-17H are top, front, rear and bottom views, respectively;

FIG. 18A is a front perspective view, FIGS. 18B-18C are left and right views in side elevation, respectively, and FIGS. 18D-18G are top, bottom, front and rear views, respectively;

FIG. 19A is a rear perspective view, FIG. 19B is a left view in side elevation, and FIGS. 19C-19F are top, bottom, front and rear views, respectively;

FIG. 20A is a front perspective view, FIG. 20B is right-view in side elevation, and FIG. 20C is a front view;

FIG. 21A is a front perspective view, FIG. 21B is right view in side elevation, and FIG. 21C is a front view;

FIG. 22A is a perspective view and FIGS. 22B and 22C are side views in side elevation;

FIG. 23A is a perspective view and FIG. 23B is a view in side elevation;

FIG. 24A is a perspective view, FIG. 24B is a view in side elevation, and FIG. 24C is a front view;

FIG. 25A is a view in side elevation and FIG. 25B is a perspective view;

FIG. 26A is a view in side elevation and FIG. 26B is a perspective view;

FIG. 27A is a view in side elevation and FIG. 27B is a perspective view;

FIG. 29A is a view in side elevation and FIG. 29B is a perspective view;

FIG. 30A is a front view and FIG. 30B is a rear view;

FIG. 31A is a view in side elevation and FIG. 31B is a perspective view;

FIG. 32A is a view in side elevation and FIG. 32B is a perspective view;

FIG. 35A is a left view in side elevation and FIG. 35B is a right view in side elevation;

FIG. 37 is a rear perspective view of a semiautomatic handgun according another embodiment of the present invention;

FIGS. 38A-38F show the semiautomatic handgun of FIG. 37, where FIG. 38A is a left view in side elevation, FIG. 38B is a right view in side elevation, and FIGS. 38C-38F are front, rear, bottom and top views, respectively;

FIGS. 40A and 40B are rear and front perspective views, respectively, FIG. 40C is a right view in side elevation, FIG. 40D is a top view, and FIG. 40E is a left side longitudinal sectional view taken along line 40E-40E in FIG. 40D;

FIG. 41A is a front view, FIG. 41B is a right side longitudinal sectional view taken along line 41B-41B in FIG. 41A, FIG. 41C is a bottom view, and FIG. 41D is a left side longitudinal sectional view taken along line 41D-41D in FIG. 41C;

FIG. 42A is a rear perspective view, FIG. 42B is a left view in side elevation, FIGS. 42C-42F are bottom, front, rear and top views, respectively, and FIG. 42G is a left side longitudinal sectional view taken along line 42G-42G in FIG. 42F;

FIG. 43A is a perspective view, FIG. 43B is a view in side elevation, FIG. 43C shows the position of the extractor relative to an external surface portion of the slide when a live cartridge is chambered, FIG. 43D is an enlarged view of circled area A in FIG. 43C, FIG. 43E shows the position of the extractor relative to an external surface portion of the slide when a live cartridge is not chambered, and FIG. 43F is an enlarged view of circled area B in FIG. 43E;

FIG. 44A is a perspective view, FIG. 44B is a top view, and FIG. 44C is a view in side elevation;

FIGS. 45A-45B show the magazine catch used in the semiautomatic handgun of. FIG. 37, where FIG. 45A is a perspective view and FIG. 45B is a view in side elevation;

FIG. 46A is a side view of the guide rod assembly in the assembled, uncompressed state, FIG. 46B is an exploded view of the guide rode assembly, FIG. 46C is a side view of the guide rod assembly in the assembled, compressed state, FIGS. 46D-46F are cross-sectional views of the sleeve member, cap member, and head member, respectively, of the guide rod assembly, and FIG. 46G is a partial view showing the positional relationship between the uncompressed guide rod assembly and the frame, slide and barrel of the semiautomatic handgun;

FIG. 49A is a side view, FIG. 49B is a sectional view taken along line 49B-49B in FIG. 49A, and FIG. 49C is a sectional view taken along line 49C-49C in FIG. 49B; FIGS. 50A-50C are a right view in side elevation, a bottom view, and a top view, respectively, and FIG. 50D is a sectional view taken along line 50D-50D in FIG. 50C.

DETAILED DESCRIPTION OF THE PREFERRED EMBODIMENTS

Figure 2E:
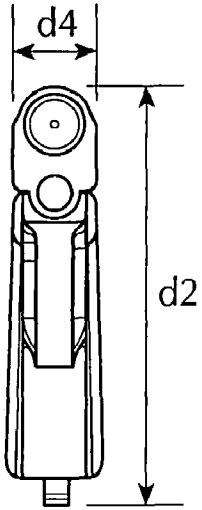

While this invention is susceptible of embodiments in many different forms, this specification and the accompanying drawings disclose only presently preferred embodiments of the invention. The invention is not intended to be limited to the embodiments so described, and the scope of the invention will be pointed out in the appended claims.

Certain terminology is used in the following description for convenience only and is not intended to be limiting. The words right, left, front, rear, upper, lower, inner, outer, clockwise, counterclockwise, rearwardly and forwardly designate directions in the drawing to which reference is made. Such terminology includes the words above specifically mentioned and words of similar import.

In the following description of the preferred embodiments of the present invention, the term "about" is used to quantify the preferred dimensions and weights of the semiautomatic handgun and its components. The term "about" is defined to cover the specific dimensions and weights described as well as values within a range of ±10% of the specific dimensions and weights described.

Referring now to the drawings in detail, wherein like numerals are used to indicate like elements throughout, there is shown in FIGS. 1-34 and 36 an embodiment of a semiautomatic handgun 1 according to the present invention. The semiautomatic handgun 1 generally comprises a frame 10, a hand grip 12 of ergonomic configuration integral with the frame 10, a slide 14 slidably mounted on the frame 10, a barrel 16 mounted to the frame 10, a firing mechanism or firing pin assembly indicated generally at 20, a guide rod assembly indicated generally at 21, a trigger assembly indicated generally at 22, and a hammer assembly indicated generally at 24.

Referring to FIGS. 17A-17H, the frame 10 is generally hollow and has a forward end indicated generally at 26, a rear end indicated generally at 28, a top indicated generally at 30, a first locating recess indicated generally at 32 disposed above a trigger guard 36 and generally between the forward end 26 and the rear end 28, a second locating recess indicated generally at 34 at the rear end 28, and a third locating recess indicated generally at 35 above the first locating recess 32. The hand grip 12 is located at the rear end 28 of the frame 10. The trigger guard 36 is integral with the frame 10 and the hand grip 12 and guards the trigger 18.

Figure 5:
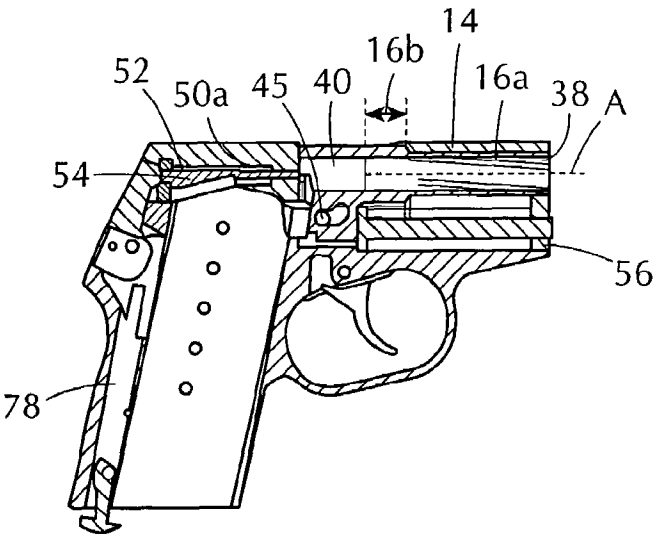
FIG. 5 is a right side longitudinal sectional view taken along the line 5-5 of FIG. 4.
Figure 8:
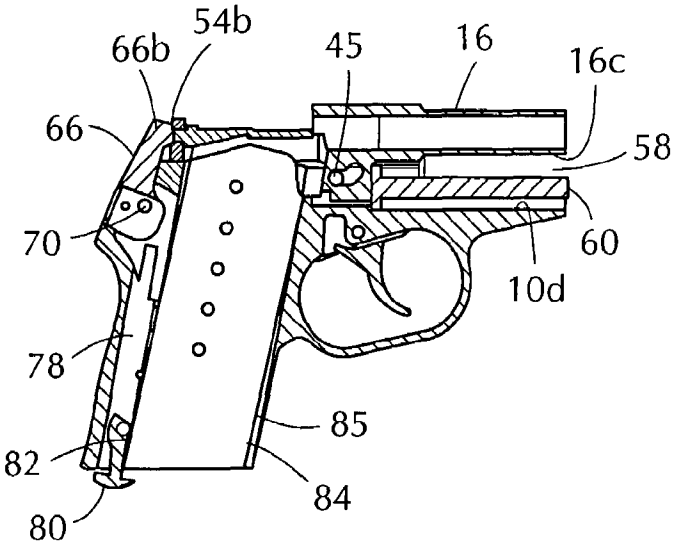
FIG. 8 is a right side longitudinal sectional view taken along the line 8-8 of FIG. 7.
Figure 10:
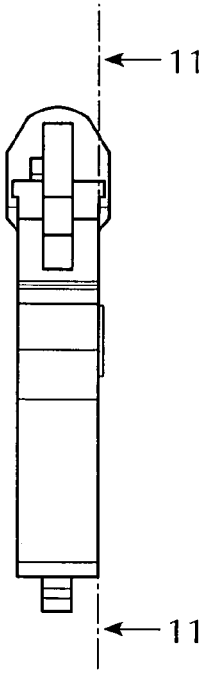
FIG. 10 is a view in rear elevation of the semiautomatic handgun according to the present invention with the right and left grip covers removed.

The barrel 16 is disposed on the top 30 of the frame 10. Referring to FIGS. 19A-19F, the barrel 16 has a bore 38 having an open end at a front end 16*d* of the barrel, a cartridge chamber 40 coaxial with the bore 38 for sequentially receiving live rounds or cartridges 42 (FIG. 13) to be fired, and a support portion 44 for connecting the barrel 16 to the frame 10. The support portion 44 has an inclined surface 44*a* defining a feed ramp for feeding the live cartridges from a magazine assembly, indicated generally at 46 in FIG. 3, to the cartridge chamber 40. The third locating recess 35 of the frame 10 defines a barrel slot 35*a* with a seat 35*b* which receive and properly position the barrel support portion 44. The barrel support portion 44 is mounted to the frame 10 by a connecting pin 45 (FIGS. 5 and 8) extending through a cam slot 44*b* formed in the barrel support portion 44 and corresponding aligned holes 10*a* formed in the frame 10 and retained therein with a friction fit. The cam slot 44*b* has a lower cam portion 44*c* and an upper cam portion 44*d*. Prior to firing the semiautomatic handgun, as shown in FIGS. 5 and 8, the connecting pin 45 rests against the lower cam portion 44*c*. As further described below, after the semiautomatic handgun is fired, the cam slot 44*b* allows the pressure of gases from the round to push the barrel 16 rearwardly and downwardly until the pin 44 rests against the upper cam portion 44*d*.

Figure 19A:
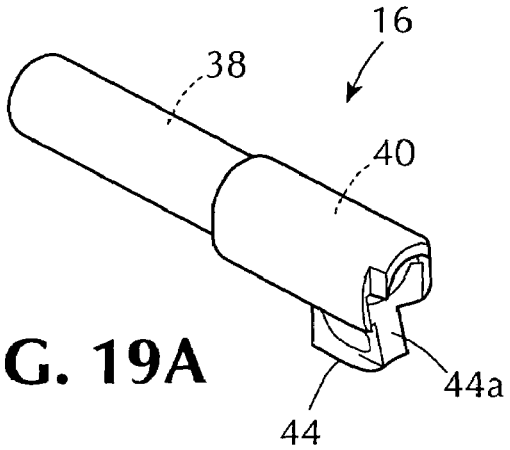
FIGS. 19A-19F show the barrel of the semiautomatic handgun according to the present invention, where
Figure 19B:
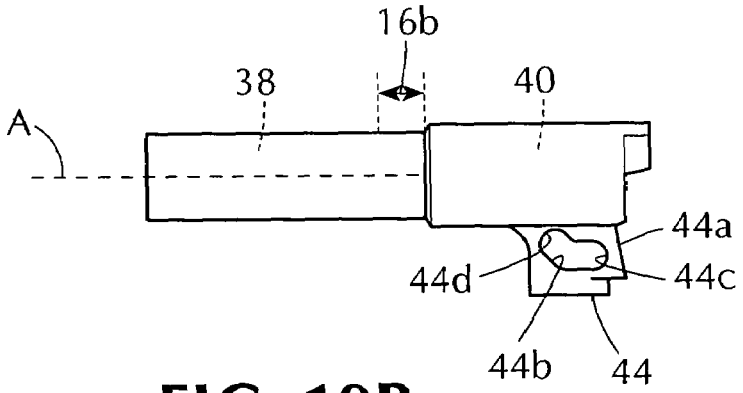
Figure 19C:
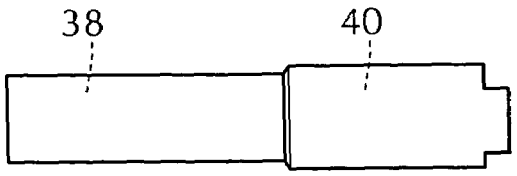
Figure 19D:
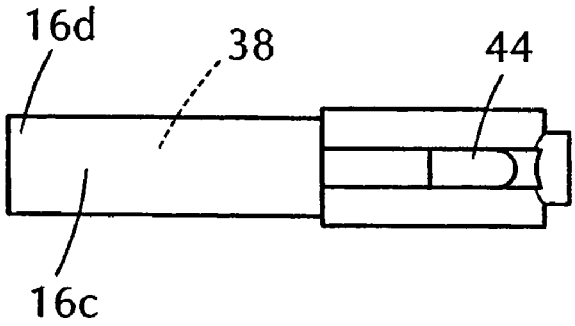
Figure 19E:
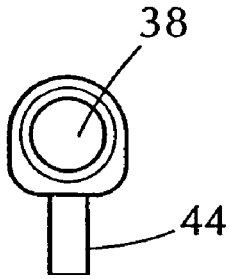
Figure 19F:
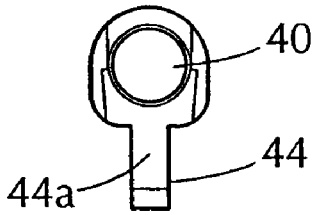
Figure 20A:
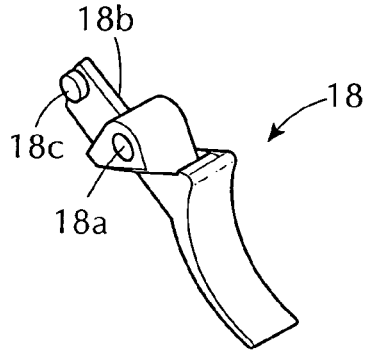
FIGS. 20A-20C show the trigger of the semiautomatic handgun according to the present invention, where
Figure 20B:
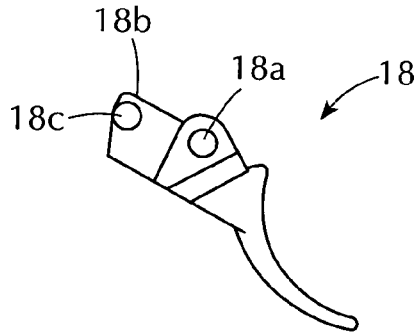
Figure 20C:
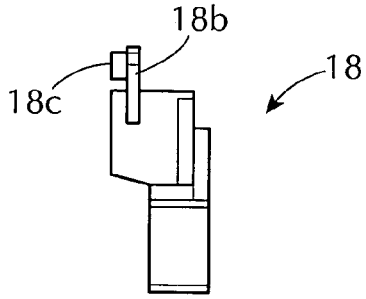
Figure 21A:
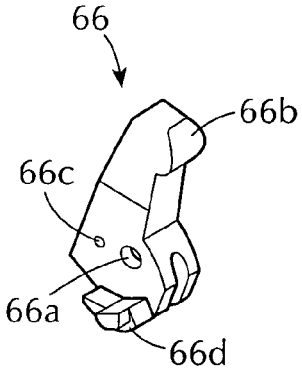
FIGS. 21A-21C show the hammer of the semiautomatic handgun according to the present invention, where
Figure 21B:
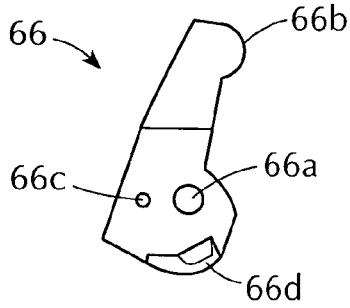
Figure 21C:
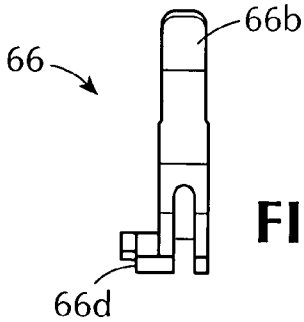
Figure 23A:
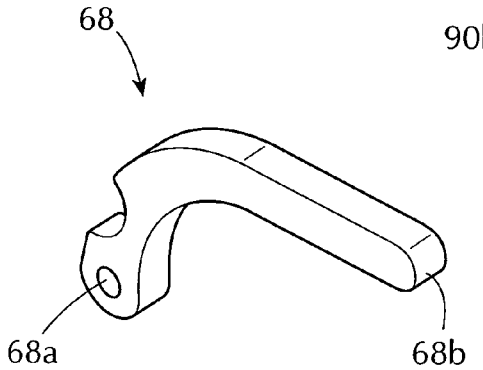
FIGS. 23A and 23B show the hammer strut used in the semiautomatic handgun according to the present invention, where
Figure 23B:
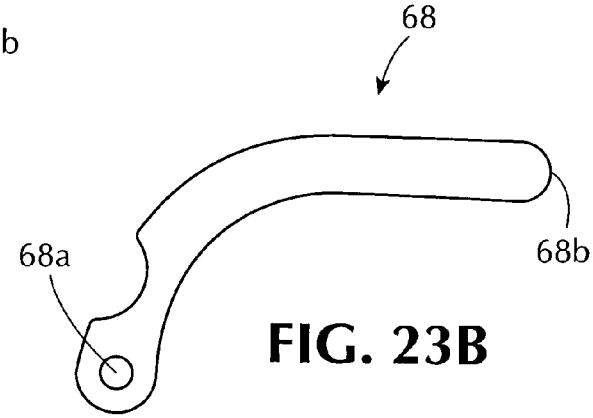

Referring to FIG. 5 and 19B, the bore 38 of the barrel 16 has a central axis A, a rifled bore portion 16*a* and a free or non-rifled bore portion 16*b*. The rifled bore portion 16*a* extends from the open end of the bore 38 toward the cartridge chamber 40. The free bore portion 16*b* is disposed between the rifled bore portion 16*a* and a forward end of the cartridge chamber 40. During a firing sequence, the free bore portion 16*b* allows the cartridge 42 to build momentum with less resistance at the time when the pressure of the gas in the cartridge chamber 40 is highest, allowing the gas to expand toward the forward end 26 of the frame 10, thereby decreasing the pressure applied against the slide 14. By this construction, since the pressure applied against the slide 14 during a firing sequence is reduced, recoil is reduced, and the slide 14 can be made smaller and lighter, thereby allowing reduction in both the size and weight of the semiautomatic handgun. Preferably, the free bore portion is about 0.250 inch in length.

Figure 13:
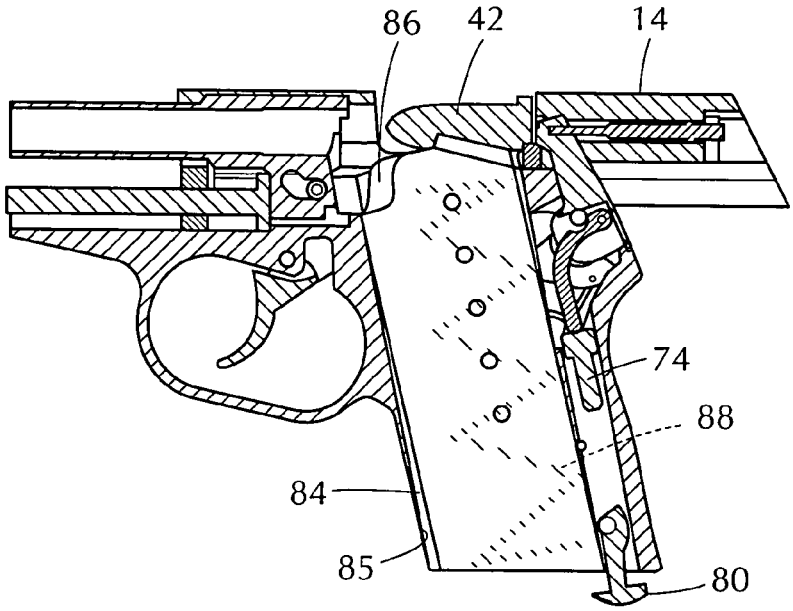
FIG. 13 is a left side longitudinal sectional view taken along the line 13-13 of FIG. 12 showing the slide in its most rearward position.
Figure 14:
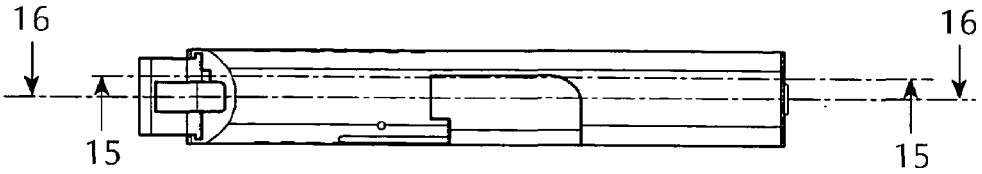
FIG. 14 is a top view of the semiautomatic handgun according to the present invention.

FIGS. 18A-18G show the slide 14 used in the semiautomatic handgun according to the present invention. The slide 14 comprises an elongate cover having forward and rear portions removably mounted over the top 30 of the frame 10. The slide 14 has a barrel hole 14*g* having a front open end 14*h* through which the front end 16*d* of the barrel 16 passes during a firing sequence of the semiautomatic handgun. The slide 14 is slidably mounted on the frame 10 for reciprocal longitudinal movement between first and second positions. The first position of the slide 14 is shown, for example, in FIG. 11 and corresponds to a firing position wherein the semiautomatic handgun is capable of firing. Firing of the semiautomatic handgun drives the slide 14 to the second position (i.e., towards the rear end 28 of the frame 10), as shown in FIG. 13, wherein the front end 16*d* of the barrel passes slidingly through the open end 14*h* of the barrel hole 14*g* of the slide 14 and wherein the empty casing of the cartridge is ejected. The slide 14 is preferably slidably mounted on the frame 10 in tongue-and-groove fashion, where the slide 14 is provided with depending flange portions 14*a* having longitudinal recesses 14*b* to slidably receive guide lugs 10*b* on side edges of the frame 10. The slide 14 is provided with serrations 48 to facilitate manipulation of the slide 14 by a user during operation of the semiautomatic handgun. The slide 14 has a longitudinal axis B which, in the assembled condition of the semiautomatic handgun, as shown in FIGS. 1 and 2A-2F, is coincident with the central axis A of the bore 38 of the barrel 16.

Figure 34:
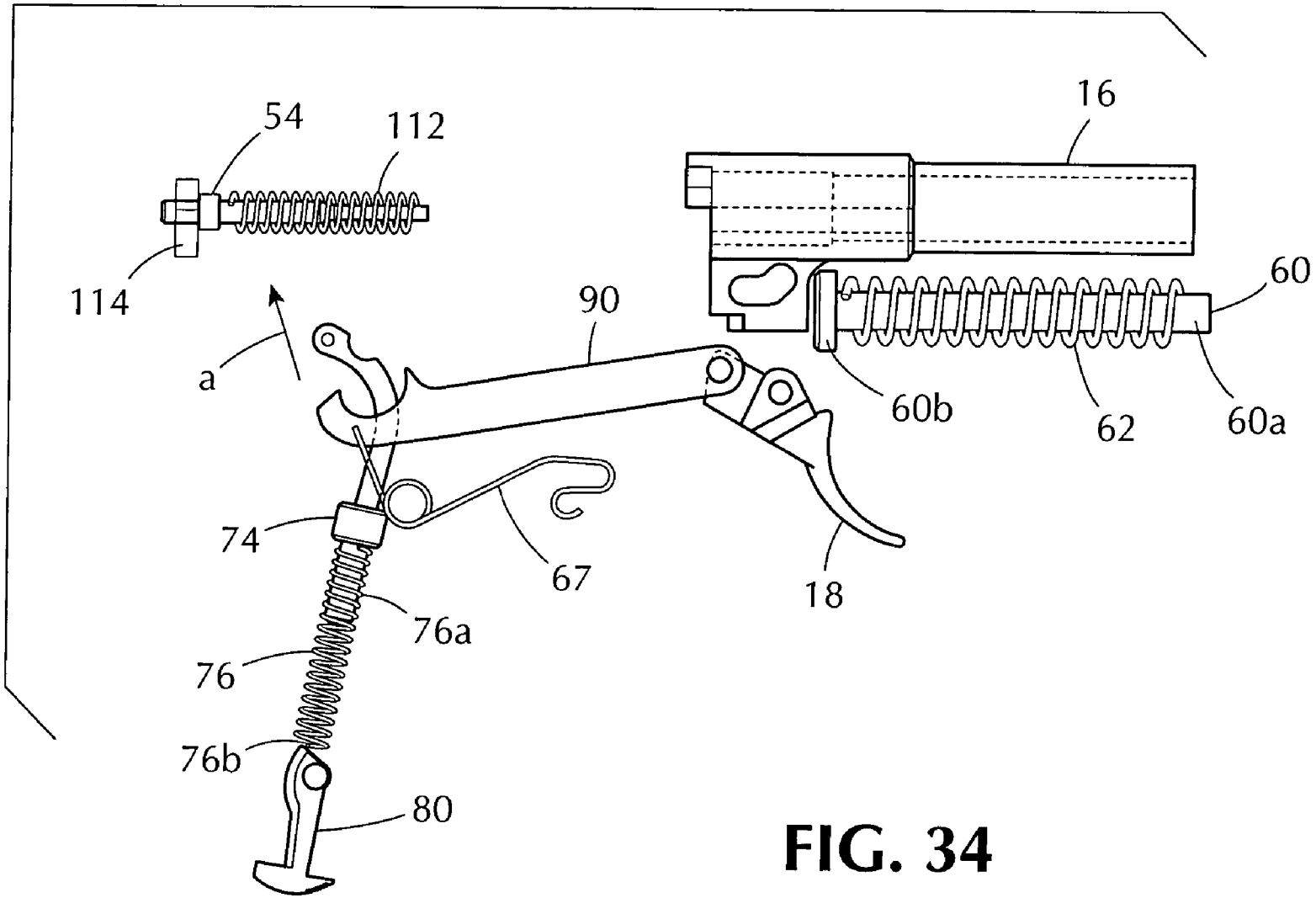
FIG. 34 is a diagrammatic view of the trigger mechanism, the firing pin, and components of the hammer assembly (with the trigger omitted for clarity purposes) of the semiautomatic handgun according to the present invention.
Figure 35A:
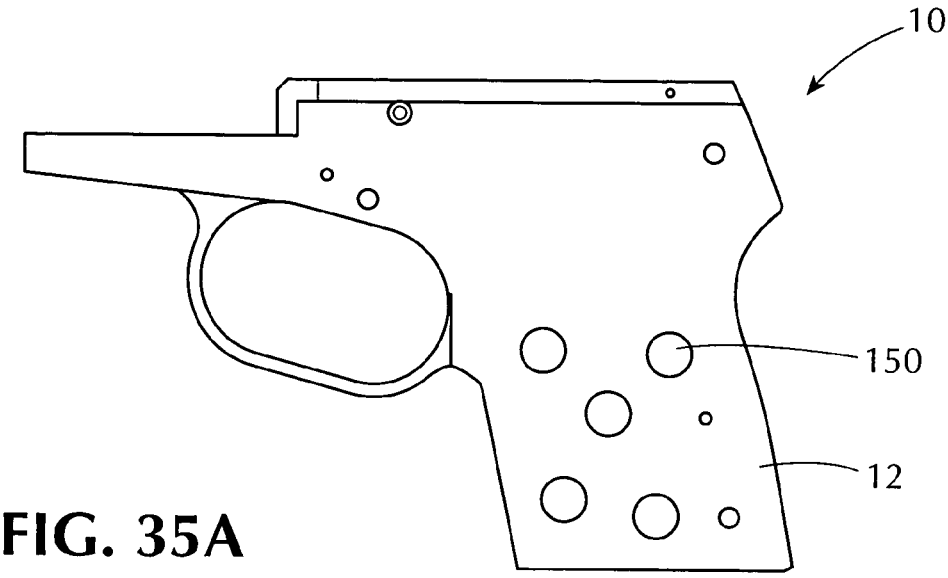
FIGS. 35A-35B show the frame used in the semiautomatic handgun according to another embodiment of the present invention, where
Figure 35B:
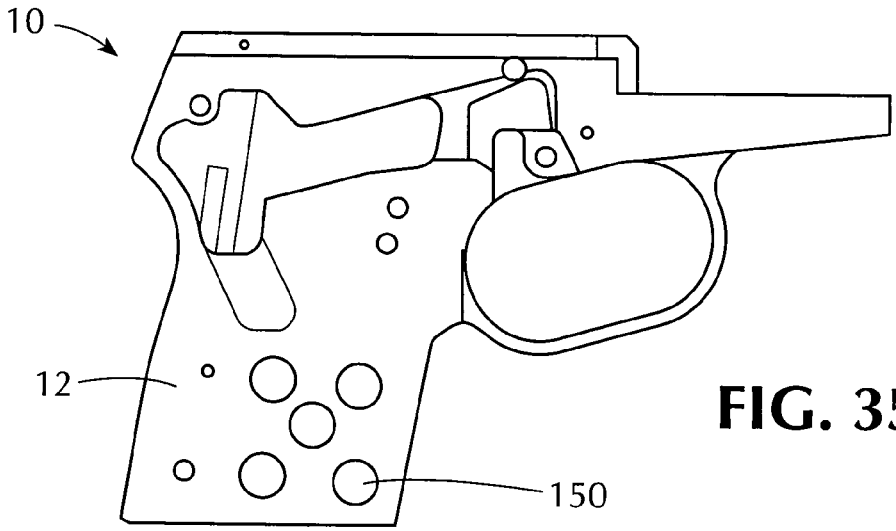

The rear portion of the slide 14 has a block 50 having an elongate passage, generally designated 52, for receiving a firing pin 54 of the firing pin assembly 20. The forward portion of the slide 14 has an abutment 56 which, together with walls 10*c*, 10*d* of the frame 10 and a peripheral wall portion 16*c* of the barrel 16, define a chamber 58 for housing a guide rod 60 and a recoil spring 62 mounted around a shank portion 60*a* of the guide rod 60 as shown in FIG. 34. The recoil spring 62 preferably comprises a double wound spring which urges the slide 14 to the first position (i.e., towards the forward end 26 of the frame 10) by applying spring pressure against the abutment 56 of the slide 14 and a head portion 60*b* of the guide rod 60. By this construction, the recoil spring 62 is operatively connected to the slide 14 for returning the slide 14 to the first position thereof. When the slide 14 is mounted on the top 30 of the frame 10 in the assembled condition of the handgun, as shown in FIGS. 1 and 2A-2F, the elongate passage 52 is coaxial with the cartridge chamber 40 and the bore 38 of the barrel 16 along the central axis A.

Figure 18B:
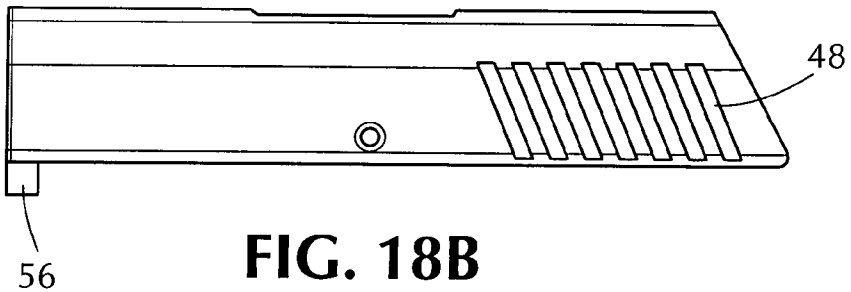
FIGS. 18A-18G show the slide of the semiautomatic handgun according to the present invention, where
Figure 18C:
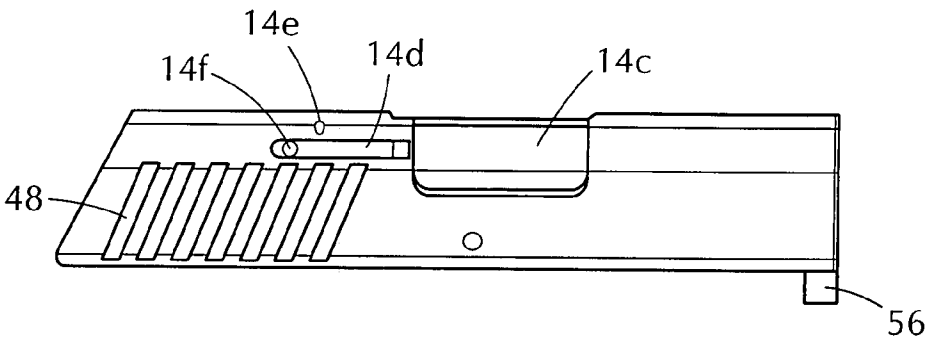
Figure 18A:
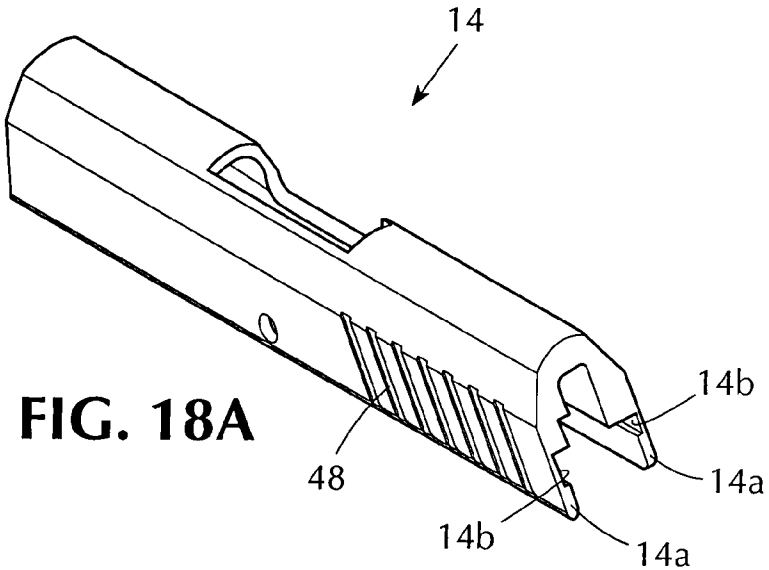
Figure 18D:
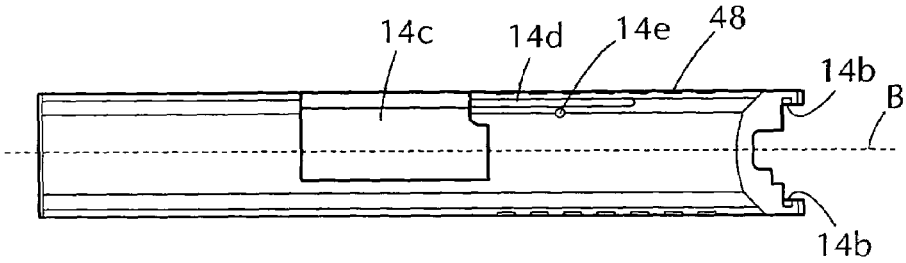
Figure 18E:
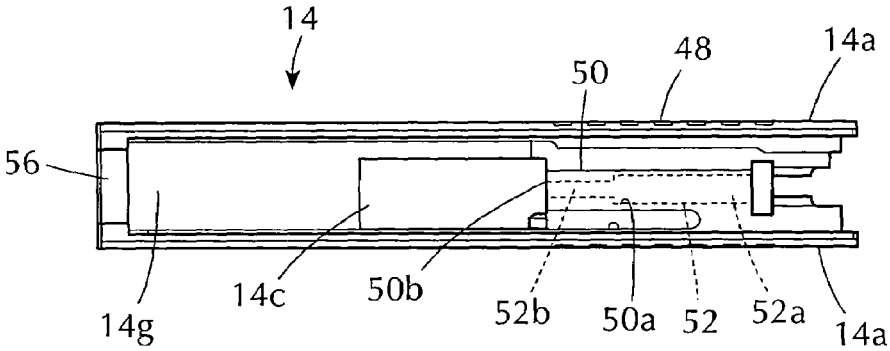
Figure 18F:
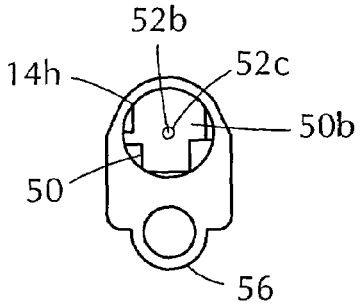
Figure 18G:
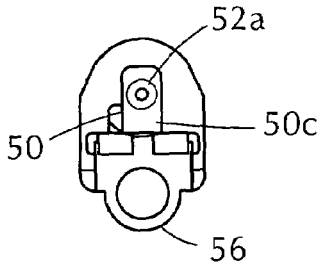

Referring to FIGS. 5 and 18E-18G, the elongate passage 52 has passage sections of decreasing diameter extending from the rear end to the forward end of the slide 14. More specifically, the elongate passage 52 has a first passage section 52*a* having a first diameter and a second passage section 52*b* having a second diameter smaller than the first diameter. The block 50 has a shoulder 50*a* disposed between the first and second passage sections 52*a*, 52*b*, a front wall defining a breech face 50*b*, and a rear wall 50*c*. As shown in FIG. 18F, an opening 52*c* of the elongate passage 52 extends through the breech face 50*b* of the block 50 adjacent to the second passage section 52*b* and is coaxial with the firing pin 54, the cartridge chamber 40 and the bore 38 of the barrel 16. The opening 52*c* has a diameter sufficient to allow passage therethrough of a forward end 54*a* of the firing pin 54 for striking the primer of the live cartridge 42 disposed in the cartridge chamber 40.

Referring to FIGS. 3, 8, 21A-21C, 31A-31B, 32A-32B and 34, the hammer assembly 24 comprises broadly a hammer 66 and a hammer strut 68. For clarity purposes only, the hammer 66 has been omitted from FIG. 34. The hammer 66 is pivoted to the frame 10 on a hammer pin 70 passing through an aperture 66*a* of the hammer 66 and apertures 10*e* of the frame 10 for engagement of its striker portion 66*b* with a rear end 54*b* of the firing pin 54. The hammer strut 68 is pivoted to the hammer 66 on a pin 72 passing through aperture 66*c* of the hammer 66 and an aperture 68*a* of the hammer strut 68. The hammer 66 is driven through the hammer strut 68 by a plunger 74 under the biasing force of a mainspring 76. More specifically, a lower end 68*b* of the hammer strut 68 engages a generally conical-shaped recess 74*a* in the head portion 74*b* of the plunger 74. An upper portion 76*a* of the mainspring 76 is disposed around a shank portion 74*c* of the plunger 74 and abuts a lower end of the head portion 74*b* thereof to bias the plunger upwardly as shown in FIG. 34. The mainspring 76, the plunger 74 and a lower portion of the hammer strut 68 are disposed in a tunnel 78 in the backstrap of the hand grip 12. A lower end 76*b* of the mainspring 76 presses against a magazine release catch 80 pivoted to the frame 10 on a pin 82 passing through an aperture 80*a* of the catch 80 and apertures 10*f* of the frame 10.

As shown in FIGS. 8 and 34, the catch 80 is urged counterclockwise by the mainspring 76 into latching engagement with the floorplate 46*a* of a cartridge magazine 84 of the magazine assembly 46 slidably retained in a magazine well 85 formed within the hand grip 12 of the frame 10. As shown in FIG. 13, the magazine assembly 46 comprises generally the cartridge magazine 84, the footplate 46*a*, a follower 86, and a spring 88. FIGS. 1 and 2A-2F show the assembled semiautomatic handgun without the magazine assembly in the magazine well 85. In FIGS. 4-16, the magazine assembly 46 is inserted in the magazine well, however, the floorplate 46*a*, which is shown in FIG. 3, is omitted from FIGS. 4-16 to facilitate illustration only. The magazine assembly 46 is of conventional design to hold a spring-loaded column of cartridges 42 which are fed one by one into the cartridge chamber 40 as the slide 14 is driven rearward either by hand or on recoil when the handgun is fired. It is understood by those skilled in the art that the biasing force of the mainspring 76 against the catch 80 is selected so that a user can easily manually urge the catch 80 clear of the floorplate 46*a* of the cartridge magazine 84 against the bias of the mainspring 76 to enable the magazine assembly 46 to be inserted into or withdrawn from the magazine well 85.

Figure 6:
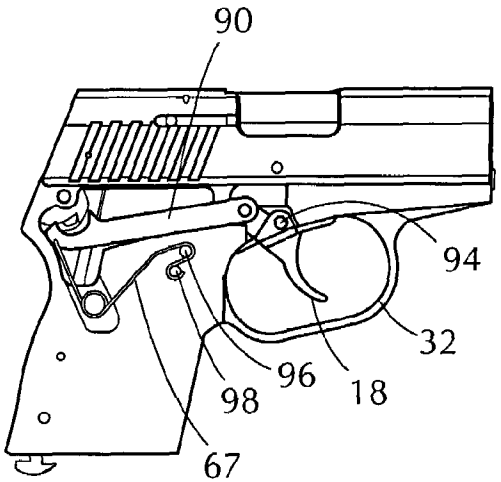
FIG. 6 is a right view in side elevation of the semiautomatic handgun according to the present invention with the right grip cover removed to show components of the trigger mechanism.
Figure 4:
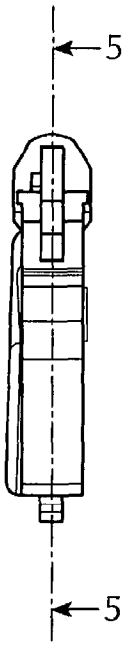
FIG. 4 is a view in rear elevation of the semiautomatic handgun according to the present invention with the right grip cover removed.
Figure 9:
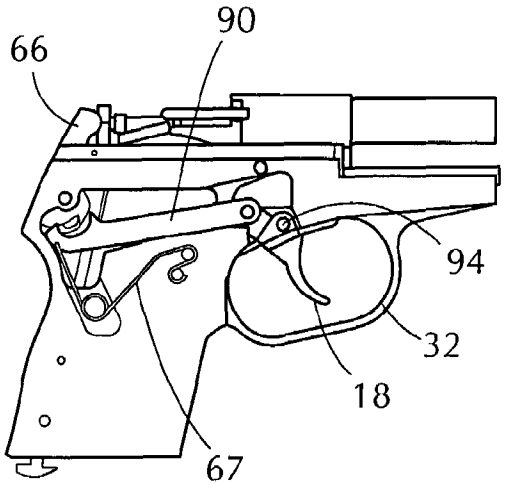
FIG. 9 is a right view in side elevation of the semiautomatic handgun according to the present invention with the slide and the right grip cover removed to show components of the trigger mechanism and the firing pin assembly.
Figure 7:
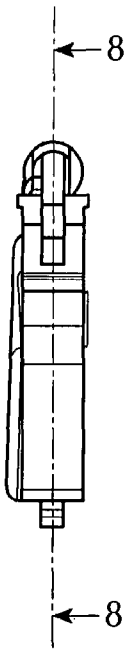
FIG. 7 is a view in rear elevation of the semiautomatic handgun according to the present invention with the slide and the right grip cover removed.
Figure 11:
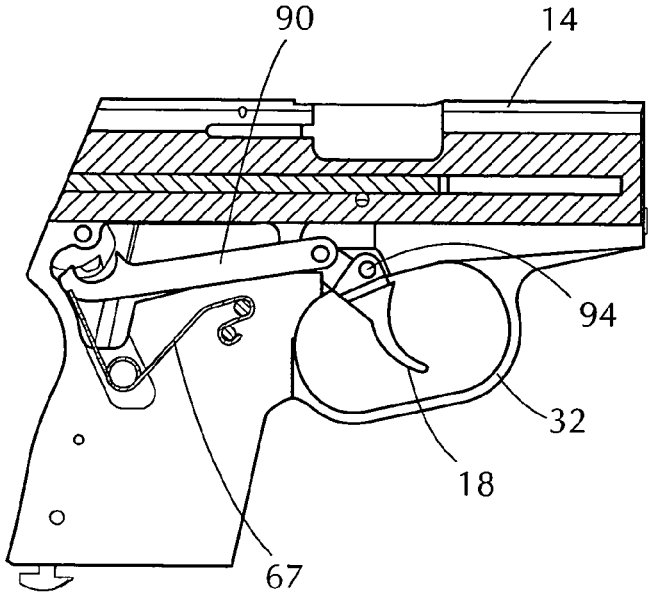
FIG. 11 is a right side longitudinal sectional view taken along the line 11-11 of FIG. 10.
Figure 12:
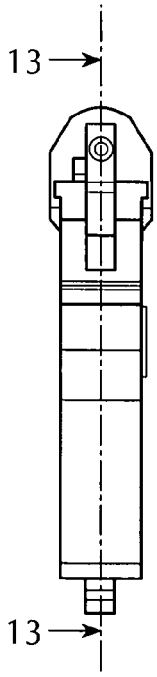
FIG. 12 is a view in rear elevation of the semiautomatic handgun according to the present invention with the right and left grip covers removed and the slide in its most rearward position.

Referring to FIGS. 3, 6, 9, 11, 17D, 20A-20C, 21A-21C, 22A-22B, and 34, the trigger assembly 22 comprises broadly the trigger 18, an elongated hammer-cocking trigger bar 90, and a biasing member 67. The trigger 18 projects outwardly from the frame 10 into a space defined by the trigger guard 32 and is pivotally connected to the-frame 10 by means of a connecting pin 94 passing through an aperture 18*a* of the trigger 18 and through an aperture log in the first locating recess 32 of the frame 10. The trigger 18 has an upward extension 18*b* to which is pivoted at a pin 18*c* a forward end 90*a* of the trigger bar 90. A rear end 90*b* of the trigger bar 90 is provided with a claw 90*c* which engages a cocking lug 66*d* on the lower end of the hammer 66 below the aperture 66*a*. Accordingly, when the trigger bar 90 is drawn forward (i.e., to the right as shown in FIGS. 6, 9 and 11) by pulling the trigger 18 clockwise, the hammer 66 is pivoted counterclockwise against the pressure of the mainspring 76 until the claw 90*c* of the trigger bar 90 passes under the cocking lug 66*d* releasing the hammer 66 to strike the firing pin 54.

The rear end 90*b* of the trigger bar 90 is urged upward and rearward (i.e., in the direction denoted by arrow a in FIG. 34) by the biasing member 67. Referring to FIGS. 6, 17D, 22A-22B, 33A-33B and 34, the biasing member 67 comprises a torsion spring having a foot portion 67*a* at one end extending into a hole 90*d* in the rear end 90*b* of the trigger bar 90. The torsion spring 67 extends from the rear end 90*b* of the trigger bar 90 to, and is pivotally supported on, a first boss 96 of the frame 10, by a first loop portion 67*b* at the forward end of the torsion spring 67 which encircles the pin 96. A second loop portion 67*c* extends from the first loop portion 67*b* and rests on a second boss 98 of the frame disposed below the first boss 96. A coil 67*d* of the torsion spring 67 has two arms 67*e* and 67*f* extending away from each other in opposite directions. The arm 67*f* extends forward to the first loop portion 67*b*, while the arm 67*e* extends rearward and is integrally connected to the rear end 90*b* of the trigger bar 90 by means of the foot portion 67*a*.

Figure 33A:
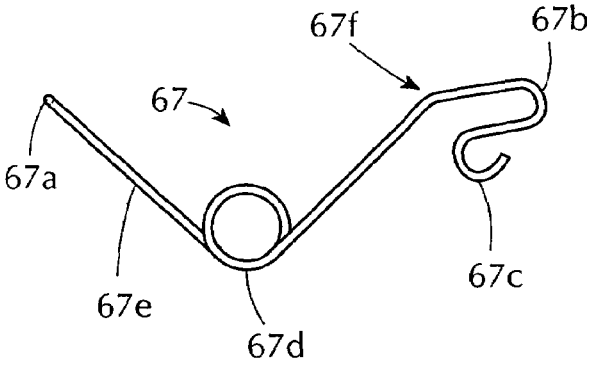
FIGS. 33A-33B are a side view and a perspective view, respectively, of the torsion spring used in the semiautomatic handgun according to the present invention.
Figure 33B:
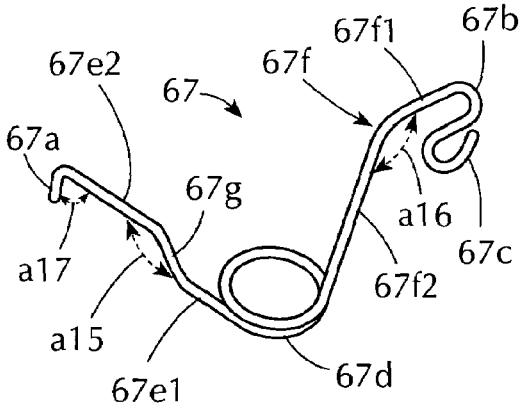

As best shown in FIG. 33A, the arm 67*f* of the torsion spring 67 has a first portion 67*f*1 extending from the first loop portion 67*b* and a second portion 67*f*2 connected to the first portion 67*f*1 and extending from the coil 67*d*. The first and second portions 67*f*1, 67*f*2 of the torsion spring 67 are disposed at an angle a16 relative to one another. As best shown in FIG. 33B, the arm 67*e* of the torsion spring 67 has a first portion 67*e*1 extending from the coil 67*d* and a second portion 67*e*2 extending from the foot portion 67*a* and connected to the first portion 67*e*1 via an offset portion 67*g*. Each of the first and second portions 67*e*1, 67*e*2 of the arm 67*e* are disposed at an angle a15 relative to the offset portion 67*g*. The foot portion 67*a* is disposed at an angle a17 relative to the second portion 67*e*2 of the arm 67*e*.

It will be appreciated by those of ordinary skill in the art that the values for the angles a15, a16 and a17 are selected so that, in the assembled state of the semiautomatic handgun 200, the torsion spring 67 lies substantially parallel to the surface of the frame 10 from which the bosses 96, 98 extend. For a 9 mm semiautomatic handgun, for example, the angle a15 is preferably about 30 degrees, the angle a16 is preferable about 150 degrees, and the angle a17 is preferably about 90 degrees.

A recess 10*h* is formed on one side of the hand grip 12 to accommodate the coil 67*d* of the torsion spring 67 in the assembled state of the semiautomatic handgun. In order to install the torsion spring 67, the arms 67*e*, 67*f* must be flexed toward each other stressing the coil 67*d*, so that a rearward force is exerted on the trigger bar 90 in the direction denoted by arrow a in FIG. 34 which in turn urges the trigger 18 in a counterclockwise direction as viewed in FIGS. 6, 9 and 11. The torsion spring 67 therefore acts as a trigger-return spring.

Referring again to FIGS. 6, 21A-21C and 22A-22B, the trigger bar 90 has an upwardly extending positioning portion 90*e* provided on the upper edge thereof forward of the claw 90*c*, and forming therewith a U-shaped section 90*f* that surrounds the cocking lug 66*d* on the hammer 66. As the hammer 66 is cocked during a triggering cycle, the positioning portion 90*e* is urged upward by the torsion spring 67 against a guide surface 10*i* of the frame 10 so that the claw 90*c* moves downward and the cocking lug 66*d* on the hammer 66 rides up the front edge of the claw 90*c* until it escapes the tip of the claw 90*c* releasing the hammer, which is then free to fall under the force exerted on it by the mainspring 76.

During the triggering cycle, a straight surface 90*g* on the upper edge of the claw 90*c* of the trigger bar 90 rests on the underside of the cocking lug 66*d* on the hammer 66, so that when the trigger is released, the torsion spring 67 drives the trigger bar 90 rearward, with the surface 90*g* sliding along the bottom of the cocking lug 66*d* until the claw 90*c* returns to the position shown in FIGS. 6, 9 and 11. The upward force exerted by the first and second loop portions 67*b*, 67*c* of the torsion spring 67 causes the claw 90*c* to move upward as soon as the tip of the claw 90*c* passes rearward of the cocking 1 ug 66*d*. The upward movement of the claw 90*c* is limited by engagement of the positioning portion 90*e* with the guide surface 10*i* on the frame 10. It will be noted that the surface 90*g* of the trigger bar 90 is only slightly sloped relative to the direction in which the trigger bar 90 moves lengthwise in order to reduce the resistance to the rearward force exerted by the torsion spring 67. Furthermore, the force exerted by the torsion spring 67 rearwardly should be substantially greater than its upward force. This is readily obtained by properly coiling the torsion spring 67 and in selecting the point at which the torsion spring 67 engages the trigger bar 90 such that the desired amount and direction of the force exerted by the foot portion 67*a* on the torsion spring 67 is attained.

The dimensions of the trigger bar 90 are selected to achieve positive contact between the positioning portion 90*e* of the trigger bar 90 and the guide surface 10*i* of the frame 10 in order to ensure accurate movements of the corresponding parts during the triggering cycle as described above. Preferably, for a 9 mm semiautomatic handgun, the trigger bar 90 has a uniform thickness d40 in the range of about 0.050 to 0.060 inches, and more preferably 0.055 inches. The distance d45 between the positioning portion 90*e* and the forward end 90*a* of the trigger bar 90 is in the range of about 1.6 to 1.7 inches, and more preferably 1.645 inches. The angle a13 between a surface 90*i* of the positioning portion 90*e* and a side surface 90*h* of the trigger bar 90 is preferably in the range of about 128 to 129 degrees, and more preferably 128.4 degrees. The height of the portion of the trigger bar 90 containing the forward end 90*a* (i.e., the distance from the side surface 90*h* to the side surface directly opposite the side surface 90*h*) is preferably about 0.250 inches.

The hand grip 12 is disposed at the rear end 28 of the frame 10. Referring to FIGS. 2B, 2E, 17D and 30A-30B, the right and left sides of the hand grip 12 are provided with a right cover 100 and a left cover 102, respectively, which provide a grip to facilitate manipulation by the user. The right cover 100 is mounted on the right side of the hand grip 12 using suitable threaded screws 104, 106 passing through corresponding apertures 100*a*, 100*b* of the right cover 100 and threaded into corresponding threaded blind bores 10*j*, 10*k* of the frame 10. The left cover 102 is mounted on the left side of the hand grip 12 using suitable threaded screws 108, 110 passing through corresponding apertures in the left cover 102 and threaded into corresponding threaded blind bores 10*l*, 10*m* of the frame 10. A recess 112 is formed in rear side of the right cover 100 to accommodate portions of the torsion spring 67 and the trigger bar 90 so that these components do not contact the right cover 100 in the assembled state of the semiautomatic handgun and during movement of these components during a triggering cycle. The rear side of each of the covers 100, 102 is provided with blind bores 103, 105 (shown only in the right cover 100 in FIG. 30B) for accommodating corresponding opposite ends of the trigger pin 94 and the magazine release pin 82. By this construction, the covers 100, 102 are more positively engaged with the corresponding sides of the hand grip 12 when connected thereto by the threaded screws.

The firing pin assembly 20 of the semiautomatic handgun 1 according to the present invention will now be described in detail with reference to FIGS. 3, 24A-24C, 25A-25B and 34.

The firing pin assembly 20 comprises broadly the firing pin 54 movable within the elongate passage 52 in the block 50 of the slide 14 during a firing sequence between a rearward, cocked condition remote from the cartridge chamber 40, and a forward, fire condition proximate the cartridge chamber 46, a resilient biasing member 112 for biasing the firing pin 54 to its fire condition, and a retainer 114 for controlling movement of the firing pin 54 within the elongate passage 52 in the block 50 of the slide 14.

Figure 24A:
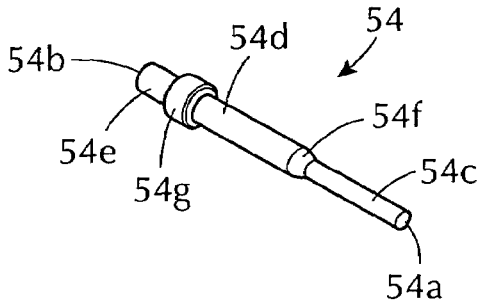
FIGS. 24A-24C show the firing pin used in the semiautomatic handgun according to the present invention, where
Figure 24B:
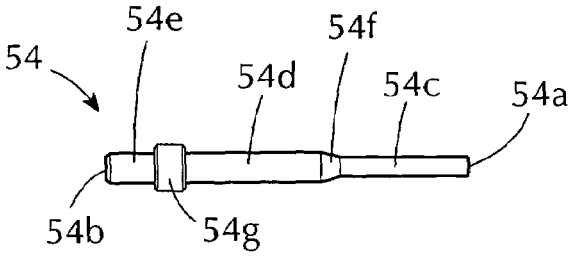
Figure 24C:
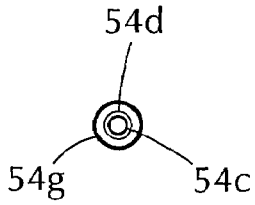
Figure 25A:
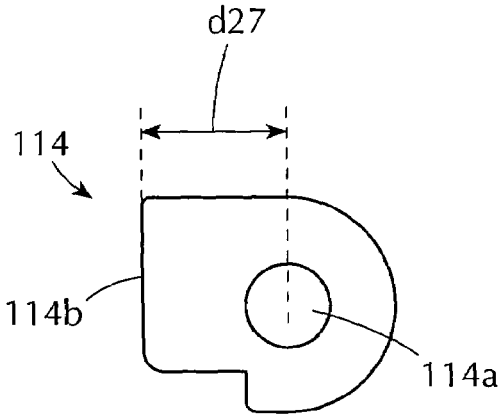
FIGS. 25A-25B show the firing pin retainer used in the semiautomatic handgun according to the present invention, where
Figure 25B:
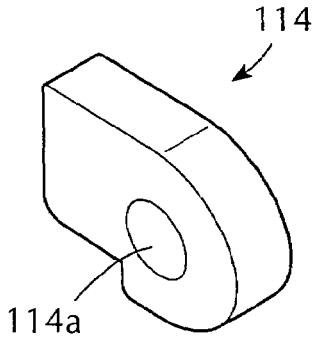

Referring to FIGS. 24A-24C, the firing pin 54 has a first cylindrical body portion 54*c* having the forward end portion 54*a* for movement within the second passage section 52*b* of the elongate passage 52 in the block 50 of the slide 14, a second cylindrical body portion 54*d* for movement within the first passage section 52*a* of the elongate passage 52, and a third cylindrical body portion 54*e* having the rear end portion 54*b*, a tapered portion 54*f* separating the first and second cylindrical body portions 54*c*, 54*d*, and a collar portion 54*g* disposed between the second and third cylindrical body portions 54*d*, 54*e* for guiding movement of the firing pin 54 within the elongate passage 52 in the block 50 of the slide 14 during a firing sequence. The third cylindrical body portion 54*e* has a greater diameter than the second cylindrical body portion 54*d* which has a greater diameter than the first cylindrical body portion 54*c*. The taper of the tapered portion 54*f* increases from the first cylindrical body portion 54*c* to the second cylindrical body portion 54*d*. The collar portion 54*g* has a greater diameter than each of the first, second and third cylindrical body portions 54*c*, 54*d*, 54*e*, respectively. Preferably, the entire firing pin 54 is formed as a unitary, one-piece structure from a single piece of material by a suitable manufacturing process. However, it is understood by those skilled in the art that the collar portion 54*g* may be formed separately from the remaining portions of the firing pin 54 and connected between the second and third cylindrical body portions 54*d*, 54*e* with a friction fit or by suitable connecting means, such as hardware and/or welding.

Figure 16:
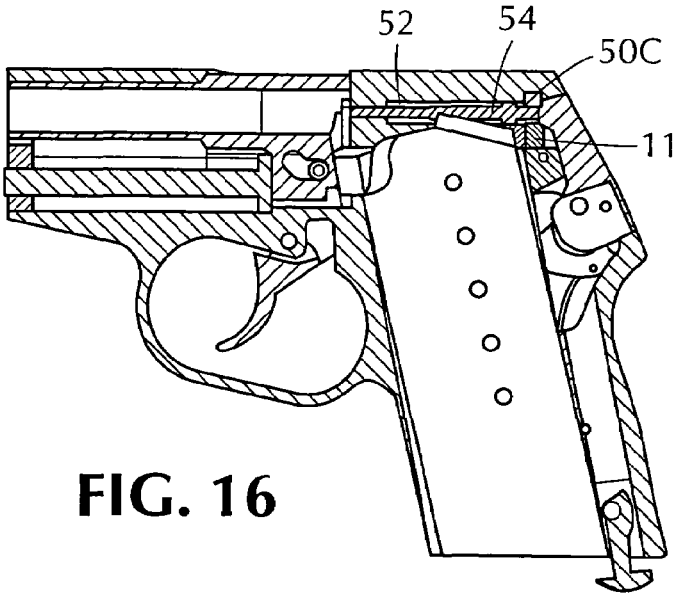
FIG. 16 is a left side longitudinal sectional view taken along the line 16-16 of FIG. 14.

The retainer 114 is mounted over the third cylindrical body portion 54*e* of the firing pin 54 by fitting the rear end portion 54*b* into an aperture 114*a* of the retainer with a friction fit. When the firing pin 54 is assembled in the semiautomatic handgun 1, the retainer 114 abuts against the rear wall 52*c* of the block 50 in the slide 14 as shown in FIG. 16. Preferably, the distance d27 between a center of the aperture 114*a* and a side surface 114*b* of the retainer 114 is in the range of about 0.244 to 0.246, and more preferably 0.245. By this construction, movement of the firing pin 54 in the direction toward the forward end of the frame 10 is limited by the rear wall 52*c* of the block 50 so that movement of the forward end portion 54*a* of the firing pin 54 is controlled to provide accurate discharge of a cartridge 42 in the cartridge chamber 40.

Preferably, the biasing member 112 comprises a long action firing spring disposed around the first and second cylindrical body portions 54*c*, 54*d* and the tapered portion 54*f* of the firing pin 54. The firing spring 112 is arranged to be placed under compression to propel the firing pin 54 towards the firing condition with a relatively strong, predetermined force. The firing spring 112 is anchored, at opposite ends thereof, between an inner surface of the collar portion 54*g* of the firing pin 54 and the shoulder 50*a* of the block 50 in the slide 14. In the assembled state of the semiautomatic handgun 1, as shown in FIGS. 5 and 16, the firing pin assembly 20 (the firing spring 112 being omitted for illustration purposes only) is movably mounted to the slide 14 with the elongate passage 52 coaxial with the cartridge chamber 40 and the bore 38 of the barrel 16 along the central axis A.

Figure 26A:
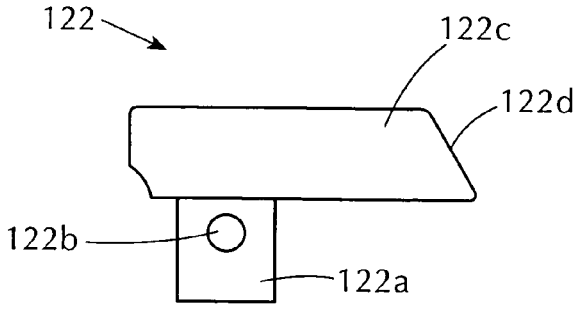
FIGS. 26A-26B show the ejector used in the semiautomatic handgun according to the present invention, where
Figure 26B:
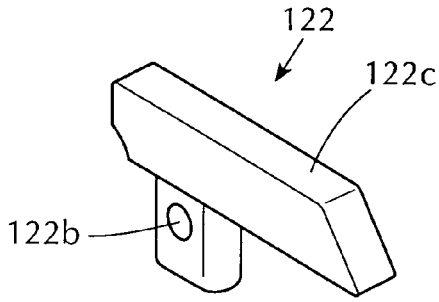
Figure 27A:
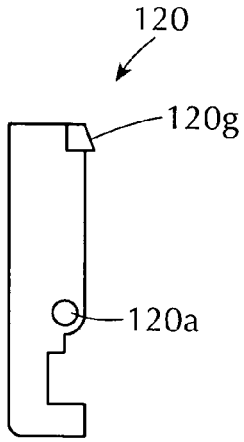
FIGS. 27A-27B show the extractor used in the semiautomatic handgun according to the present invention, where
Figure 27B:
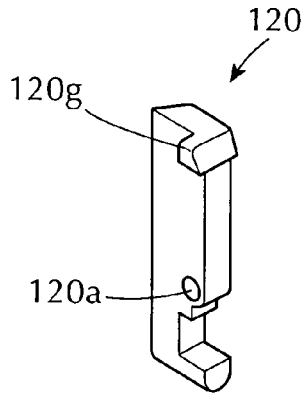
Figure 28:
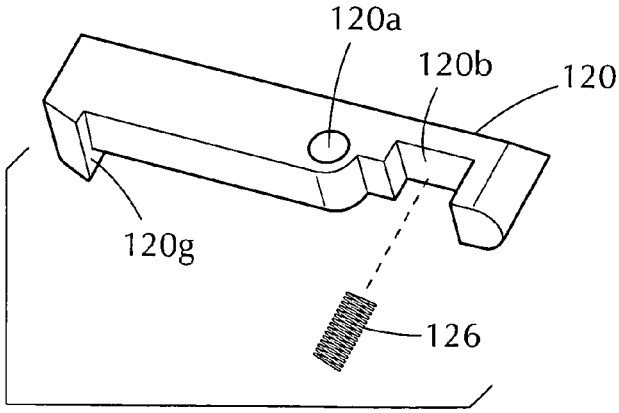
FIG. 28 is a diagrammatic view showing the extractor and corresponding spring used in the semiautomatic handgun according to the present invention.
Figure 29A:
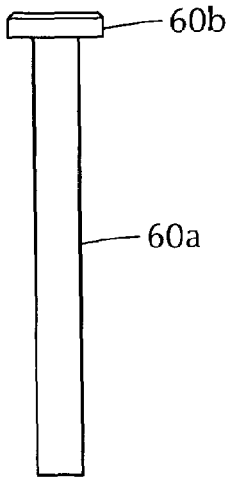
FIGS. 29A-29B show the recoil spring guide rod used in the semiautomatic handgun according to the present invention, where
Figure 29B:
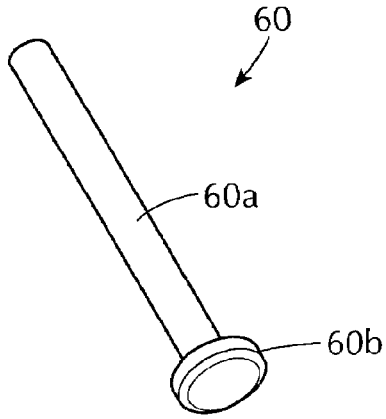
Figure 30A:
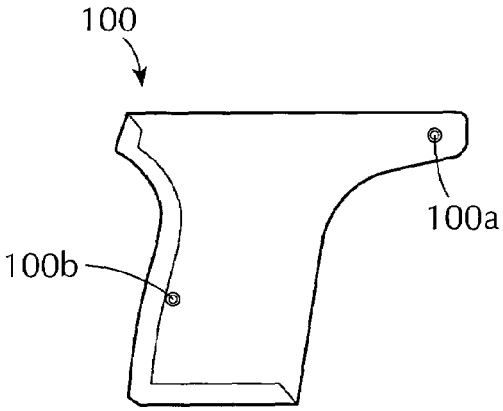
FIGS. 30A-30B show the right grip cover used in the semiautomatic handgun according to the present invention, where
Figure 30B:
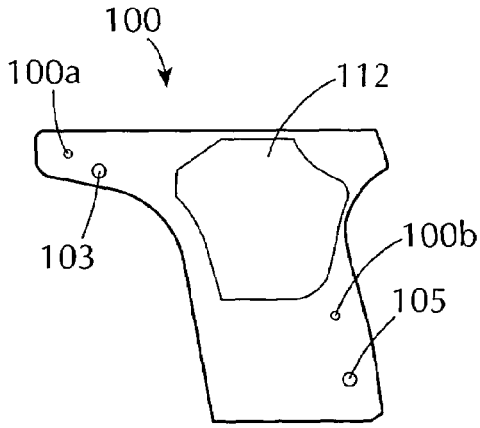
Figure 31A:
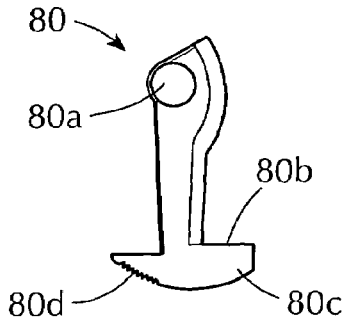
FIGS. 31A-31B show the magazine release used in the semiautomatic handgun according to the present invention, where
Figure 31B:
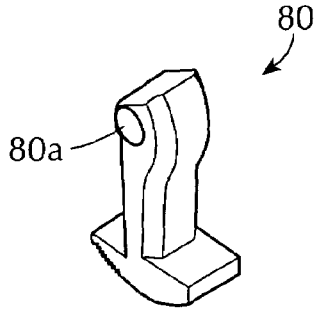
Figure 32A:
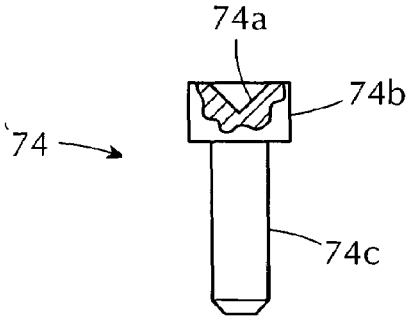
FIGS. 32A and 32B show the plunger used in the semiautomatic handgun according to the present invention, where
Figure 32B:
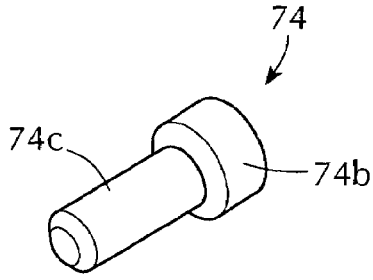

FIGS. 27A-27B and 28 show an extractor 120 for extracting an empty cartridge from the cartridge chamber 40 and FIGS. 26A-26B show an ejector 122 for ejecting the empty cartridge extracted by the extractor 120 out of an ejection port 14*c* in the slide 14 during movement of the slide 14 toward its second position upon firing a round. The extractor 120 has an extracting portion 120*g* which hooks on the rim of the empty casing and pulls it out of the cartridge chamber 40 after a firing sequence. The extractor 120 is mounted in a horizontal slot 14*d* of the slide 14 for pivotal movement by a connecting pin 124 which extends through an aperture 120*a* of the extractor 120 and a corresponding vertical aperture 14*e* of the slide 14. A biasing member 126 is anchored, at opposite ends thereof, between a surface 120*b* of the extractor 120 and a blind bore 14*f* formed in a rear wall of the horizontal slot 14*d* of the extractor 120. The biasing member 126 functions as a spring catch for retaining the extractor 120 in contact with the spent cartridge to effect extraction of the empty cartridge from the semiautomatic handgun when the slide 14 is driven to the second position thereof. The ejector 122 has a connecting portion 122*a* extending from an ejecting portion 122*c* and disposed in a recess 10*l* formed in the top 30 of the frame 10 adjacent one of the guide rails 10*b*. The ejector 122 is integrally connected to the frame 10 by a pin 128 extending through a horizontal aperture 122*b* formed in the connecting portion 122*a* of the ejector and through a corresponding horizontal aperture 10*n* in the frame 10. A horizontal aperture 10*x* is formed in the frame 10 in alignment with the horizontal aperture 10*n* to facilitate removal of the pin 128 during disassembly of the semiautomatic handgun 1. During movement of the slide 14 toward its second position upon firing a round, the extractor 120 pulls the empty cartridge from the cartridge chamber 40. When the slide 14 reaches its second position, a cam surface 122*d* of the ejecting portion 122*c* of the ejector 122 hits a lower rim portion of the empty cartridge, expelling the empty cartridge through the ejection port 14*c* in the slide 14.

Operation of the semiautomatic handgun 1 according to the present invention will be explained below with reference to the drawings.

In use, the shooter inserts a loaded magazine into the magazine well 85. If a cartridge 42 is not already positioned in the cartridge chamber 40, the slide 14 is first manually moved rearward toward the rear end 28 of the frame 10 against the bias of the recoil spring 62 and then released. By this operation, the slide 14 is allowed to be moved forward towards the front end 26 of the frame 10 under the bias of the recoil spring 62 causing a cartridge to be pushed from the magazine assembly 46 into the cartridge chamber 40. The semiautomatic handgun is now ready to be fired.

Figure 15:
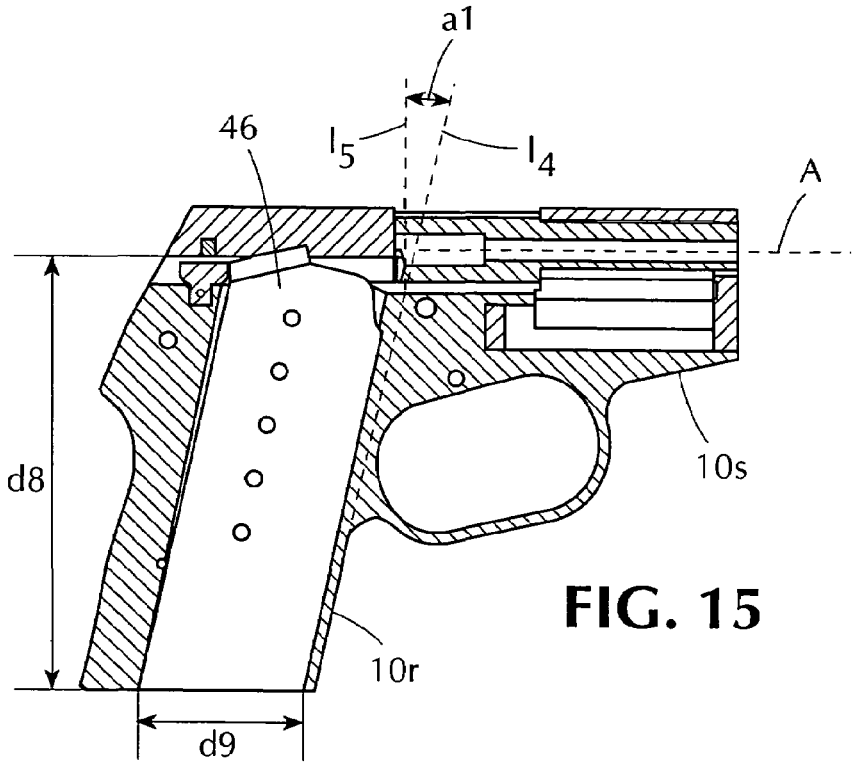
FIG. 15 is a right side longitudinal sectional view taken along the line 15-15 of FIG. 14.
Figure 50A:
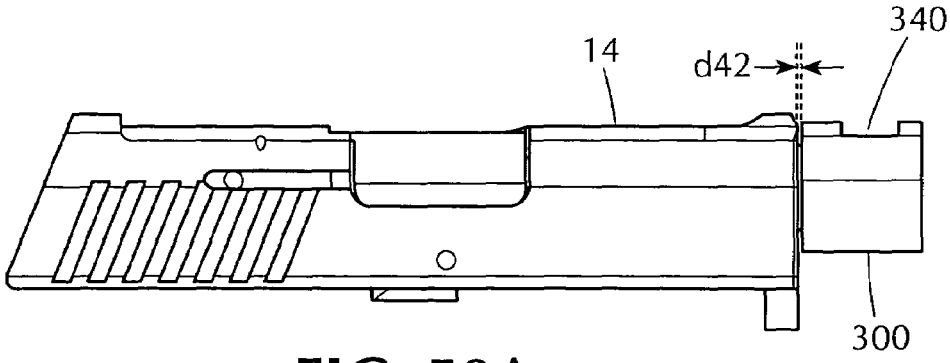
FIGS. 50A-50D show the connection and positional relationship between the compensator, the barrel and the slide, where
Figure 50B:
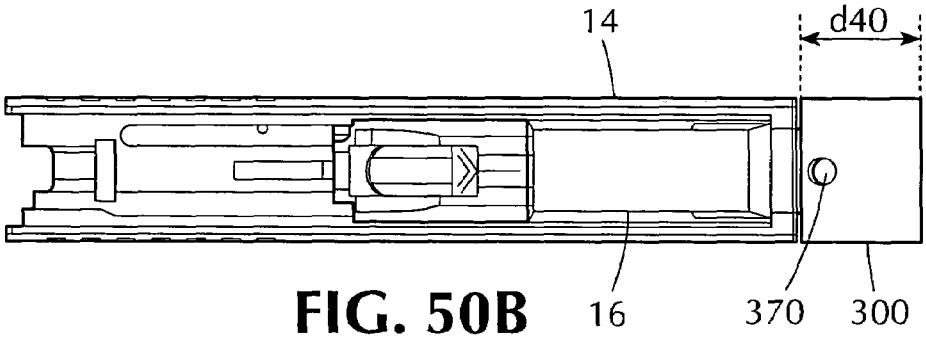
Figure 50C:
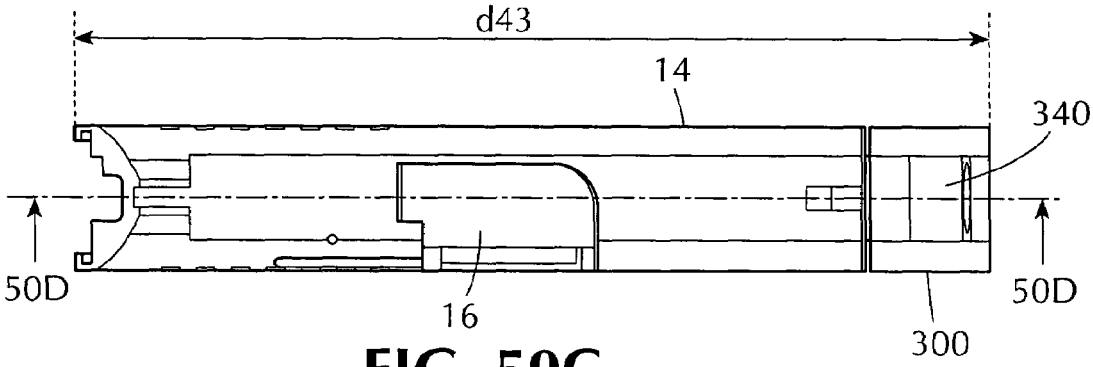
Figure 50D:
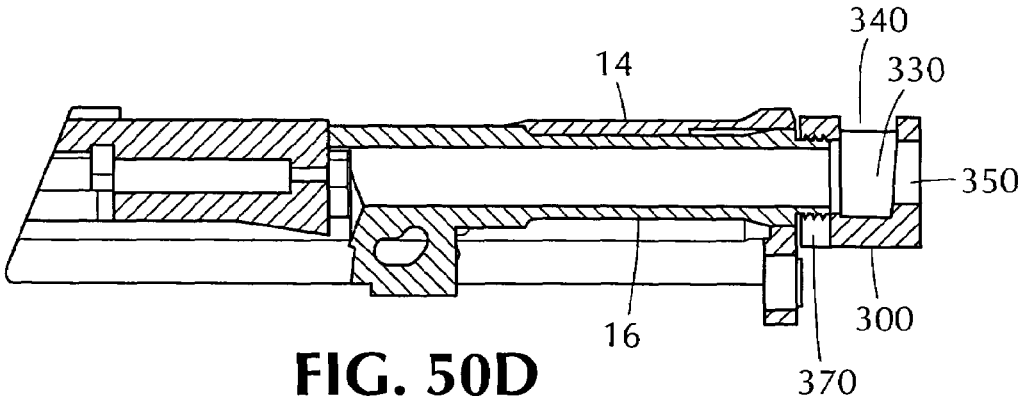

It will be appreciated that, prior to firing, the barrel 16 is in a locked breech condition with respect to the slide 14. More specifically, the barrel 16 is locked into the slide 14 by virtue of the contact between the outer surface portions of the chamber 40 of the barrel 16 and the corresponding portions of the ejection port 14*c* and breech face 50*b* of the slide 14 as shown in FIGS. 5, 15 and 16. The locked breech condition of the barrel 16 is also shown in FIG. 50D.

When the trigger 18 is pulled to the rear, the trigger bar 90 moves forward and its rear end 90*b* engages the cocking lug 66*d* of the hammer 66, thereby locking the hammer 66 to the rear in the cocked position. The rear end 90*b* of the trigger bar 90 rides the cocking lug 66*d* of the hammer 66 to its breaking point. At this time, the hammer strut 68 moves down into the tunnel 78 in the backstrap of the hand grip 12 compressing the mainspring 76. Under the spring power of the mainspring 76, the hammer 66 travels forward striking the firing pin 54 which in turn strikes the primer of the chambered round to ignite the gunpowder in the round. Gases generated upon ignition of the gunpowder forcefully push the bullet of the round into the free bore section 16*b* of the barrel 16 which allows the gases to flow forward, thereby reducing pressure which in turn reduces recoil. The bullet then moves forward into the rifled section 16*a* of the barrel 16 and then exits the semiautomatic handgun. The pressure of the gases push the empty casing of the round against the breech face 50*b* of the block 50 in the slide 14 pushing the slide 14 rearwardly and pushing the barrel 16 rearwardly and downwardly by means of the cam slot 44*b* of the barrel 16 as the front end 16*d* of the barrel passes through the open end 14*h* of the slide 14.

As the slide 14 moves to the rear, the extracting portion 120*g* of the extractor 120 hooks on the rim of the empty casing and pulls it out of the cartridge chamber 40. As the slide 14 reaches near the end of its rearward travel, a bottom left side of the empty casing is hit by the ejector 122 and, while still being pulled by the extractor 120, the empty casing is ejected out of the ejection port 14*c* of the slide 14. When it reaches the end of its rearward travel, the slide 14 moves forward under the power of the recoil spring 62, again stripping a new round from the magazine and positioning it in the cartridge chambers 40. The cycle is now complete and the semiautomatic handgun is now ready to be fired again.

From the foregoing construction and operation of the semiautomatic handgun 1 according to the present invention, it will be appreciated that the firing assembly 20, the trigger assembly 22, and the hammer assembly 24 constitute a double-action mechanism of the semiautomatic handgun. Stated otherwise, depression of the trigger 18 from the state of the handgun shown in FIG. 6 both cocks and releases the firing pin 54 to fire a round. This features allow for a smoother, simpler and more consistent trigger action providing improved firing accuracy over conventional handguns. Furthermore, by the double-action mechanism of the semiautomatic handgun of the present invention, the number of moving components is reduced to a minimum, thereby providing a semiautomatic handgun which is lightweight, compact and economical to manufacture, and in which the interaction of components is reliable and simple. Another advantage of the double-action mechanism of the semiautomatic handgun 1 according to the present invention is that it facilitates maintenance and provides for improved assembly and disassembly of the components thereof.

The frame 10 and the grip covers 100, 102 are preferably formed of aluminum, such as 7075-T6 aluminum. The recoil spring guide rod 60 is preferably formed of a suitable polymer, such as DELRIN®. The slide 14, the barrel 16, the trigger 18, the hammer 66, the firing pin 54, the firing pin retainer 114, the extractor 120, the ejector 122, the hammer strut 68, the plunger 74, the magazine catch 80, the trigger bar 90, and the pins are preferably formed of stainless steel, such as 17-4 stainless steel. The torsion spring 67, the firing pin spring 112, the mainspring 76 and the recoil spring 62 are preferably formed of spring steel. However, it is understood by those of ordinary skill in the art that other materials exhibiting a high ratio of strength to weight are suitable for the components of the semiautomatic handgun. For example, the grip covers can also be made of carbon fibers. Additionally, all of the components, except for the guide rod and the springs, can be manufactured of titanium. It will also be appreciated that the various components of the semiautomatic handgun may be constructed from cast or machined metal or polymers.

Referring again to FIGS. 2A and 2D-2F, the overall length d1 of the semiautomatic handgun 1 according to the present invention is preferably in the range of about 4.5 to 5.5 inches, and more preferably about 4.5 to 5.0 inches. The overall height d2 of the semiautomatic handgun 1 is preferably in the range of about 2.9 to 4.4 inches, and more preferably about 3.2 to 4.0 inches. The overall width or thickness d3 of the semiautomatic handgun 1, including the grip covers, is preferably in the range of about 0.85 to 0.98 inches, and more preferably about 0.90 to 0.95 inches. The overall width d4 of the slide 14 is preferably in the range of about 0.75 to 0.85 inches, and more preferably about 0.8 to 0.83 inches. The distance d5 between the top of the slide 14 and a lower front portion of the frame 10 is preferably in the range of about 0.95 to 1.25 inches, and more preferably about 1.0 to 1.15 inches. The length d6 of the bottom portion of the hand grip 12 is preferably in the range of about 1.6 to 2.0 inches, and more preferably about 1.75 to 1.9 inches. The distance d7 between two lines $l_1$, $l_2$ extending perpendicularly to a line $l_3$ connecting points 14*g* and 80*b* of the slide 14 and the magazine catch 80, respectively, is preferably in the range of about 5.0 to 6.75 inches, and more preferably about 5.5 to 6.5 inches. Preferably, the unloaded weight (i.e., the weight without the magazine 46 and without a round in the chamber) of the semiautomatic handgun 1 is in the range of about 11.5 to 12.75 ounces, and more preferably about 12.0 to 12.5 ounces.

Figure 2F:
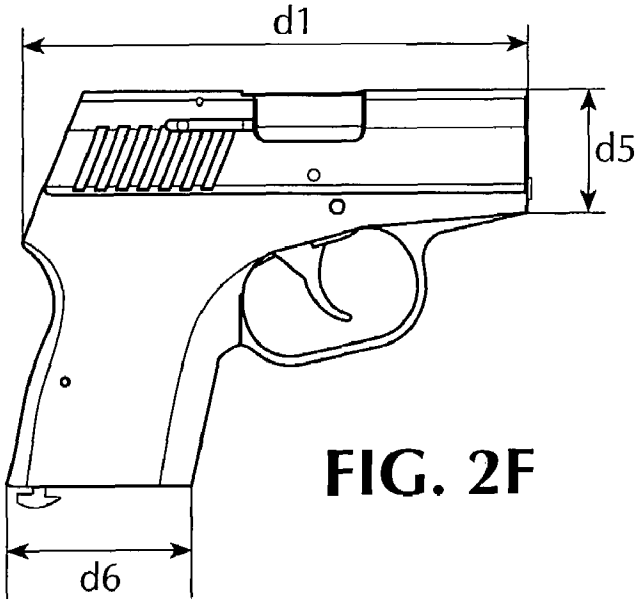
Figure 2D:
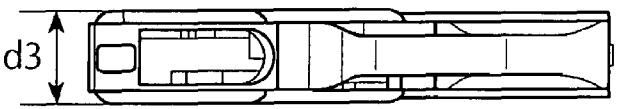
Figure 3:
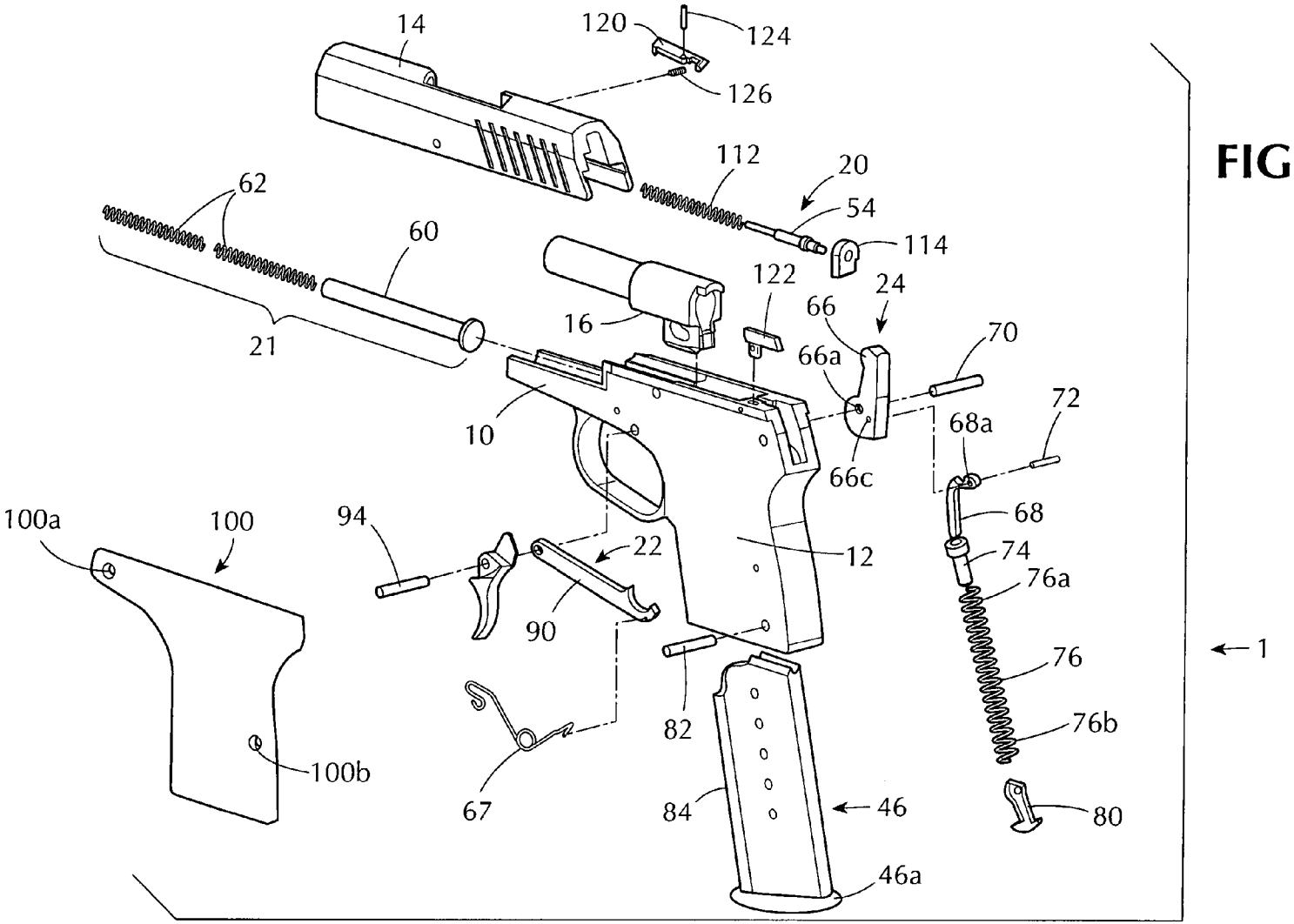
FIG. 3 is an exploded view of the semiautomatic handgun according to the present invention.

It will be appreciated by those skilled in the art that the overall height d2 of the semiautomatic handgun 1 and the length d6 of the bottom portion of the hand grip 12 shown in FIG. 2F will depend on the type of magazine 46 selected which will determine the height d8 and the length d9 of the magazine well 85 as shown in FIG. 15. The type of magazine 46 selected depends on the number of rounds desired to be held in the magazine.

As described in detail below, it will be appreciated by those skilled in the art that several structural features of the frame 10 and the right grip cover 100 facilitate the manufacture of the semiautomatic handgun 1 according to the present invention within the foregoing described preferred ranges of dimensions and weights to provide a semiautomatic handgun with exterior dimensions and an unloaded weight not previously achieved by the prior art.

Figure 17A:
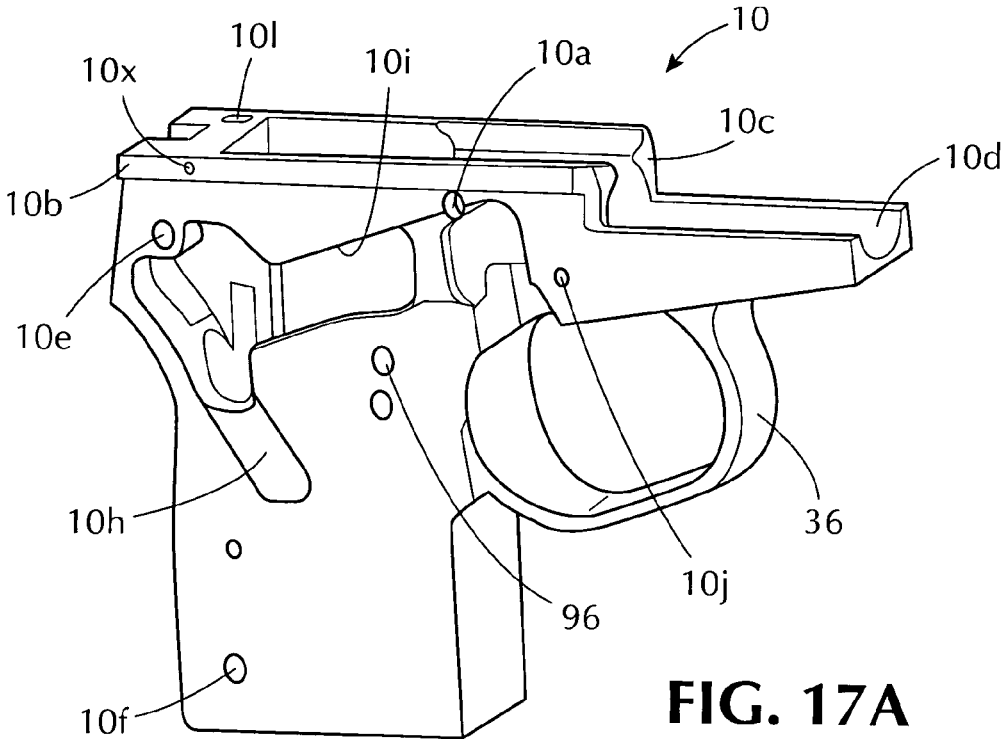
FIGS. 17A-17H show the frame of the semiautomatic handgun according to the present invention, where
Figure 17B:
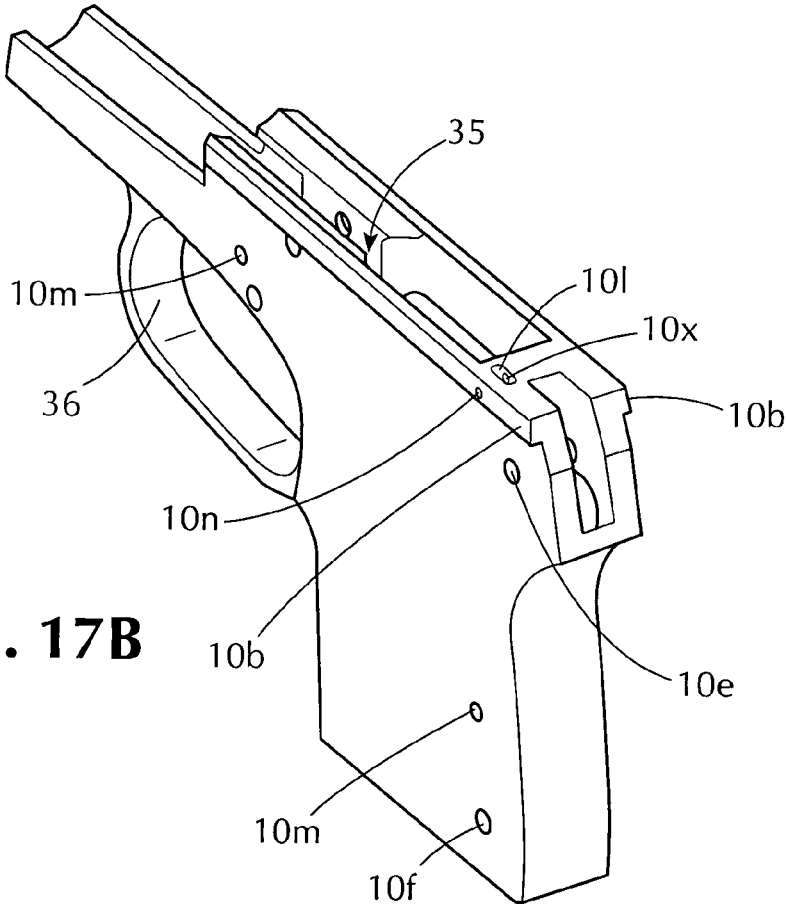
Figure 17C:
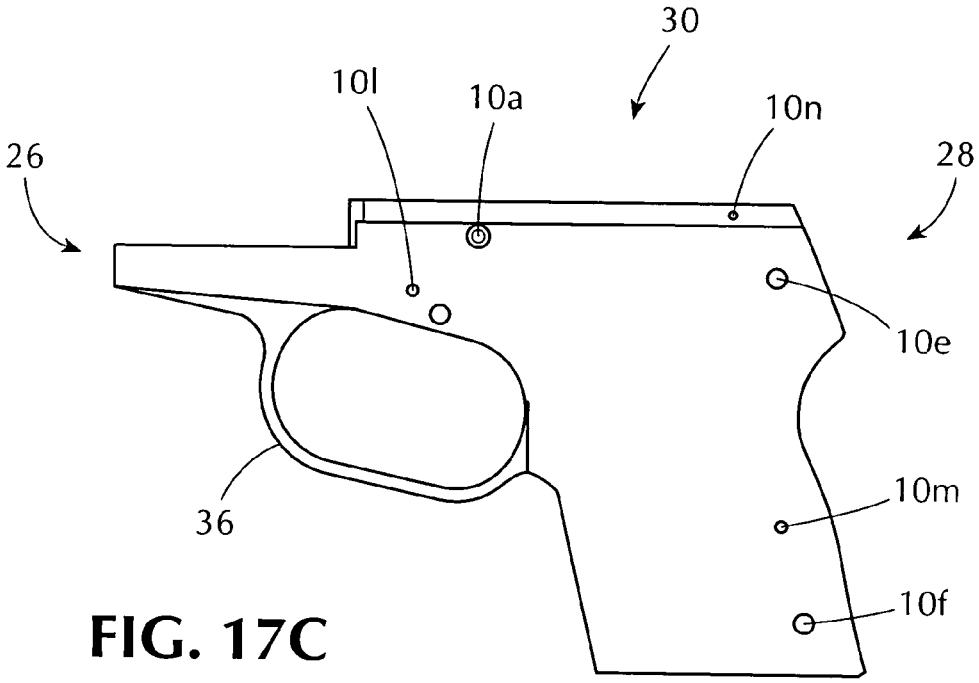
Figure 17D:
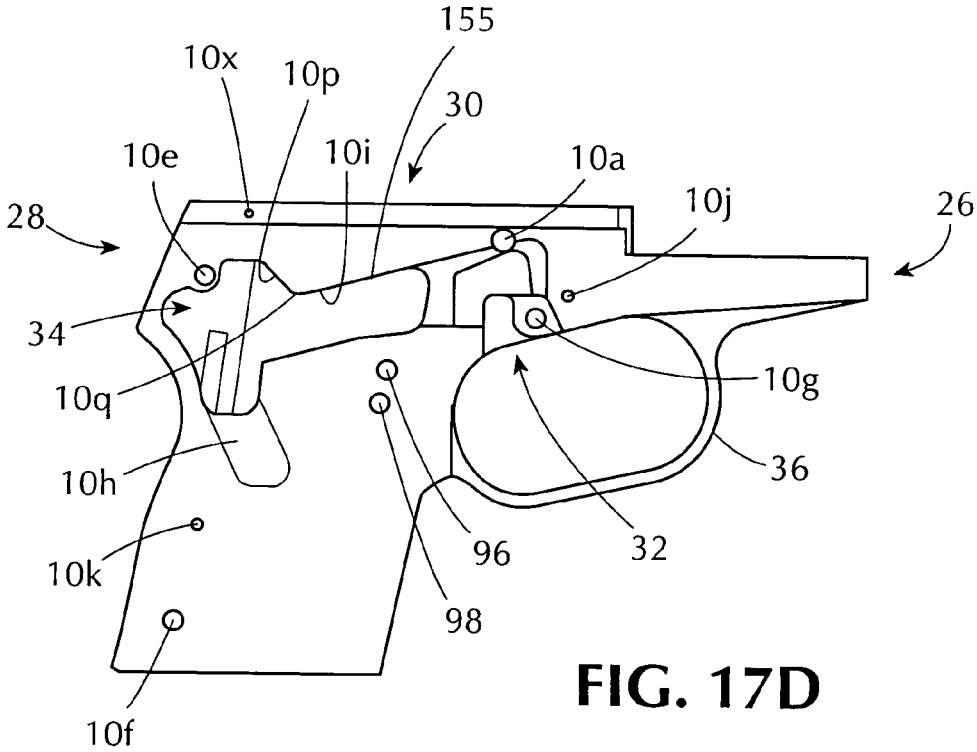
Figure 17E:
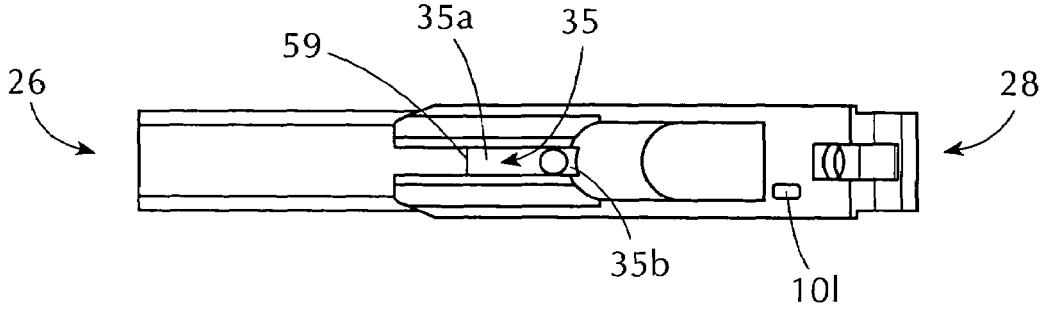
Figure 17F:
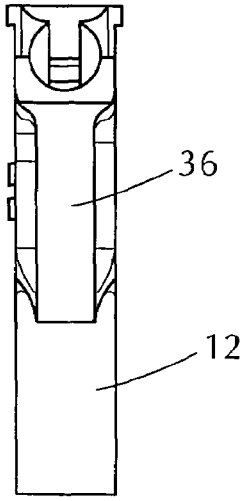
Figure 17G:
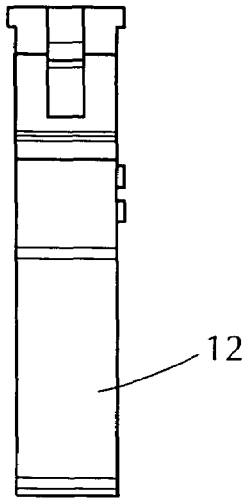
Figure 17H:
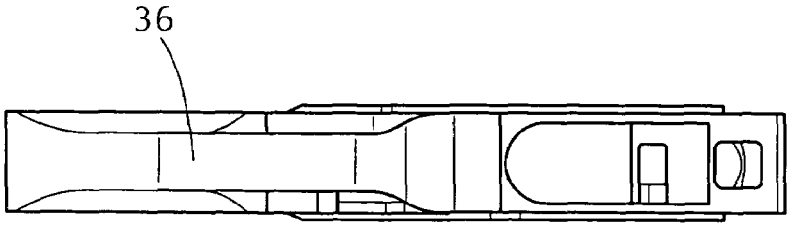
Figure 36:
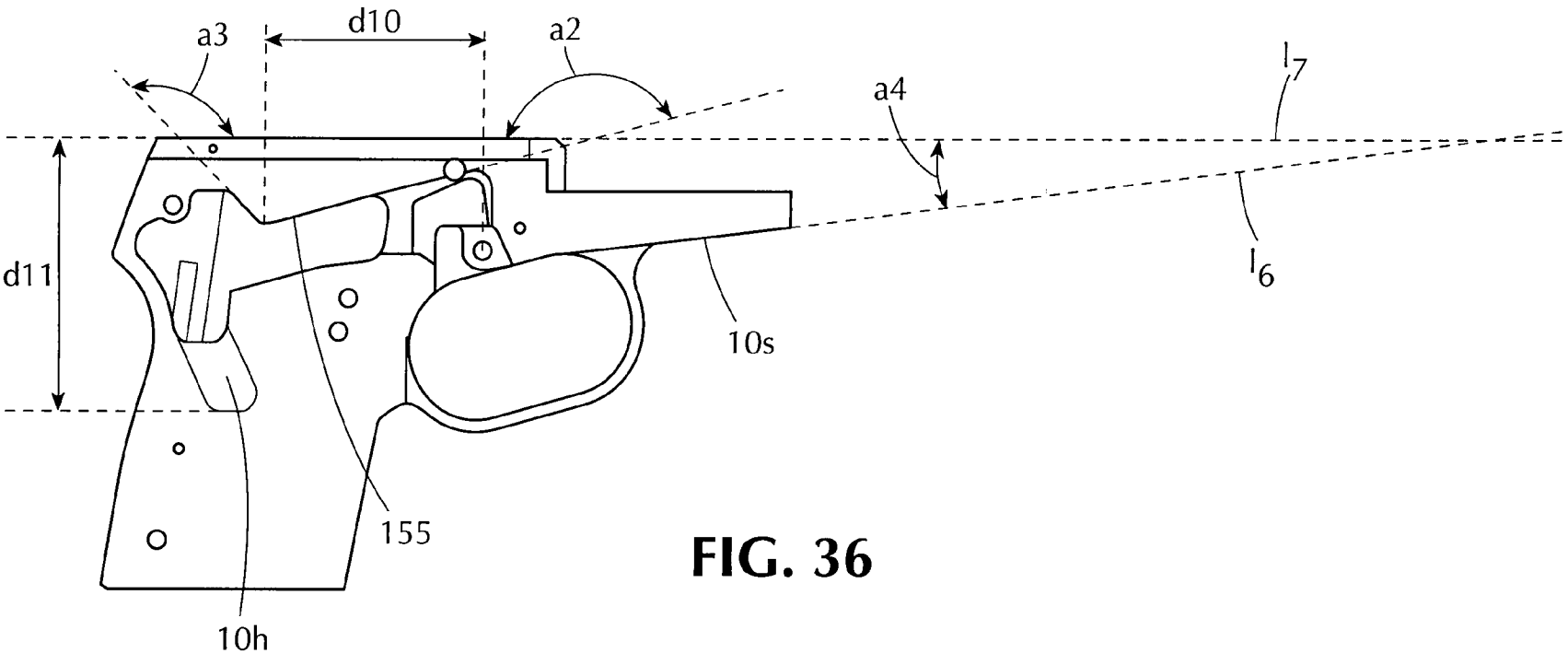
FIG. 36 is a right view in side elevation of the frame of semiautomatic handgun according to the present invention showing critical dimensions and angles.
Figure 38C:
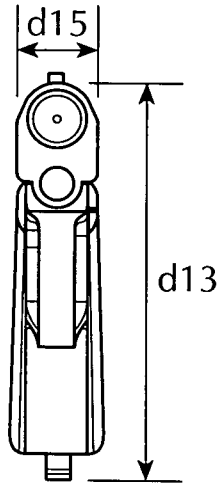
Figure 38D:
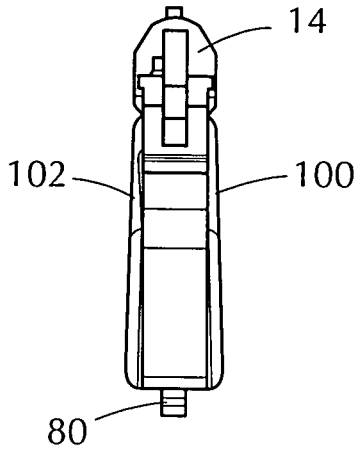
Figure 38E:
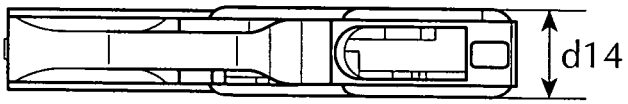
Figure 38F:
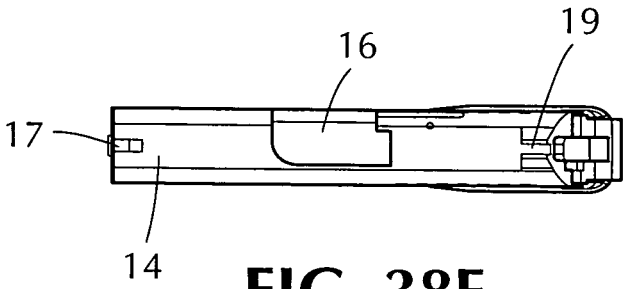

Referring to FIGS. 17D and 36, an abutment 155 of the frame 10 has a first surface constituting the guide surface 10*i* and a second surface 10*p* extending from the guide surface 10*i*. The guide surface 10*i* is inclined at an angle a2 relative to the top 30 of the frame 10. The angle a2 is selected so that the guide surface 10*i* allows the positioning portion 90*e* of the trigger bar 90 to ride along the inclination of the guide surface 10*i* until the cocking lug 66*d* of the hammer 66 escapes the tip of the claw 90*c* of the trigger bar, thereby releasing the hammer. The guide surface 10*i* effectively limits the upward movement of the claw 90*c* so that upon release of the hammer 66, the U-shaped section 90*f* of the trigger bar again surrounds the cocking lug 66*d* and the semiautomatic handgun is again ready to be fired again. A turning point 10*q* between the guide surface 10*i* and the second surface 10*p* is disposed at a distance d10 from a center of the aperture 10*g* in the first locating recess 32 of the frame 10. The distance d10 is selected so that the length of the guide surface 10*i* on which the positioning portion 90*e* of the trigger bar 90 rides is sufficient to allow the trigger bar 90 to undergo the range of movement necessary until the cocking lug 66*d* of the hammer 66 escapes the tip of the claw 90*c* which releases the hammer. The second surface 10*p* of the abutment 155 is inclined at an angle a3 relative to the top 30 of the frame 10 so that the second locating recess 34 provides sufficient space to accommodate movement of the cocking lug 66*d* and the claw 90*c* during the triggering cycle. Preferably, the angle a2 is in the range of about 166 to 168 degrees, and the angle a3 is in the range of about 134 to 136 degrees. The distance d10 is preferably in the range of about 1.4 to 1.6 inches. By this construction, the abutment 155 allows the trigger bar 90 and the hammer 66 to be reset again for another triggering cycle without interfering with movements of the trigger bar and the hammer during the triggering cycle. Accordingly, there is no need to provide additional components in the semiautomatic handgun to assist resetting of the hammer, thereby reducing the number of parts and overall weight of the semiautomatic handgun.

Another structural feature of the frame 10 which contributes to the reduction in size and weight of the semiautomatic handgun 1 is a space formed by the recess 10*h* of the frame 10 and the recess 112 of the right cover 100 in the assembled state of the semiautomatic handgun 1. The recess 10*h* and the recess 112 accommodate portions of the torsion spring 67 and the trigger bar 90 so that these components do not contact the right cover 100 in the assembled state-of-the semiautomatic handgun and during a triggering cycle. The recess 10*h* of the frame 10 specifically accommodates the coil 67*d* of the torsion spring 67 in the assembled state of the semiautomatic handgun. The lower surface of the recess 10*h* is disposed at a distance d11 from the top 30 of the frame. The distance d11 is selected so that the coil 67*d* of the torsion spring 67 has sufficient space to move freely without interference by other portions of the frame 10. Thus the recess 10*h* and the recess 112 reduce the overall width d3 (FIG. 2D) of the semiautomatic handgun by providing a space within which the coil 67*d* of the torsion spring can move during a triggering cycle. Preferably, the distance d11 is in a range of about 1.8 to 1.9 inches.

The hand grip 12 of the semiautomatic handgun according to the present invention is ergonomically designed to fit the hand of the shooter for positive control and to lessen felt recoil and muzzle flip when a round is fired. The hand grip 12 is contoured so that the semiautomatic handgun rides low in the hand of the shooter and aligns the barrel with the forearm of the shooter for a natural point which facilitates hitting a target. Furthermore, with the foregoing preferred dimensions of the semiautomatic handgun, the fingers of the shooter can wrap securely about the grip with the forefinger in the trigger and the barrel in close alignment with the axis of the shooter's arm.

With reference to FIGS. 15 and 36, in order to achieve the foregoing advantages of the ergonomic design of the semiautomatic handgun 1, two critical angles a1 and a4 are defined. Angle a1 is an angle formed by the intersection of a line $l_4$ extending along a surface 10*r* of the frame 10 and a line $l_5$ extending generally perpendicular to the axis A of the barrel 16. Angle a4 is an angle formed by the intersection of a line $l_6$ extending along a surface 10*s* of the frame 10 and a line $l_7$ extending along the top 30 of the frame 10. The angles al and a4 are selected so that the barrel will be aligned only slightly above the axis of the forearm of the shooter when the hand grip 12 is held in the hand with the top of a shooter's wrist level aligned with the top of the forearm. This alignment substantially eliminates muzzle rise when the semiautomatic handgun is fired. Preferably, the angle a1 is in the range of about 9 to 11 degrees and the angle a4 is in the range of about 5 to 6 degrees.

By the foregoing description, it will be appreciated that the semiautomatic handgun according to the present invention can be designed to fire cartridges of various calibers, including 9 mm, 0.380, 0.357 SIG, 0.40 S&W (Smith and Wesson), and 0.45 ACP (Automatic Colt Pistol) calibers.

A preferred embodiment according to the present invention is a 9 mm semiautomatic handgun constructed as described above with reference to FIGS. 1-36. The frame 10 and the grip covers 100, 102 are made of aluminum, preferably 7075-T6 aluminum. The recoil spring guide rod 60 is made of a durable polymer, preferably DELRIN®. The slide 14, barrel 16, trigger 18, hammer 66, firing pin 54, firing pin retainer 114, extractor 120, ejector 122, hammer strut 68, plunger 74, magazine catch 80, trigger bar 90, firing pin spring 112, and all of the pins are made of stainless steel, preferably 17-4 stainless steel. The torsion spring 67, the firing pin spring 112, the mainspring 76 and the recoil spring 62 are preferably formed of spring steel.

The preferred dimensions d1-d7 shown in FIGS. 2A and 2D-2F for the 9 mm semiautomatic handgun according to the present invention are as follows: d1 is about 4.7 inches; d2 is about 3.6 inches; d3 is about 0.94 inches; d4 is about 0.8 inches; d5 is about 1.25 inches; d6 is about 1.75 inches; and d7 is about 6.25 inches. The angle a1 shown in FIG. 15 is preferably in the range of about 9 to 11 degrees. The angles a2-a4 shown in FIG. 36 are preferably in the range of about 5 to 6 degrees, in the range of about 166 to 168 degrees, and in the range of about 134 to 136 degrees, respectively. The unloaded weight (i.e., the weight without the magazine and without a round in the chamber) of the 9 mm semiautomatic handgun according to the present invention is preferably within the range of about 12.0 to 12.5 ounces, and more preferably 12.3 oz. This preferred unloaded weight includes the weight of the slide 14, which is preferably within the range of about 4.5 to 6.0 ounces. As further described below, the low weight of the slide 14 reduces felt recoil during a firing sequence.

In the 9 mm semiautomatic handgun according to the present invention, the dimension d8 shown in FIG. 15 is preferably selected to accommodate a magazine 46 which can hold six rounds, which together with an additional round in the chamber 40, constitutes seven rounds. The result is a very compact and lightweight 9 mm semiautomatic handgun having high firing power as compared to conventional 9 mm semiautomatic handguns. It will be appreciated, however, that other types of magazines having a capacity to hold a number of rounds less than six can be used in the 9 mm semiautomatic handgun of the present invention by appropriately adjusting the dimension d8. For example, the dimension of the hand grip 12 in the direction of the dimension d8 could be shortened to accommodate a five-round or a four-round magazine. This modification would provide a 9 mm semiautomatic handgun which is even more compact and lightweight as compared to conventional 9 mm semiautomatic handguns.

Thus, by the foregoing construction, it will be appreciated that the present invention provides a 9 mm semiautomatic handgun that is lightweight and compact due to exterior dimensions and an unloaded weight not previously achieved by the prior art.

From the foregoing description, it will be appreciated that the semiautomatic handgun according to the present invention has low felt recoil as compared to conventional semiautomatic handguns. Since recoil is the reactive force equal and opposite to the force required to accelerate a bullet from the muzzle of the barrel with sufficient initial velocity to strike a target at a given distance with a forceful impact, its dissipation must be controlled. During its cycle of compression and expansion of the recoil spring 62, some of the energy of recoil will have been dissipated by the work done in compressing the recoil spring. Additional energy of recoil will be dissipated during extraction and ejection of the empty casing from the chamber 40. Several structural features of the semiautomatic handgun 1 of the invention further contribute to the dissipation of recoil when the semiautomatic handgun is fired.

One feature of the present invention contributing to the dissipation of the energy of recoil is the selection of the angle a1 shown in FIG. 15 within the preferred range of about 9-11 degrees. When a shooter grabs the grip 12 of the semiautomatic handgun 1, the preferred angle a1 allow the fingers of the shooter to push the grip into the center of the palm of the hand. As a result, when the semiautomatic handgun recoils during a triggering cycle, the grip 12 is pushed against the center of the palm of the shooter's hand rather than the top of the hand. This substantially reduces muzzle rise when the handgun is fired.

Another feature contributing to the dissipation of the energy of recoil is the provision of the free bore portion 16*b* in the barrel 16 with a length of about 0.250 inches. By this construction, recoil is released through the free bore portion 16*b* during a firing sequence. More specifically, upon ignition, the bullet of the round moves in the chamber 40 with gases flowing forward. As the gases flow through the free bore portion 16*b*, pressure is reduced. When the bullet exits the front of the semiautomatic handgun, the pressure is low enough so that the barrel 16 drops down by means of the cam slot 44*b* and the slide 14 can move rearwardly.

Other features contributing to the dissipation of the energy of recoil are the use of the "double" recoil spring 62 and the use of the spring power of the mainspring 76 to accelerate the hammer 66 forward in order to strike the firing pin 54 which in turn strikes the primer of the chambered round. Yet another feature contributing to the dissipation of the energy of recoil is the low weight of the slide 14, which is preferably within the range of about 4.5 to 6.0 ounces, and more preferably 4.8 ounces, for the 9 mm semiautomatic handgun according to the present invention.

As described above for the embodiment of FIGS. 1-34 and 36, an object of the present invention is to provide a semiautomatic handgun which is of light weight and compact construction. In order to further achieve these objects, according to another embodiment of the present invention shown in FIGS. 35A-35B, the frame 10 is provided with holes 150 for reducing the weight of the frame 10 and, therefore, the overall weight of the assembled semiautomatic handgun. In this embodiment, five circular holes 150 are formed on each side of the portion of the frame 10 corresponding to the hand grip 12. However, it will be appreciated by those of ordinary skill in the art that the number, location and configuration of the holes 150 on the frame 10 may be varied so long as the structural strength of the frame 10 is not compromised.

FIGS. 37-46G show another embodiment of a semiautomatic handgun 200 according to the present invention. The structure of the semiautomatic handgun 200 is generally the same as that of the semiautomatic handgun 1 described above with reference to FIGS. 1-34 and 36 except as further described below. For ease of understanding, the same numerals used with reference to the semiautomatic hand gun 1 will be used to describe the corresponding components of the semiautomatic handgun 200 regardless of whether they have the same or different structure.

Figure 39:
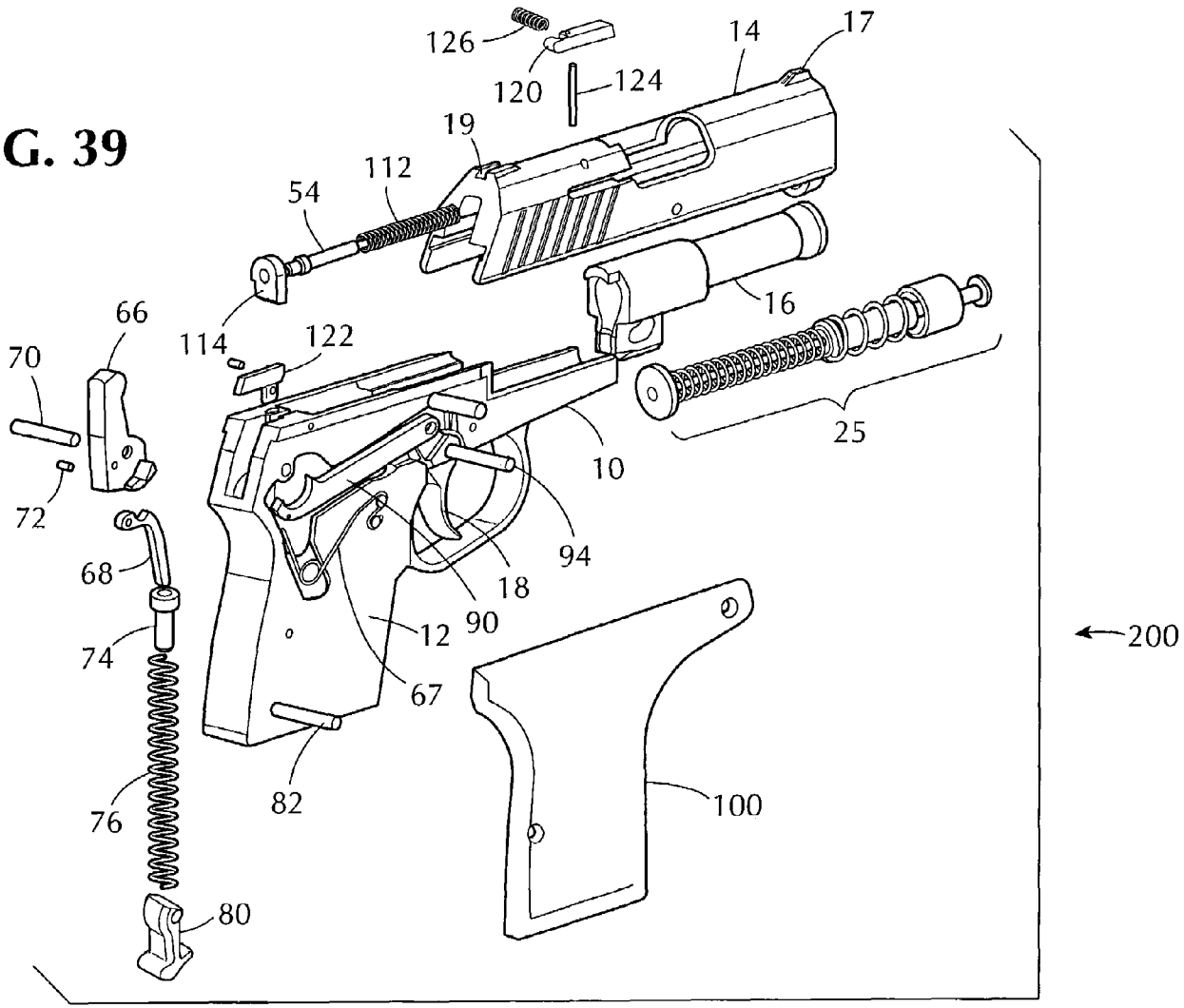
FIG. 39 is an exploded view of the semiautomatic handgun shown in FIG. 37.

FIG. 37 is a rear perspective view and FIGS. 38A-38F are a left view in side elevation, a right view in side elevation, a front view, a rear view, a bottom view and a top view, respectively, of the semiautomatic handgun 200. FIG. 39 is an exploded view of the semiautomatic handgun 200. The overall length d12 of the semiautomatic handgun 200 is preferably in the range of about 4.9 to 5.2 inches. The overall height d13 of the semiautomatic handgun 200, including sights 17, 19, is preferably in the range of about 3.9 to 4.1 inches. The overall width or thickness d14 of the semiautomatic handgun 200, including the grip covers, is preferably in the range of about 0.75 to 0.82 inches. The overall width d15 of the slide 14 is preferably in the range of about 0.75 to 0.85 inches. The distance d16 between the top of the slide 14 and a lower front portion of the frame 10 is preferably in the range of about 1.25 to 1.35 inches. The length d17 of the bottom portion of the hand grip 12 is preferably in the range of about 1.65 to 1.95 inches. The distance d18 between two lines 19, 110 extending perpendicularly to a line 13 connecting points 14*g* and 80*b* of the slide 14 and the magazine catch 80, respectively, is preferably in the range of about 5.8 to 6.4 inches. Preferably, the unloaded weight (i.e., the weight without the magazine 46 and without a round in the chamber) of the semiautomatic handgun 200 is in the range of about 10.95 to 14.85 ounces.

Preferably, for a 9 mm semiautomatic handgun 200, the foregoing dimensions d12-d18 are as follows: d12 is about 5.05 inches; d13 is about 4.04 inches with sights 17, 19 and 3.966 without sights 17, 19; d14 is about 0.812 inches; d15 is about 0.812 inches; d16 is about 1.31 inches; d17 is about 1.8 inches; and d18 is about 6.26 inches. The unloaded weight for the 9 mm semiautomatic handgun 200 is about 12.9 ounces.

It will be appreciated by those skilled in the art that the overall height d13 of the semiautomatic handgun 200 and the length d17 of the bottom portion of the hand grip 12 shown will depend on the type of magazine 84 selected which will determine the height d8 and the length d9 of the magazine well 85 as shown in FIGS. 13 and 15. The type of magazine 84 selected depends on the number of rounds desired to be held in the magazine 84.

FIGS. 40A-40E show the frame 10 of the semiautomatic handgun 200. The frame 10 of the semiautomatic handgun 200 differs from the frame 10 of the semiautomatic handgun 1 in the following respects. The frame 10 of the semiautomatic handgun 200 has a rib portion 11 having a generally U-shaped cavity, generally designated at 11*a*, opening to the top 30 of the frame 10. The cavity 11*a* has a base portion 11*b* and sidewall portions 11*c*, 11*d*. Through-holes lie extend through the sidewall portions 11*c*, 11*d* and communicate and are aligned with the horizontal aperture 10*n* in the frame 10 which receives the pin 128 for connecting the ejector 122 to the frame 10 as described above for the semiautomatic handgun 1. The through-holes 11*e* correspond to the through-hole 10*x* in the semiautomatic handgun 1 and function to permit the removal of the pin 128 during disassembly of the semiautomatic handgun 200. As further described below, the cavity 10*a* provides a clearance that allows the passage of a protrusion 51 extending from a lower surface of the block 50 of the slide 14 when the slide 14 moves rearwardly (i.e., towards the rear end 28 of the frame 10) during a firing sequence.

As described above with reference to FIGS. 17D and 36, the frame 10 of the semiautomatic handgun has the abutment 155 having the guide surface 10*i* and the surface 10*p* separated by the turning point 10*q*. As shown in FIG. 40C, the guide surface 10*i* of the frame 10 of the semiautomatic handgun 200 is inclined at an angle a6 relative to the top 30 of the frame 10. The angle a6 is selected so that the guide surface 10*i* allows the positioning portion 90*e* of the trigger bar 90 to ride along the inclination of the guide surface 10*i* until the cocking lug 66*d* of the hammer 66 escapes the tip of the claw 90*c* of the trigger bar, thereby releasing the hammer. The guide surface 10*i* effectively limits the upward movement of the claw 90*c* so that upon release of the hammer 66, the U-shaped section 90*f* of the trigger bar again surrounds the cocking lug 66*d* and the semiautomatic handgun is again ready to be fired again. The turning point 10*q* between the guide surface 10*i* and the surface 10*p* is disposed at a distance d19 from a center of the aperture 10*g* in the first locating recess 32 of the frame 10. The distance d19 is selected so that the length of the guide surface 10*i* on which the positioning portion 90*e* of the trigger bar 90 rides is sufficient to allow the trigger bar 90 to undergo the range of movement necessary until the cocking lug 66*d* of the hammer 66 escapes the tip of the claw 90*c* which releases the hammer. The second surface 10*p* of the abutment 155 is inclined at an angle a7 relative to the top 30 of the frame 10 so that the second locating recess 34 provides sufficient space to accommodate movement of the cocking lug 66*d* and the claw 90*c* during the triggering cycle.

Preferably, the angle a6 is in the range of about 12.1 to 12.7 degrees. The angle a7 is preferably in the range of about 43 to 47 degrees. The distance d19 is preferably in the range of about 1.55 to 1.65 inches. For a 9 mm semiautomatic handgun 200, the angle a6 is about 12.575 degrees, the angle a7 is about 45 degrees, and the distance d19 is about 1.616 inches. By this construction, the abutment 155 allows the trigger bar 90 and the hammer 66 to be reset again for another triggering cycle without interfering with movements of the trigger bar and the hammer during the triggering cycle. Accordingly, there is no need to provide additional components in the semiautomatic handgun to assist resetting of the hammer, thereby reducing the number of parts and overall weight of the semiautomatic handgun.

Figure 40A:
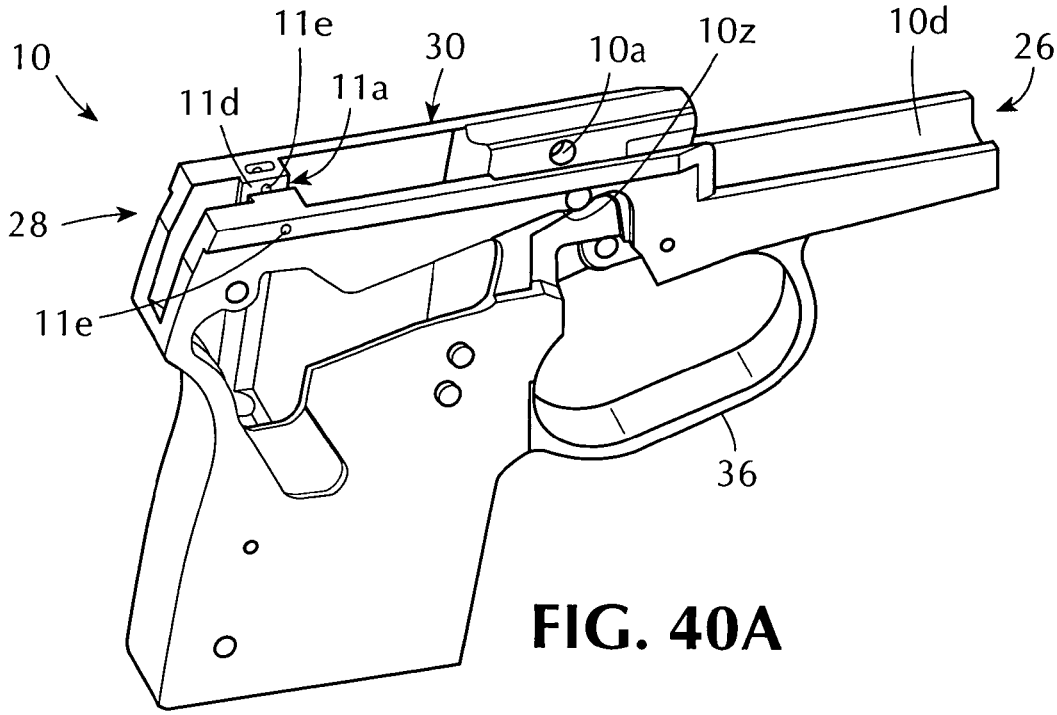
FIGS. 40A-40E show the frame of the semiautomatic handgun of FIG. 37, where
Figure 40B:
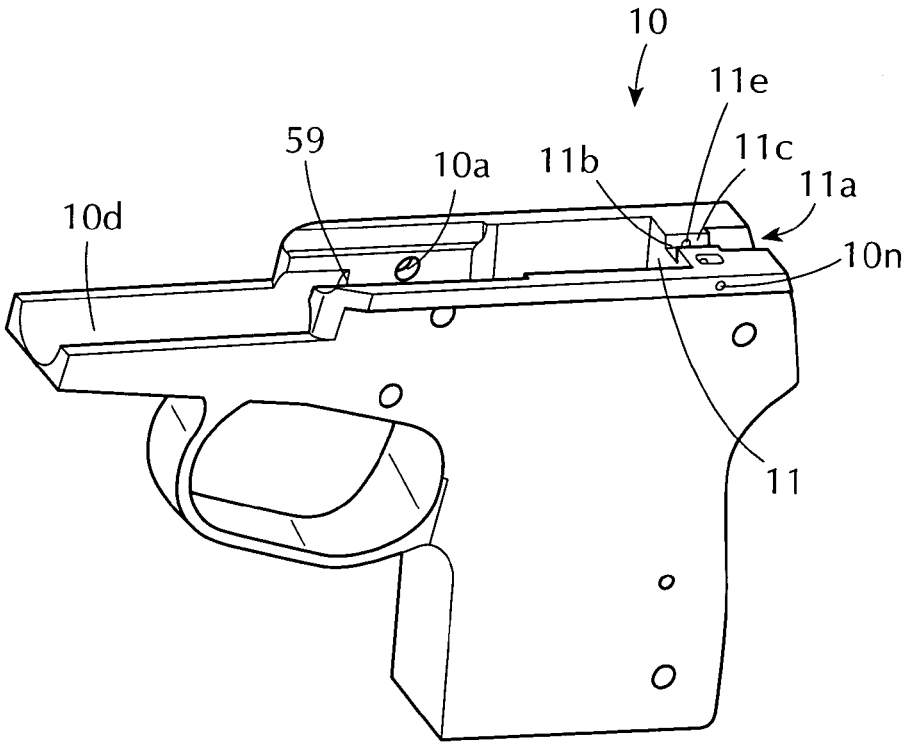
Figure 40C:
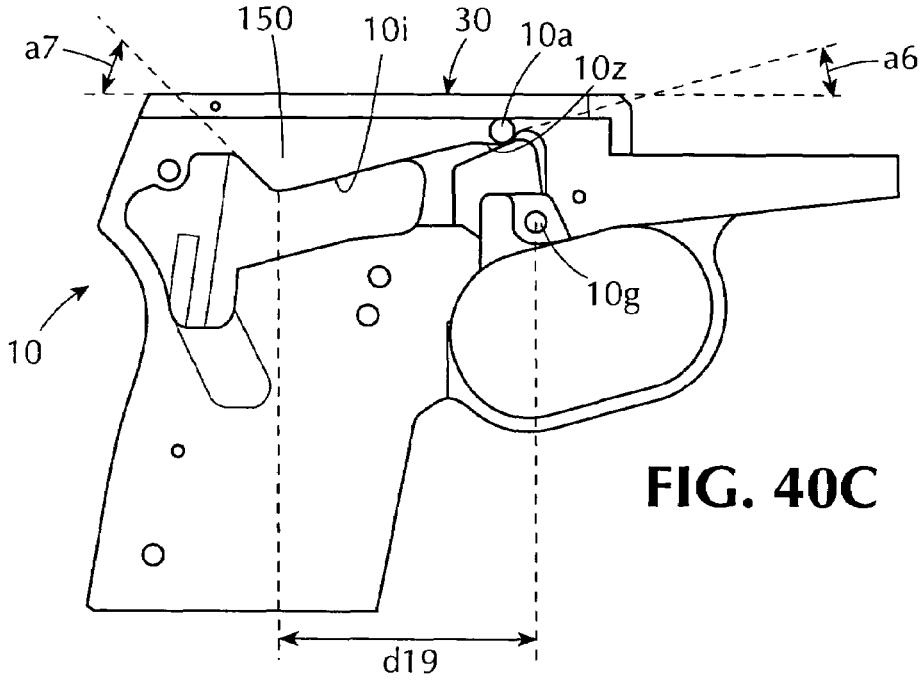

Another structural feature of the frame 10 of the semiautomatic handgun 200 which differs from the semiautomatic handgun 1 is best shown in FIGS. 40A and 40C. As described above for the semiautomatic handgun 1, the hole 10*a* of the frame 10 is configured to receive the connecting pin 45 (FIGS. 5 and 8) which extends through the cam slot 44*b* of the barrel support portion 44. In the semiautomatic handgun 200, the frame 10 has a reinforcement portion 10z surrounding a lower portion of the hole 10*a* for the purpose of reinforcing this area of the frame 10 which is subjected to stresses as a result of the movement of the barrel 16 during a firing sequence.

Figure 22A:
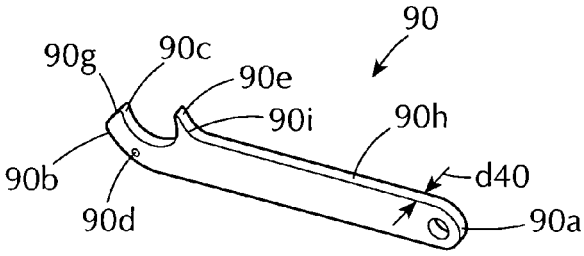
FIGS. 22A-22B and 22C show embodiments of the trigger bar used in the semiautomatic handgun according to the present invention, where
Figure 22B:
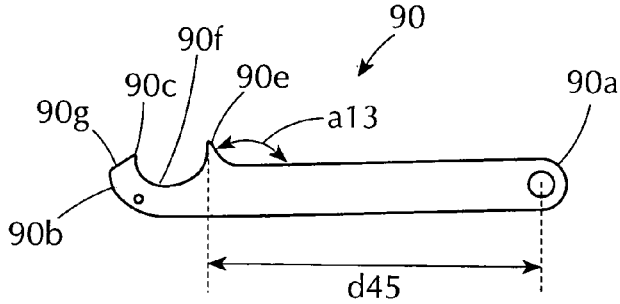
Figure 22C:
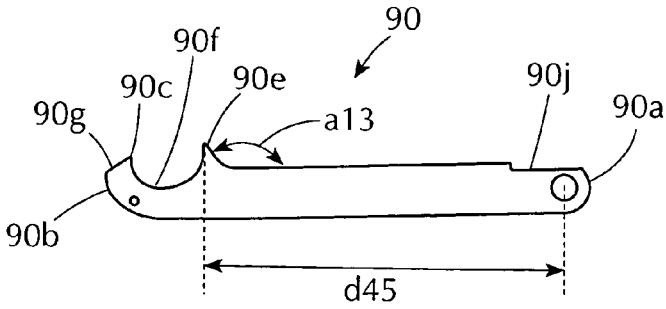

FIG. 22C shows the trigger bar 90 used in the semiautomatic handgun 200 of the present embodiment. The trigger bar 90 in FIG. 22C is substantially the same as the trigger bar 90 described above with respect to the semiautomatic handgun 1 except as follows. The forward end 90*a* of the trigger bar 90 in FIG. 22C has a relief cut 90*j* which provides a clearance for the reinforcement portion 10*z* of the frame 10 as described above. It will be appreciated by those of ordinary skill in the art that the depth of the relief cut 90*j* from the side surface 90*h* and the length of the relief cut 90*j* of the trigger bar 90 are selected so that the reinforcement portion 10*z* of the frame 10 does not contact the trigger bar 90 during a firing sequence. For a 9 mm semiautomatic-handgun, the length of the relief cut 90*j* is preferably about 0.350 inches and the depth of the relief cut 90*j* is preferably about 0.040 inches.

Figure 40D:
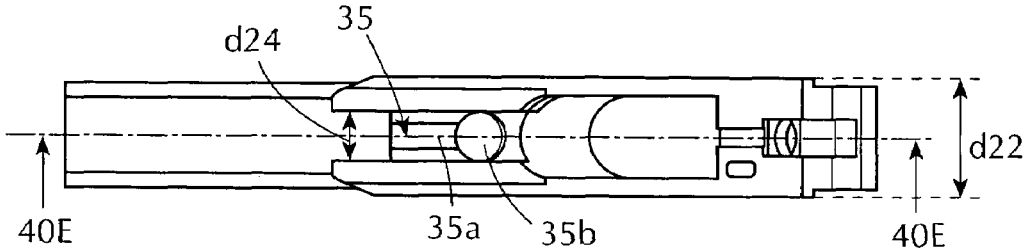
Figure 40E:
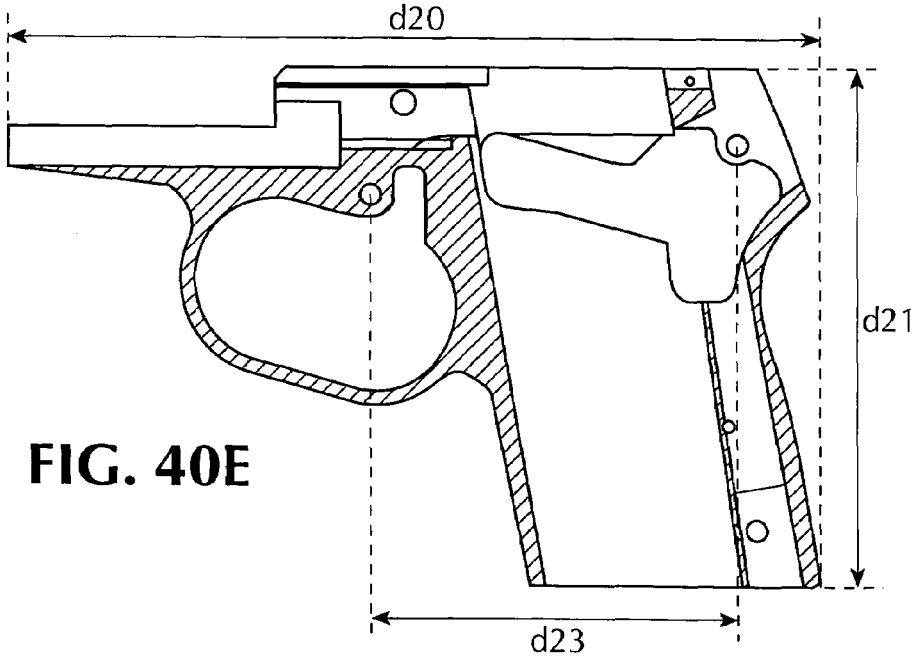
Figure 41A:
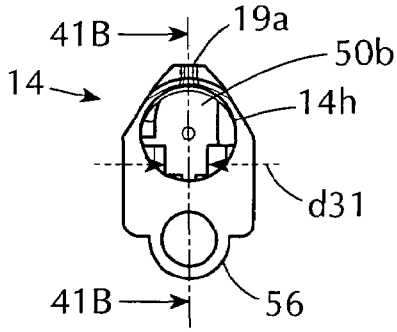
FIGS. 41A-41D show the slide of the semiautomatic handgun of FIG. 37, where
Figure 41B:
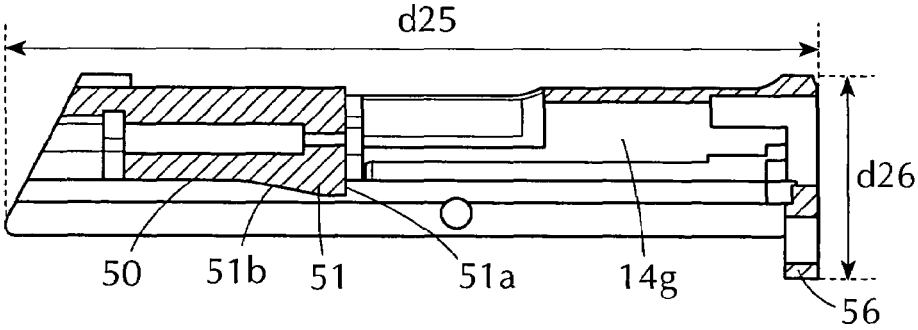
Figure 41C:
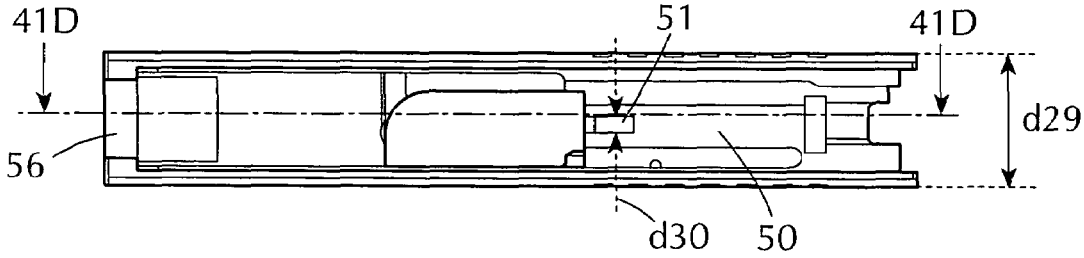
Figure 41D:
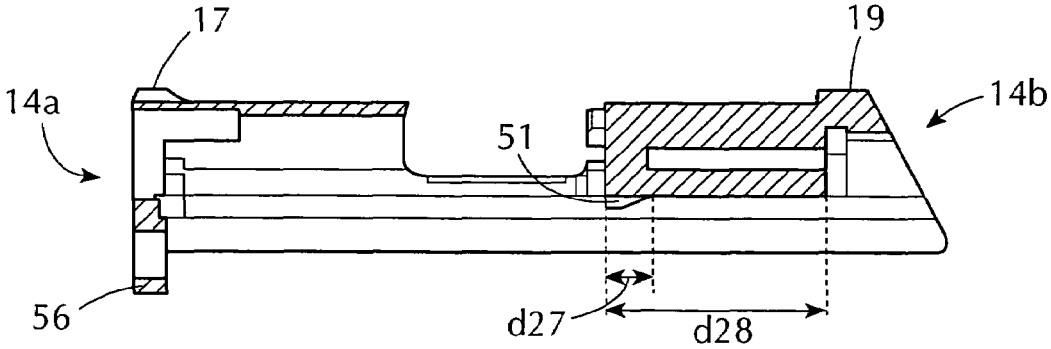
Figure 42A:
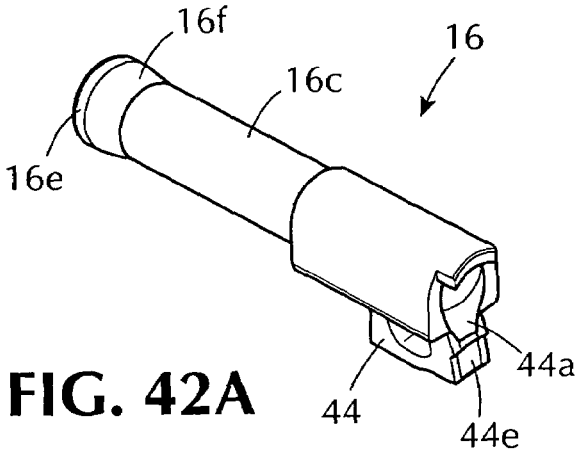
FIGS. 42A-42G show the barrel of the semiautomatic handgun in FIG. 37, where
Figure 42B:
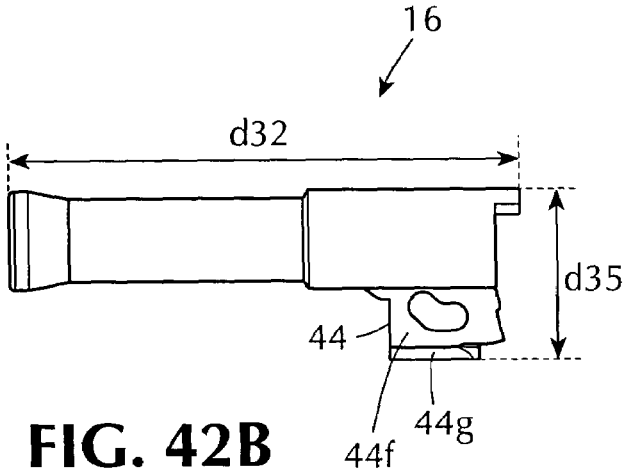
Figure 42C:
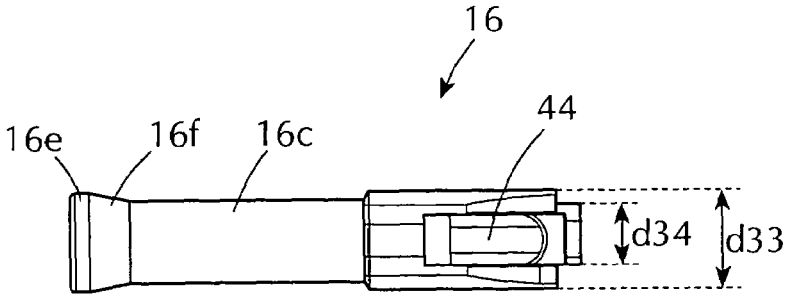
Figure 42D:
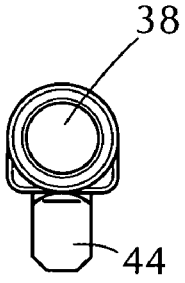
Figure 42E:
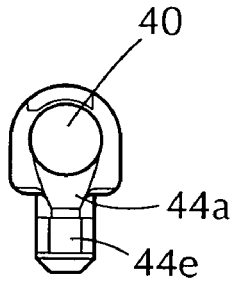
Figure 42F:
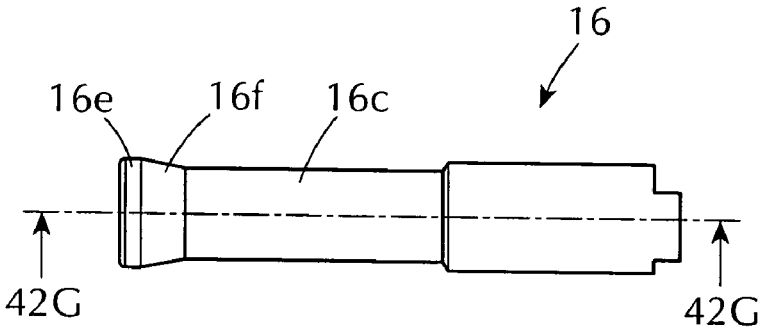
Figure 42G:
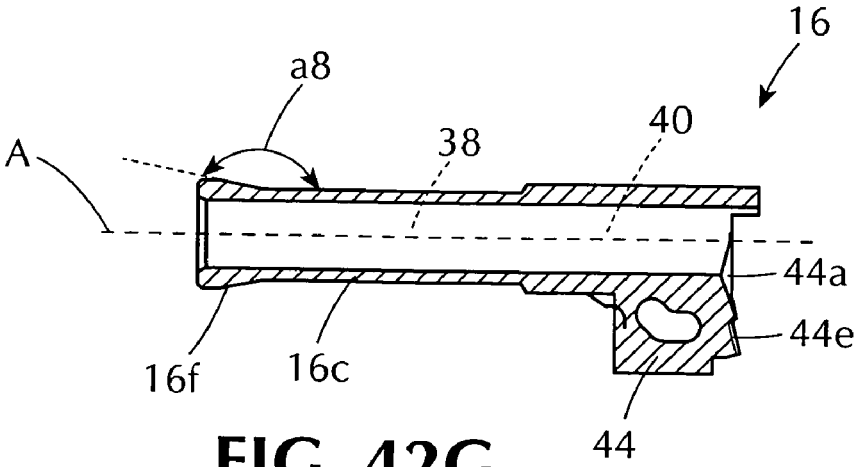

FIG. 40D is a top view of the frame 10 of the semiautomatic handgun 200 and FIG. 40E a is a left side longitudinal sectional view taken along line 40E-40E in FIG. 40D showing several critical dimensions of the frame 10. The frame 10 has a length d20, a height d21 and a thickness d2 selected to provide sufficient structural strength to enable the frame 10 to withstand the forces applied thereto as a result of the recoil action during a firing sequence. For this purpose: the length d20 of the frame 10 is preferably in the range of about 4.85 to 5.15 inches; the height d21 of the frame 10 is preferably in the range of about 3.0 to 3.2 inches; and the thickness d22 of the frame 10 is preferably in the range of about 0.61 to 0.63 inches. Furthermore, the distance d23 between center of the aperture log in the first locating recess 32 of the frame 10 for receiving the trigger connecting pin 94 and the center of the aperture 10*e* which is disposed at a rear end portion of the frame 10 for receiving the hammer pin 70 is selected to allow accommodation and connection of the corresponding components of the trigger assembly 22 and the hammer assembly 24 without increasing the overall length d20 and height d21 of the frame 10. Preferably, the distance d23 is in the range of about 2.260 and 2.270 inches.

Another critical dimension associated with the frame 10 is the width d24 of the barrel slot 35*a* in the third locating recess 35. The width d24 is selected so that the barrel support portion 44 is able to undergo rearward and downward movement within the barrel slot 35*a* by means of the cam slot 44*b* during a firing sequence without substantial movement of the barrel 16 in the width direction of the barrel slot 35*a* which tends to increase felt recoil. For this purpose, the width 24 is preferably within the range of about 0.287 to 0.290 inches. By this construction, the overall width of the frame 10 is reduced while substantially reducing felt recoil. Preferably, for a 9 mm semiautomatic handgun 200, the foregoing dimensions d20-d24 are as follows: d20 is about 4.960 inches; d21 is about 3.11 inches; d22 is about 0.625 inches; d23 is about 2.263 inches; and d24 is about 0.288 inches.

It will be appreciated by those skilled in the art that the frame 10 of the semiautomatic handgun 200 may be provided with holes for reducing the weight of the frame 10 and, therefore, the overall weight of the assembled semiautomatic handgun, as described above for the embodiment of FIGS. 35A-35B.

FIGS. 41A-41D show the slider 14 used in the semiautomatic handgun 200 according to the present invention. One difference between the semiautomatic handgun 200 and the semiautomatic handgun 1 described above with reference to FIGS. 1-34 and 36 is that the slider 14 of the semiautomatic handgun 200 has front and rear sights 17, 19, respectively, in the form of protrusions extending from upper external surface portions of the slider 14. The rear sight 19 has a slot 19*a* defining an observation mark to be aligned with the front sight 17 in the longitudinal direction of the slide 14. It is understood by those of ordinary skill in the art that the front and rear sights 17, 19 are not limited to the specific construction shown in FIGS. 37, 39 and 41A-41D. Other types of conventional sights may be used for the semiautomatic handgun 200 without departing from the spirit and scope of the invention. It is also understood that, if desired, the sights 17, 19 may be omitted altogether from the semiautomatic handgun 200.

Another difference between the semiautomatic handgun 200 and the semiautomatic handgun 1 described above with reference to FIGS. 1-34 and 36 is in the structure of the block 50 of the slide 14. The block 50 of the slide 14 of the semiautomatic handgun 200 has a protrusion 51 extending from a lower surface thereof. The protrusion 51 has a front wall surface 51*a* and a tapered surface 51*b* which decreases in taper from a front end 14*a* to a rear end 14*b* of the slide 14. The width and height of the protrusion 51 are smaller than the corresponding width and height of the cavity 11*a* in the rib portion 11 of the frame 10 so that the protrusion 51 is permitted to travel freely along the cavity 11*a* when the slide 14 moves rearwardly and than forwardly during a firing sequence as described above.

As described above with reference to the embodiment of FIGS. 1-34 and 36, the support portion 44 of the barrel 16 has an inclined surface 44*a* defining a feed ramp for feeding live cartridges from the magazine assembly 46 to the cartridge chamber 40. When the slide 14 begins to move forward after being moved rearwardly either manually or during a firing sequence, the function of the protrusion 51 of the slide 14 in the semiautomatic handgun 200 is to strip a live cartridge from the magazine 84 and to push the live cartridge by contacting an upper portion thereof until the live cartridge reaches an end of a holding portion of the magazine 84. At this point, the live cartridge displaces upward due to the biasing force of the magazine spring 88 and lines up with the central axis A of the barrel 16. In this state, and as the slide 14 continues to move forward, the breech face 50*b* of the slide block 50 contacts the rear portion of the live cartridge and completely pushes the live cartridge up the feed ramp 44*a* and into the chamber 40 of the barrel 16. Thus the protrusion 51 insures that there is positive contact between the breech face 50*b* of the slide block 50 and the live cartridge during forward movement of the slide 14 so that the live cartridge is securely and quickly chambered so that the semiautomatic handgun 200 is ready for firing. By this construction, the cycle-time (i.e., the time between successive firings) of the semiautomatic handgun 200 is effectively reduced.

As described above with reference to the embodiment of FIGS. 1-34 and 36, the overall weight of the slide 14 affects the felt recoil during a firing sequence. In order to reduce felt recoil, the weight of the slide 14 of the semiautomatic handgun 200 is preferably within the range of about 4.5 to 6.0 ounces. In order to achieve this low weight, several critical dimensions are selected for the slide 14. In this regard, the length d25 of the slide 14 is preferably within the range of about 4.75 to 4.95 inches. The height d26 of the slide 14 is preferably within the range of about 1.10 to 1.30 inches. The preferred height d26 includes the height of each of the sights 17, 19 which is preferably about 0.065 inches.

The width d29 of the slide 14 is preferably within the range of about 0.79 to 0.82 inches. The length d27 and width d30 of the protrusion 51 are selected to be as small as possible with respect to the overall length d28 and width d31 of the block 50 in order to maintain the overall weight of the slide 14 within the preferred range described above. Preferably, the length d27 of the protrusion 51 is in the range of about 0.29 to 0.31 inches, the width d30 of the protrusion 51 is in the range of about 0.085 to 0.110 inches, the length d28 of the block 50 is in the range of about 1.25 to 1.4 inches, and the width d31 of the block 50 is in the range of about 0.20 to 0.30 inches. Preferably, for a 9 mm semiautomatic handgun 200, the foregoing dimensions d25-d31 are as follows: d25 is about 4.895 inches; d26 is about 1.237 inches; d27 is about 0.305 inches; d28 is about 1.326 inches; d29 is about 0.812 inches; d30 is about 0.098 inches; and 31 is about 0.258 inches.

FIGS. 42A-42G show the barrel 16 used in the semiautomatic handgun 200 according to the present invention. The support portion 44 of the barrel 16 has a base part 44*f* having the cam slot 44*b* and a locating part 44*g* extending from the base part 44*f*. In the assembled state of the semiautomatic handgun 200, support portion 44 of the barrel 16 is disposed in the third locating recess 35 of the frame so that the base and locating parts 44*f*, 44*g* of the support portion 44 are disposed in the barrel slot 35*a*. In this state, the locating portion 44*g* is also firmly abutted against the seat 35*b* in the barrel slot 35*a* to prevent movement of the barrel 16 toward the rear end 28 of the frame 10 and to align the cam slot 44*b* with the holes 10*a* formed in the frame 10 so that the barrel 16 is firmly mounted to the frame 10 by the connecting pin 45 (see FIGS. 5 and 8) extending through the cam slot 44*b* and corresponding aligned holes 10*a* of frame 10 and retained therein with a friction fit.

In the semiautomatic handgun 1 described above with reference to FIGS. 1-34 and 36, the feed ramp 44*a* of the barrel 16 extends along the entire rear surface of the base part 44*f* of the support portion 44 (see FIG. 19A) leading into the entrance of the cartridge chamber 40. In the barrel 16 of the semiautomatic handgun 200, however, the feed ramp 44*a* extends only partially along the rear surface of the base part 44*f* of the support portion 44. More specifically, the feed ramp 44*a* in the barrel 16 of the semiautomatic handgun 200 extends from the entrance of the cartridge chamber 40 to approximately one-half the length of the rear surface of the base part 44*f*. The remaining one-half of the rear surface of the base part 44*f* forms an undercut portion 44*e* which provides a clearance facilitating the feeding of the live cartridge over the feed ramp 44*a* and into the cartridge chamber 40. The width d34 of the support portion 44 of the barrel 16 is selected to allow the support portion 44 to be positioned in the barrel slot 35*a* of the frame 10 for undergoing rearward and downward movement by means of the cam slot 44*b* while preventing the barrel 16 from displacing in a direction generally transverse to the central axis A of the barrel bore 38 during a firing sequence. Preferably, the width d34 of the support portion 44 is in the range of about 0.26 to 0.28 inches and is selected in accordance with the width d24 selected for the barrel slot 35*a* as described above. By the foregoing construction, felt recoil is reduced during a firing sequence.

Another feature of the barrel 16 of the semiautomatic handgun 200 is the provision of a truncated conical mouth or portion 16*f* at the front end portion of the barrel 16. More specifically, the barrel 16 has the peripheral wall portion 16*c* and a cylindrical portion 16*e* forming a front terminal end of the barrel 16. The truncated conical portion 16*f* is disposed between and is contiguous with each of the peripheral wall portion 16*c* and the cylindrical portion 16*e* and has a tapered surface which decreases from the front end to the rear end of the barrel 16. The truncated conical portion 16*f* provides a means for facilitating the front end portion of the barrel to pass through the front open end 14*h* of the barrel hole 14*g* of the slide 14 during a firing sequence of the semiautomatic handgun 200. During a firing sequence, starting from a locked breech condition of the barrel 16, upon firing of a round the pressure of the gases generated upon ignition of the gunpowder in the round push the empty casing of the round against the breech face 50*b* of the slide 14, thereby starting the rearward movement of the slide 14. During rearward movement of the slide 14, the barrel 16 is pushed rearwardly and downwardly by means of the barrel cam slot 44*b* as the front end portion of the barrel 16 passes through the open end 14*h* of the slide 14. The taper of the truncated conical portion 16*f* allows the front end portion of the barrel 16 to clear the inner surface portion of the barrel hole 14*g* at the open end 14*h* and pass therethrough, thereby preventing the barrel from locking-up (i.e., prevents the front end portion of the barrel from striking the inner surface of the barrel hole 14*g* which would in turn prevent the front end portion of the barrel from passing through the open end 14*h* of the barrel hole) during a firing sequence. In order to achieve the advantage of the truncated conical portion 16*f* to prevent the front end portion of the barrel 16 from locking-up relative to the slide 14 during a firing sequence, the tapered surface of the truncated conical portion 16*f* is disposed at an angle a8 relative to the peripheral wall portion 16*c* of the barrel 16. Preferably, the angle a8 is in the range of about 9.5 to 10.5 degrees.

Moreover, other critical dimensions of the barrel 16 contribute to the reduction in the overall size and weight of the semiautomatic handgun 200 and to the reduction in felt recoil during a firing sequence of the semiautomatic handgun 200. For example, the length d32 of the barrel 16 is preferably in the range of about 2.850 to 2.950 inches, the thickness d33 of the barrel 16 is preferably in the range of about 0.50 to 0.60 inches, the thickness 34 of the support portion 44 of the barrel 16 is preferably in the range of 0.270 to 0.280 inches, and the height d35 of the barrel 16 is preferably in the range of about 0.90 to 1.0 inches. Preferably, for a 9 mm semiautomatic handgun 200, the foregoing dimensions d32-d35 and angle a8 are as follows: d32 is about 2.9 inches; d33 is about 0.563 inches; d34 is about 0.277 inches; d35 is about 0.950 inches; and the angle a8 is about 10 degrees.

Figure 43A:
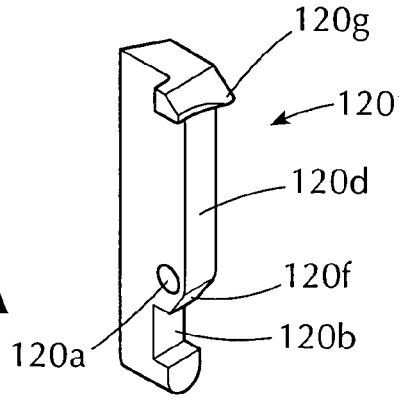
FIGS. 43A-43F show the extractor used in the semiautomatic handgun of FIG. 37, where
Figure 43C:
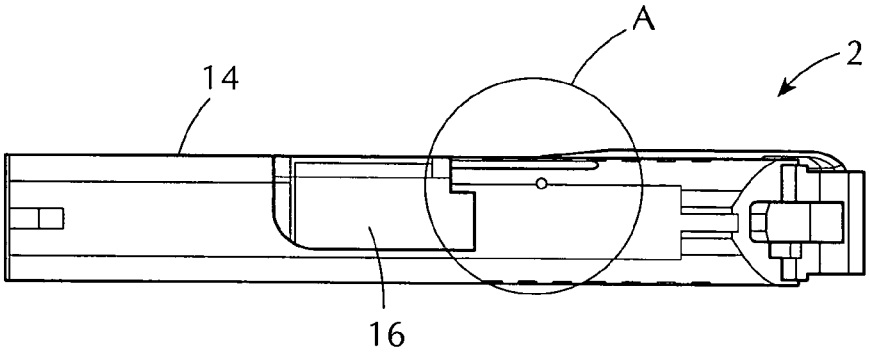
Figure 43D:
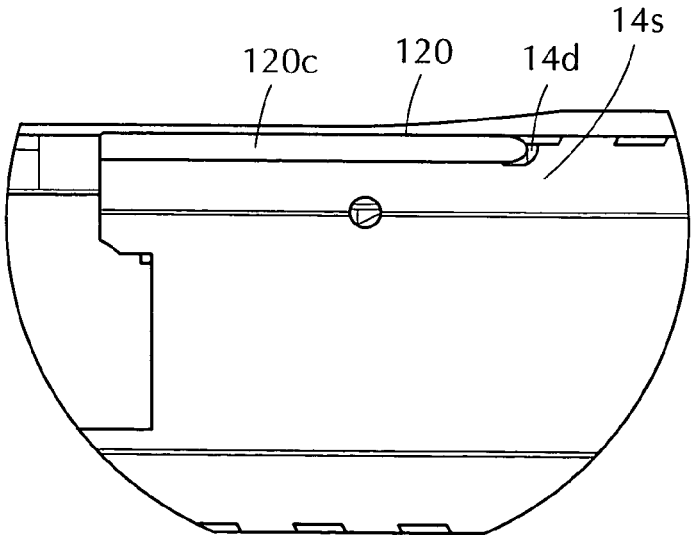
Figure 43B:
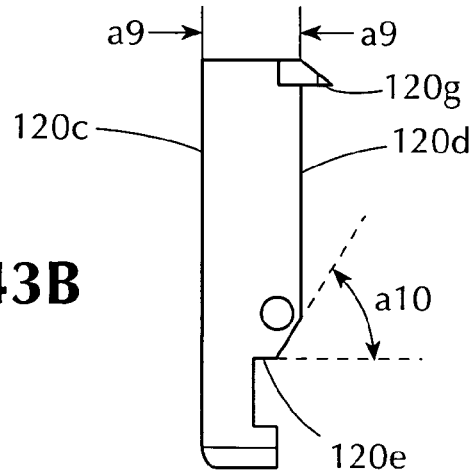

FIGS. 43A-43B show the extractor 120 used in the semiautomatic handgun 200 according to the present invention. As described above for the semiautomatic handgun 1, the function of the extractor 120 is to extract an empty cartridge from the cartridge chamber 40. The extractor 120 is mounted in the horizontal slot 14*d* of the slide 14 for pivotal movement by the connecting pin 124 which extends through the aperture 120*a* of the extractor 120 and the corresponding vertical aperture 14*e* of the slide 14. The biasing member 126 is anchored, at opposite ends thereof, between the surface 120*b* of the extractor 120 and the blind bore 14*f* formed in the rear wall of the horizontal slot 14*d* of the slide 14. The biasing member 126 functions as a spring catch for retaining the extracting portion 120*g* of the extractor 120 in contact with the spent cartridge to effect-extraction of the empty cartridge from the semiautomatic handgun when the slide 14 is driven to the second position thereof.

The extractor 120 of the semiautomatic handgun 200 has opposite side surfaces 120*c*, 120*d*, a step portion 120*e* contiguous with the surface 120*b*, and a tapered surface 120*f* disposed between and contiguous with each of the surface 120*b* and the side surface 120*d*. The tapered surface 120*f* increases in taper from the step portion 120*e* to the side surface 120*d*. The side surface 120*c* is inclined at an angle a9 relative to the side surface 120*d*. As further described below, by inclining the side surfaces 120*c*, 120*d* at the angle a9, the extractor 120, when mounted in the horizontal slot 14*d* of the slide 14 as described above, functions as a means for indicating whether or not a live cartridge is chambered in the cartridge chamber 40 of the barrel 16.

When the extractor 120 is mounted in the horizontal slot 14*d* of the slide 14, the surface 120*d* confronts the rear wall of the horizontal slot-14*d* and the surface 120*c* is exposed to the exterior of the semiautomatic handgun 200. FIG. 43C is a top view of the semiautomatic handgun 200 and FIG. 43D is an enlarged view of circled area A in FIG. 43C showing the position of the extractor 120 relative to an external surface portion 14*s* of the slide 14 when a live cartridge is chambered. As shown in FIG. 43D, the surface 120*c* of the extractor 120 is disposed generally parallel to the external surface portion 14s of the slide 14 which indicates that a live cartridge is chambered, and therefore that the semiautomatic handgun 200 is ready to be fired. The parallel relationship between the surface 120*c* of the extractor 120 and the external surface portion 14*s* of the slide 14 is achieved due to the live cartridge in the chamber 40 pressing the extracting portion 120*g*, and thus the entire extractor 120, against the bias of the biasing member 126 to position the extractor 120 in the parallel state shown in FIG. 43D from the non-parallel state shown in FIG. 43F.

Figure 43E:
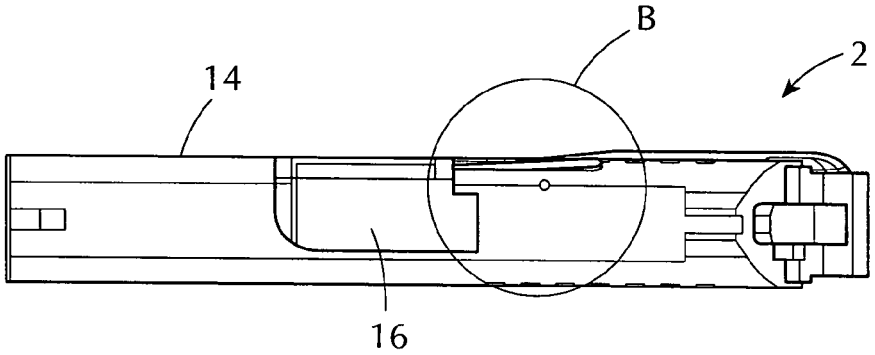
Figure 43F:
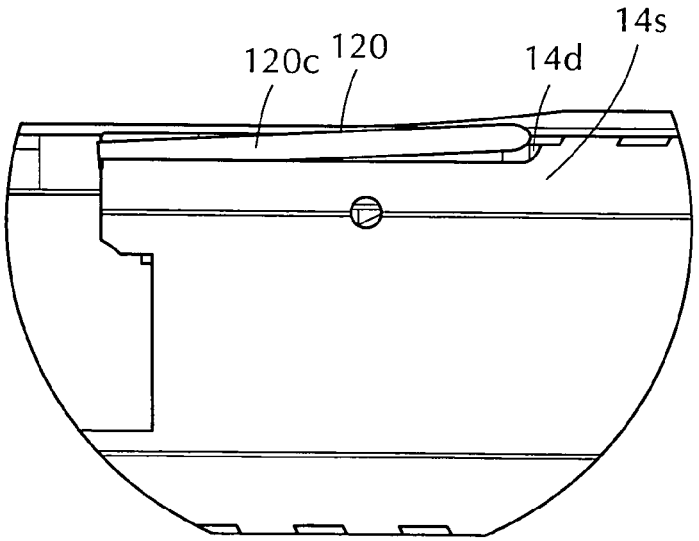

FIG. 43E is a top view of the semiautomatic handgun 200 and FIG. 43F is an enlarged view of circled area B in FIG. 43E showing the position of the extractor 120 relative to the external surface portion 14S of the slide 14 when a live cartridge is not chambered. As shown in FIG. 43F, the surface 120C of the extractor 120 is not disposed generally parallel to the external surface portion 14s of the slide 14 which indicates that a live cartridge is not chambered. In the case shown in FIG. 43F, since a live cartridge is not positioned in the cartridge chamber 40, the slide 14 must first be manually moved rearward toward the rear end 28 of the frame 10 against the bias of the recoil spring of the guide rod assembly 25 and then released. By this operation, the slide 14 is allowed to be moved forward towards the front end 26 of the frame 10 under the bias of the recoil spring causing a live cartridge to be pushed by the slide 14 from the magazine assembly 46 into the cartridge chamber 40.

Thus, by visual inspection of the surface 120*c* of the extractor 120 in conjunction with the exterior surface portion 14*s* of the slide 14, a user can readily identify whether a live cartridge is chambered (i.e., when the surface 120*c* of the extractor 120 is parallel to the exterior surface portion 14*s* of the slide 14) or not (i.e., when the surface 120*c* of the extractor 120 is not parallel to the exterior surface portion 14s of the slide 14). Preferably, the angle a9 between the side surfaces 120*c*, 120*d* of the extractor 120 which facilitates the foregoing identification is in the range of 1 to 1.5 degrees.

Another critical angle associated with the extractor 120 of the semiautomatic handgun 200 is the angle a10 between the step portion 120*e* and the tapered surface 120*f* shown in FIG. 43B. Preferably, the angle a10 is in the range of about 52 to 55 degrees. The combination of the foregoing preferred angles a9 and a10 for the extractor 120 facilitates the extraction of the empty casing as the extractor 120 hooks on the rim of the empty casing and pulls it out of the cartridge chamber 40 when the slide 14 moves rearwadly during a firing sequence. Preferably, for a 9 mm semiautomatic handgun 200, the angles a9 and a10 are about 1.29 and 53 degrees, respectively.

Figure 44A:
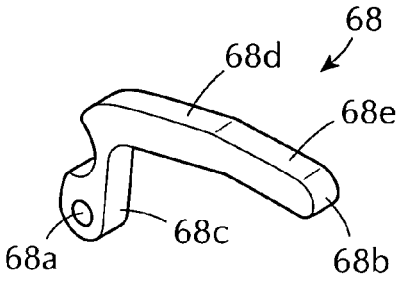
FIGS. 44A-44C show the hammer strut used in the semiautomatic handgun of FIG. 37, where
Figure 44B:
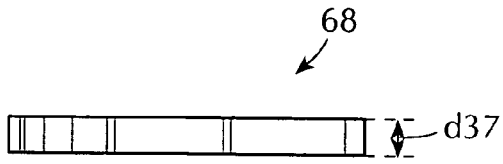
Figure 44C:
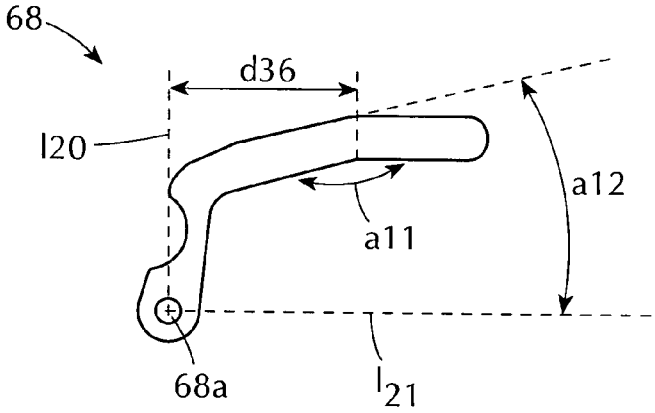

FIGS. 44A-44C show the hammer strut 68 used in the semiautomatic handgun 200 according to the present invention. The hammer strut 68 has a first arm portion 68*c*, a second arm portion 68*d* extending from the first arm portion 68*c*, and a third arm portion 68*e* extending from the second arm portion 68*d*. The first arm portion 68*c* has the aperture 68*a* through which the pin 72 passes for pivotally connecting the hammer strut 68 to the hammer 66 as described above for the semiautomatic handgun 1. The third arm portion 68*e* has the lower end 68*b* of the hammer strut 68 which engages the generally conical-shaped recess 74*a* in the head portion 74*b* of the plunger 74. The structure of the hammer strut 68 is characterized by several critical dimensions which substantially increases the functionality and longevity of the hammer strut 68 by reducing stress concentrations while the hammer 66 travels rearwardly and forwardly during a firing operation sequence. In this regard, a line 120 passing through the center of the aperture 68*a* is disposed at a distance d36 from a portion connecting the second and third arm portions 68*d*, 68*e*, the second and third arm portions 68*d*, 68*e* are inclined at an angle all relative to one another, and the second arm portion 68*d* is inclined at an angle a12 relative to a line 121 disposed generally perpendicular to line 120. The distance d36 is preferably in the range of about 0.45 to 0.50 inches. Preferably, the angle all is in the range of about 166 to 169 degrees. The angle a12 is preferably in the range of about 11 to 12 degrees. The thickness d37 of the hammer strut 68 is preferably in the range of about 0.050 to 0.100. Preferably, for a 9 mm semiautomatic handgun 200, the distance d36 is about 0.484 inches, the thickness d37 is about 0.090 inches, and the angles a11 and a12 are about 168 and 11.45 degrees, respectively.

Figure 45A:
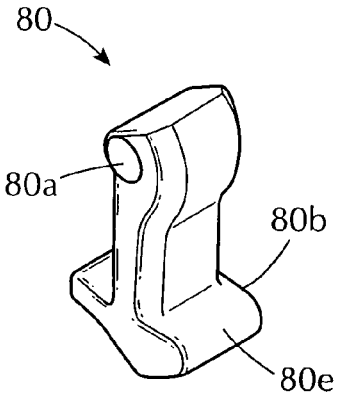
Figure 45B:
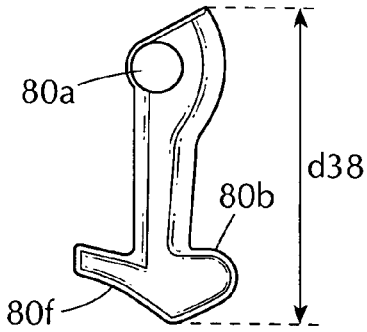

FIGS. 45A-45B show the magazine release catch 80 used in the semiautomatic handgun 200 of the present invention. In the semiautomatic handgun 1 described above with reference to FIGS. 31A, 31B, the catch 80 has a base 80*b* having a step portion 80*c* and a serrated portion 80*d*. In the catch 80 of the semiautomatic handgun 200, however, the base 80*b* has a generally outwardly curved portion 80*e* instead of the step portion 80*c*. Furthermore, instead of the serrations 80*d* in the catch 80 of the semiautomatic handgun 1, the catch 80 of the semiautomatic handgun 200 has a generally inwardly curved portion 80*f* which conforms to the outwardly curved surface of the user's fingers. Preferably, the length d38 of the catch 80 is in the range of about 0.75 to 0.85 inches and, for a 9 mm semiautomatic handgun, d38 is preferably about 0.810 inches. By this construction, the catch 80 can be easily urged counterclockwise by the mainspring 76 into latching engagement with the floorplate 46*a* of the cartridge magazine 84 of the magazine assembly 46. Furthermore, a user can easily manually urge the catch 80 clear of the floorplate 46*a* of the cartridge magazine 84 against the bias of the mainspring 76 to enable the magazine assembly 46 to be inserted into or withdrawn from the magazine well 85.

Figure 46A:
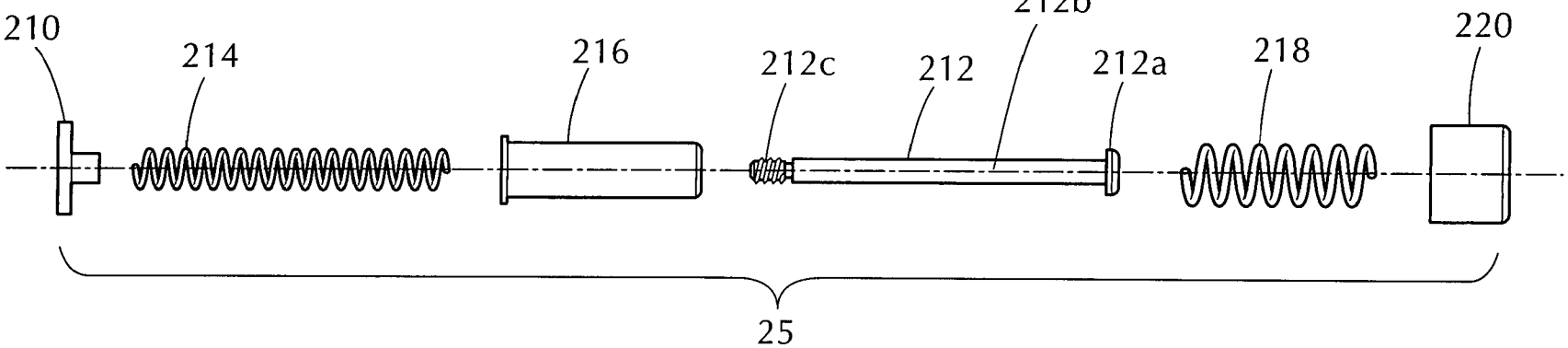
FIGS. 46A-46G show the guide rod assembly used in the semiautomatic handgun of FIG. 37, where
Figure 46B:
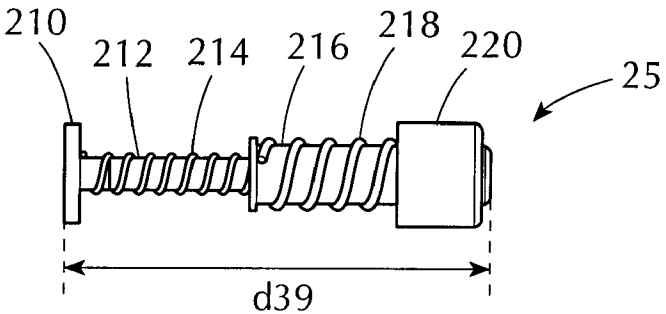
Figure 46C:
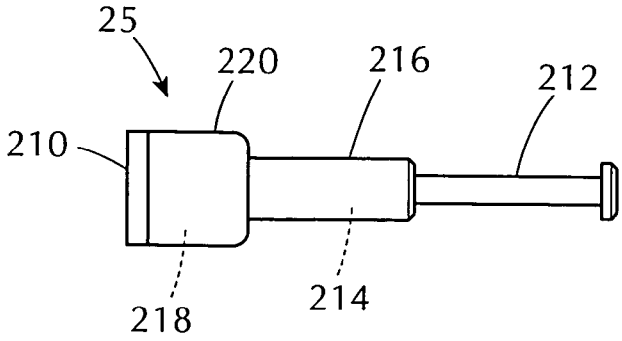
Figure 46D:
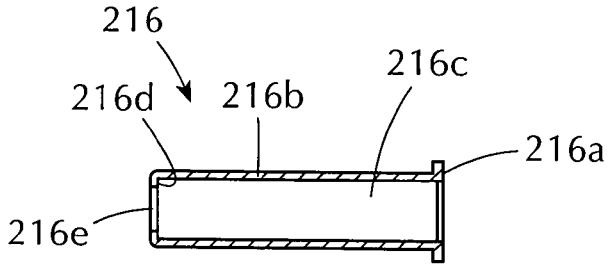
Figure 46E:
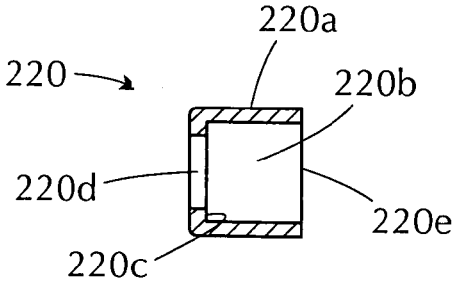
Figure 46F:
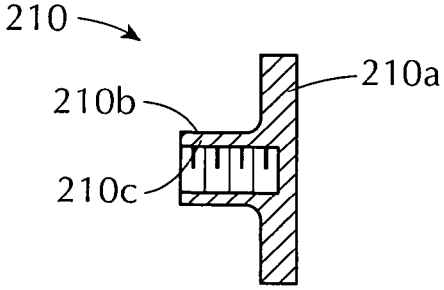

FIGS. 46A-46F show the guide rod assembly 25 used in the semiautomatic handgun 200 according to the present invention. FIG. 46A is an exploded view of the guide rod assembly 25. The function of the guide rod assembly 25 is to return the slide 14 forwardly after recoil during a firing sequence. The guide rod assembly 25 has the following six components: a first cap member 210, a guide rod 212, a first spring member 214, a tubular sleeve 216, a second spring member 218, and a second cap member 220. The guide rod 212 has a head portion 212*a* and a shank portion 212*b* having a threaded end 212*c*. As shown in FIG. 46F, the first cap member 210 has a head portion 210*a* and a tubular portion 210*b* extending from and having a smaller diameter than the head portion 210*a*. The tubular portion 210*b* has a threaded inner surface 210*c* for threaded engagement with the threaded end 212*b* of the guide rod 212. As shown in FIG. 46D, the tubular sleeve 216 has a head portion 216*a* and a tubular portion 216*b* extending from the head portion 216*a* and having an inner space 216*c* and a diameter smaller than the head portion 216*c*. A terminal end of the tubular sleeve 216 opposite the head portion 216*a* has an inner shoulder portion 216*d* disposed in the inner space 216*c* and defining an opening 216*e* of the tubular sleeve 216. As shown in FIG. 46E, the second cap member 220 comprises a tubular body 220*a* having an inner space 220*b*, an inner shoulder portion 220*c* disposed in the inner space 220*b* and defining a first opening 220*d*, and a second opening 220*e* opposite the second opening 220*d*.

Figure 46G:
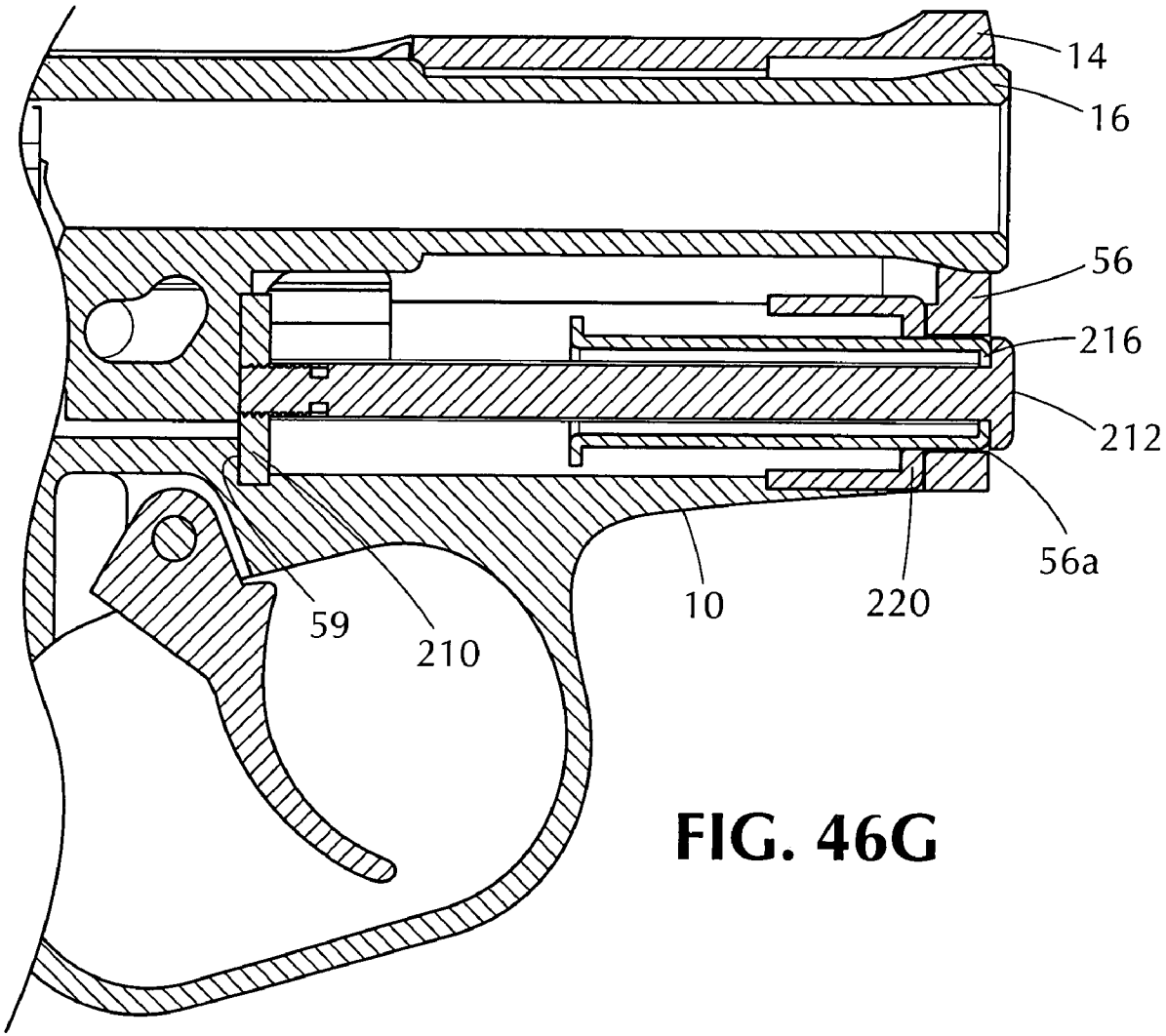
Figure 47:
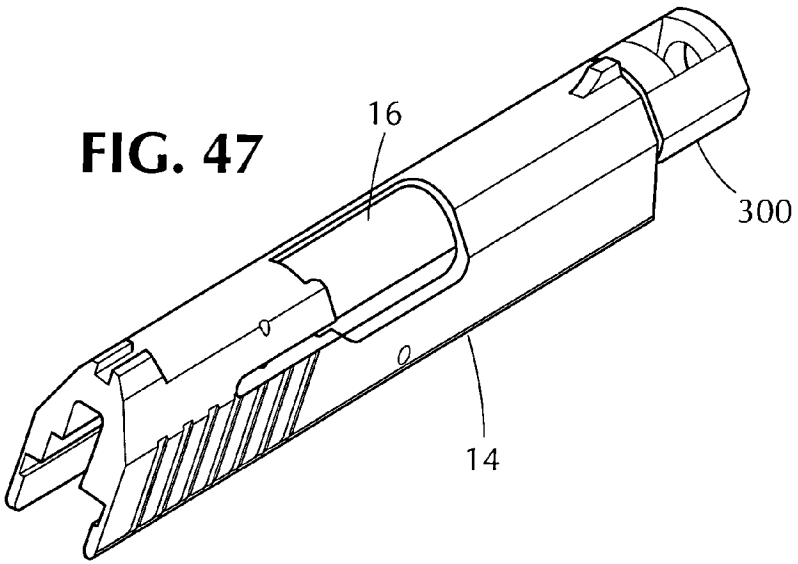
FIG. 47 shows another embodiment of the semiautomatic handgun according to the present invention incorporating a compensator.

FIG. 46B shows the guide rod assembly 25 in the assembled, uncompressed state, and FIG. 46G shows the positional relationship between the assembled, uncompressed guide rod assembly 25 and the frame 10, slide 14 and barrel 16 of the semiautomatic handgun 200. The guide rod 212 is connected to the first cap member 210 via threaded engagement between the corresponding threaded end 212*c* and the threaded inner surface 210*c*. The tubular sleeve 216 is mounted around the shank portion 212*b* of the guide rod 212 and its tubular portion 216*b* has an inner diameter which is greater than the outer diameter of the shank portion 212*b* so that the tubular sleeve 16 is permitted to travel in forward and rearward directions along a longitudinal axis of the shank portion 212*b* when the slide 14 moves rearwardly upon recoil during a firing sequence. The extent of travel of the tubular sleeve 216 in the forward direction is limited by the head portion 212*a* of the guide rod 212 at which point an outer surface of the inner shoulder portion 216*d* of the tubular sleeve 216 is configured to abut against an inner surface of the head portion 212*a*. The extent of travel of the tubular sleeve 216 in the rearward direction is limited by the head portion 210*a* of the first cap member 210 at which point an outer surface of the head portion 216*a* of the tubular sleeve 216 is configured to abut against an inner surface of the head portion 210*a*.

The second tubular member 220 is mounted around the tubular portion 216*b* of the tubular sleeve 216 and its inner shoulder portion 220*c* has an inner diameter which is greater than the outer diameter of the tubular portion 216*b* so that the second tubular member 220 is permitted to travel in the forward and rearward directions along a longitudinal axis of the tubular sleeve 216 when the slide 14 moves rearwardly upon recoil during a firing sequence. The extent of travel of the second tubular member 220 in the forward direction is limited by the abutment 56 of the slide 14 at which point an outer surface of the inner shoulder portion 220*c* is configured to abut against an inner surface of the abutment 56. The extent of travel of the second tubular member 220 in the rearward direction is limited by the head portion 210*a* of first cap member 210 at which point the end of the first cap member 220 at the second opening 220*e* thereof is configured to abut against an inner surface of the head portion 210*a*. The inner shoulder portion 220*c* of the second tubular member 220 is configured to engage the head portion 216*a* of the tubular sleeve 216 during movement in the rearward direction so that the second tubular member 220 displaces the tubular sleeve 216 rearwardly when the slide 14 moves rearwardly upon recoil during a firing sequence.

Referring to FIG. 46B, the first spring member 214 is mounted around the shank portion 212*b* of the guide rod 212, and opposite ends of the first spring member 214 are anchored between the head portions 210*a* and 212*a* of the first cap member 210 and guide rod 212, respectively. The second spring member 218 is mounted around the outer surface of the tubular portion 216*b* of the tubular sleeve 216, and opposite ends of the second spring member 218 are anchored between the head portions 216*a* and 212*a* of the tubular sleeve 216 and guide rod 212, respectively. In FIG. 46B, each of the first and second spring members 214, 218 is shown in an uncompressed state.

FIG. 46G shows the state in which the assembled guide rod assembly 25 is mounted in the semiautomatic handgun 200, with the first and second spring members 214, 218 omitted for clarity purposes. In this mounted state, an outer surface of the head portion 210*a* of the first cap member 210 abuts against an inner shoulder portion 59 of the frame 10, the end portion of the tubular sleeve 216 with the inner shoulder portion 216*d* extends into an opening 56*a* of the abutment 56 of the slide 14, the outer surface of the inner shoulder portion 220*c* of the first cap member 220 abuts against the inner surface of the abutment 56, and the head portion 212*a* of the guide rod 212 extends through the opening 56*a*. During a firing sequence, as the slide 14 moves to the rear, the abutment 56 of the slide 14 pushes the second cap member 220 rearwardly against the biasing force of the second spring member 218. The second cap member 220 then pushes the tubular sleeve 216 rearwardly against the biasing force of the first spring member 214 when the outer surface of the inner shoulder portion 220*c* engages the head portion 216*a*. As the slide 14 reaches the end of its rearward travel, the first and second spring members 214, 218, and thus the entire guide rod assembly 25, are in a fully compressed state. At this point, as shown in FIG. 46C, the second cap member 220 abuts the head portion 210*a* of the first cap member. When the slide 14 reaches the end of its rearward travel, the slide 14 moves forward under the biasing force of the first and second spring members 214, 218.

The dimensions of the components of the guide rod assembly 25 are selected so that guide rod assembly 25 is properly accommodated on the surface 10*d* of the frame 10 in the state shown in FIG. 46G. For a 9 mm semiautomatic handgun 200, for example, the relevant dimensions of several of the components of the guide rod assembly 25 are as follows: the overall length d39 of the guide rod assembly 25 in the uncompressed state shown in FIG. 46B is preferably about 2.20 inches; the overall length of the guide rod 212 is preferably about 2.185 inches; the overall length of the first spring member 214 is preferably about 3.035 inches and its outer diameter is preferably about 0.225 inches; the overall length of the tubular sleeve 216 is preferably about 1.2 inches; the overall length of the second spring member 218 is preferably about 1.6 inches and its outer diameter is preferably about 0.375 inches; and the overall length and diameter of the second cap member 220 are preferably about 0.40 inches and 0.50 inches, respectively.

The construction methods and materials for the components of the semiautomatic handgun 200 are the same as described above for the semiautomatic handgun 1. Additionally, the first cap member 210, the guide rod 212, the tubular sleeve 216 and the second cap member 220 of the guide rod assembly 25 are preferably formed of stainless steel, such as 17-4 stainless steel. Alternatively, these component of the guide rod assembly 25 may also be formed of titanium or a suitable polymer, such as DELRIN®. The first and second spring members 214, 218 of the guide rod assembly 25 are preferably formed of spring steel. However, it is understood by those of ordinary skill in the art that other materials exhibiting a high ratio of strength to weight are suitable for the components of the semiautomatic handgun 200 as set forth above for the semiautomatic handgun 1. For example, the guide rod 212 and the tubular sleeve 216 may be formed of a high strength polymer or other hard plastic material which is resistant to deformation from the spring members during compression and decompression thereof.

By the foregoing construction, several advantages are attained by the guide rod assembly 25 according to the present invention. More specifically, as the slide 14 reaches the end of its rearward travel as described above, the second cap member 220 directly contacts the first cap member 210. When the slide 14 moves to its forwardmost position under the biasing force of the first and second spring members 214, 218, the second cap member 220 directly contacts the abutment 56 of the slide 14 and the tubular sleeve 216 directly contacts the head portion 216*a* of the guide rod 212. Thus, during a firing sequence, the second cap member 220 and the tubular sleeve 216 do not have direct contact with the any part of the frame 10, thereby substantially reducing damage to the frame 10 during repetitive firing of the semiautomatic handgun 200, particularly to the inner shoulder portion 59 of the frame 10 on which the first cap member 210 rests. This feature is particularly advantageous when the frame is formed of aluminum and the components of the guide rod assembly 25 are formed of steel as described above.

Another advantage is that the foregoing preferred dimensions of the components of the guide rod assembly 25 of the present invention are selected so that the spring members 214, 218 are not fully compressed when the slide 14 reaches the end of its rearward travel as described above. This feature effectively extends the life of the spring members 214, 218 during repetitive firing of the semiautomatic handgun 200.

Thus it will be appreciated by those skilled in the art that the foregoing construction, including preferred dimensions and materials, of the guide rod assembly 25 contributes to the dissipation of the energy of recoil when the semiautomatic handgun 200 is fired. For example, during the cycle of compression and expansion of the first and second spring members 214, 218, a significant amount of the energy of recoil will have been dissipated by the work done in compressing the first and second spring members 214, 218, thereby reducing felt recoil. Felt recoil is further reduced by avoiding direct contact between the frame 10 and the tubular sleeve 216 and the second cap member 220 of the guide rod assembly 25 as described above. Furthermore, the life of the spring members 214, 218 are significantly extended by insuring that the spring members 214, 218 are not fully compressed when the slide 14 reaches the end of its rearward travel as described above.

Figure 48:
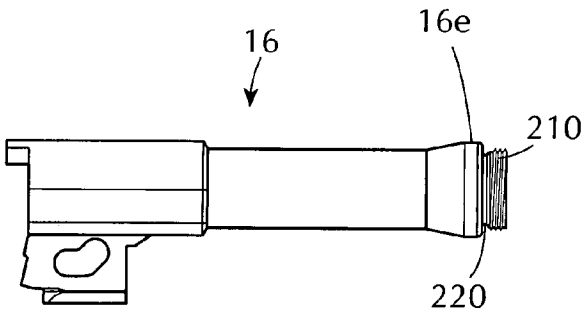
FIG. 48 shows the connection between the barrel and the compensator of the semiautomatic handgun shown in FIG. 47.

FIGS. 47-50D show a modified version of the semiautomatic handgun 200 incorporating a compensator 300 for further reducing felt recoil during a firing sequence. FIGS. 47 and 50A-50D show the slide 14, barrel 16 and the compensator 300 in an assembled state. AS further described below, the compensator 300 is attached to a forward end of the barrel 16 which, as best shown in FIG. 48, has been modified from the previous embodiments to provide an engaging portion to which the compensator 300 is connected. FIGS. 49A-49C show the structure of the compensator 300.

As shown in FIG. 48, the forward end of the barrel 16 is provided with an engaging portion having a first cylindrical section 210 and a second cylindrical section 220 having a smaller diameter than the first cylindrical section 210 and disposed between the first cylindrical section 220 and the cylindrical portion 16*e* of the barrel 16. The first cylindrical section 210 is preferably threaded for engagement with matching threads of the compensator 300 as further described below. The engaging portion is preferably formed in one piece with the barrel 16 by overextending the cylindrical portion 16*e* during manufacture of the barrel 16 and then machining the overextended cylindrical portion 16*e* to form the first and second cylindrical sections 210, 220. It is understood by those of ordinary skill in the art, however, that the engaging portion may instead be formed separately from the barrel 16 and then connected to the forward end of the barrel by any known method, including soldering, welding, bonding, press-fitting and locating with a set screw.

Figure 49B:
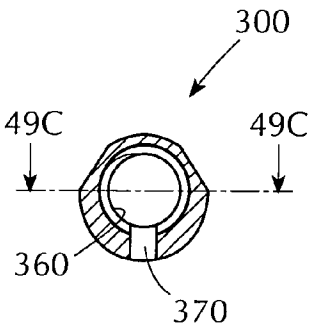
FIGS. 49A-49C show the compensator used with the semiautomatic handgun shown in FIG. 47, where
Figure 49C:
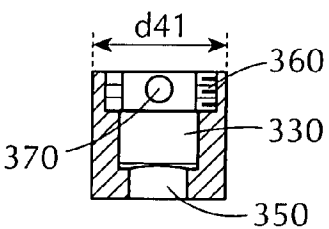
Figure 49A:
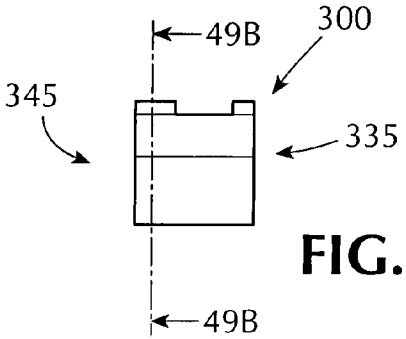

Referring now to FIGS. 49A-49C, the compensator 300 has a generally cylindrical expansion chamber 330 and an opening 340 disposed directly above the expansion chamber 330 and unobstructed to the atmosphere. The opening 340 defines a venting port for venting the high-pressure gases generated during a firing sequence. A front end 335 of the compensator 300 has an open end 350 which aligns with the barrel chamber 40 when the compensator 300 is connected to the barrel 16 and defines an exit port through which a round exits the semiautomatic handgun during a firing sequence. A rear end 345 of the compensator 300 has an inner threaded surface 360 for threaded engagement with the threads of the first cylindrical section 210 of the barrel 16 to connect the compensator 300 to the barrel 16. A lower surface portion of the compensator 300 is provided with a through-hole 370 which aligns with the-first cylindrical section 210 of the barrel engaging portion and is configured to receive a set screw (not shown) for engagement with the first cylindrical section 210 when the compensator 300 is connected to the barrel 16 to further secure the compensator 300 to the barrel 16.

The dimensions of the compensator 300 are selected to conform to the caliber of the semiautomatic handgun 200. For a 9 mm semiautomatic handgun, for example, the length d40 of the compensator 300 is preferably about 0.650 inches and the width d41 of the compensator 300 is preferably about 0.812 inches. When the compensator 300 is connected to the barrel 16, a clearance d42 is provided between the rear end 345 of the compensator 300 and the front end of the slide 14. For a 9 mm semiautomatic handgun, for example, the length of the clearance d42 is preferably about 0.010 inches. Thus, with the lengths d40 and d42 of the compensator 300 and the clearance, respectively, the overall length of a 9 mm semiautomatic handgun 200 is preferably about 5.56 inches.

The compensator 300 is preferably formed of stainless steel, such as 17-4 stainless steel. However, it is understood by those of ordinary skill in the art that other materials exhibiting a high ratio of strength to weight are suitable for the compensator 300 of the semiautomatic handgun. For example, the compensator 300 can be manufactured of titanium.

While the present embodiment employs a threaded connection and a set screw for connecting the compensator 300 to the barrel 16, it will be appreciated by those skilled in the art that the present invention is not limited to such specific form of connection. For example, the compensator 300 may be connected to the barrel 16 by any other known connection method, including soldering, welding, bonding, press-fitting and other forms of connecting hardware.

As described above, the function of the compensator 300 is to further reduce the overall felt recoil during a firing sequence. More specifically, when the firing pin 54 strikes the primer of a chambered round, the gunpowder in the round is ignited. High-pressure gases generated upon ignition of the gun powder push the bullet of the round into the free bore section 16*b* of the barrel 16 which allows the gases to flow forward. As the bullet enters the expansion chamber 330 of the compensator 300, the high-pressure gases are vented forward, which generates a pressure tending to push the barrel 16 in the forward direction, and upward, which generates a pressure tending to hold the barrel 16 down, thereby producing a resultant force on the barrel 16 that counteracts the recoil moment during the firing sequence. The bullet then seals the expansion chamber 330 as it passes through the open end 350, thereby relieving the pressure in the expansion chamber 330 by venting the high-pressure gas trough the venting port 340. By the foregoing construction and operation of the compensator 300, the overall felt recoil is further reduced during a firing sequence, thereby allowing a shooter to fire the semiautomatic handgun 200 quickly and accurately.

It will be appreciated by those skilled in the art that the semiautomatic handgun 200 according to the present invention can be designed to fire cartridges of various calibers other than 9 mm, including 0.380, 0.40 S&W (Smith and Wesson), and 0.45 ACP (Automatic Colt Pistol) calibers. The construction of the components for a 0.380 caliber semiautomatic handgun are the same as for a 9 mm semiautomatic handgun, except for the barrel 16, the extractor 120 and the magazine 84 which are modified to accommodate the smaller bullet used in the 0.380 caliber semiautomatic handgun. More specifically, the depth of the chamber of the barrel 16 for a 0.380 caliber semiautomatic handgun is decreased (e.g., from 19 mm to 17 mm); the extractor 120 is modified by increasing the distance from the side surface 120*c* to the tip of the extracting portion 120*g*. and an insert (e.g., a stainless steel insert) is mounted on an inner wall along the length of the well 85 of the magazine 84 in order to shorten the width of the well 85 to accommodate a clip with the shorter bullets.

For the 0.40 S&W semiautomatic handgun, the construction of all of the components are the same as described above for a 9 mm semiautomatic handgun, except for the frame 10, the slide 14, the barrel 16, the extractor 120, the magazine 84, and the first and second spring members 214, 218 of the guide rod assembly 25. The range of dimensions and angles for these components of the 0.40 S&W semiautomatic handgun is 10% to 15% greater than the range of dimensions and angles described above for the corresponding components of the 9 mm semiautomatic handgun. For example, for the foregoing corresponding components, dimension 0.40 S&W=10%-15% [dimension 9 mm±10%].

For the 0.45 ACP semiautomatic handgun, the construction of all of the components are the same as described above for a 9 mm semiautomatic handgun, except for the frame 10, the slide 14, the barrel 16, the extractor 120, the magazine 84, and the first and second spring members 214, 218 of the guide rod assembly 25. The range of dimensions and angles for these components of the 0.45 ACP semiautomatic handgun is 12% to 20% greater than the range of dimensions and angles described above for the corresponding components of the 9 mm semiautomatic handgun. For example, for the foregoing corresponding components, dimension 0.45 ACP=12%-20% [dimension 9 mm±10%].

It will be appreciated by those of ordinary skill in the art that the unique construction and the combination of materials, dimensions and weights from which the semiautomatic handgun of the present invention is comprised results in a highly versatile semiautomatic handgun which is light weight, compact and economical to manufacture, in which specialty tooling for the manufacture thereof is kept to a minimum, in which the number of moving components is reduced to a minimum and the interaction of these components is reliable and simple, and which has constructional features providing for improved assembly and disassembly of the components thereof.

Moreover, the inventive semiautomatic handgun is highly durable and resistant to structural or performance degradation. The inventive semiautomatic handgun is also quite compact and is easily concealed or carried as a back-up weapon. Notwithstanding its small size, the gun can be held very securely, with a full two-finger grip and the thumb wrapped securely about the upper portion of the grip and the back of the grip resting against the meaty part of the hand between the thumb and the forefinger. The axis of the barrel is parallel to the axis of the forearm and only slightly above it, so that recoil forces are applied directly up the arm, with substantially no muzzle rise when the handgun is fired.

Moreover, the semiautomatic handgun according to the present invention provides a very compact handgun which has semiautomatic action, excellent accuracy and enormous stopping power. Because of its compact size and high stopping power, this handgun is particularly suitable for use as a back-up weapon by law enforcement officers and the like, and is particularly well adapted for use in self-defense situations and by trained professionals for instructional purposes. The semiautomatic handgun is also inherently safe.

It will also be appreciated by those of ordinary skill in the art that the semiautomatic handgun of the present invention can be operated by smooth, consistent trigger action providing improved accuracy.

From the foregoing description, it can be seen that the present invention comprises an improved semiautomatic handgun. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed is:

1. A semiautomatic handgun comprising: a frame; a barrel mounted on the frame and having a chamber for receiving a cartridge, a peripheral wall portion extending from the chamber, a cylindrical portion forming a front terminal end of the barrel, and a conical portion disposed between and contiguous with each of the peripheral wall portion and the cylindrical portion; a slide mounted on the frame and over the barrel and longitudinally movable relative to the frame and the barrel; a firing mechanism for striking the cartridge; and a trigger for releasing the firing mechanism; wherein the semiautomatic handgun has a length of about 5.05 inches, a height of about 4.04 inches, and a thickness of about 0.812 inches.

2. A semiautomatic handgun according to claim 1; wherein the semiautomatic handgun is a 9 mm semiautomatic handgun.

3. A semiautomatic handgun according to claim 2; wherein the semiautomatic handgun has an unloaded weight of about 12.9 ounces.

4. A semiautomatic handgun according to claim 1; wherein the semiautomatic handgun has an unloaded weight in the range of about 12.0 to 12.5 ounces.

5. A semiautomatic handgun comprising: a frame; a barrel mounted on the frame and having a chamber for receiving a cartridge, a peripheral wall portion extending from the chamber, a cylindrical portion forming a front terminal end of the barrel, and a conical portion disposed between and contiguous with each of the peripheral wall portion and the cylindrical portion; a slide mounted on the frame and over the barrel and longitudinally movable relative to the frame and the barrel; a firing mechanism for striking the cartridge; and a trigger for releasing the firing mechanism; wherein the firing mechanism comprises a firing pin, and the trigger is pivotally mounted on the frame for movement between a rest position and a depressed position; and further comprising a hammer pivotally mounted on the frame in spaced relation to the trigger for driving the firing pin to strike the cartridge, a trigger bar pivotally connected to the trigger and extending into operative relation with the hammer for cocking the hammer when the trigger is moved to the depressed position, and a biasing member having a first end connected to the frame and a second end connected to the trigger bar for biasing the trigger bar in a direction into operative relationship with the hammer and in a direction for returning the trigger to the rest position from the depressed position.

6. A semiautomatic handgun according to claim 5; wherein the frame has a first boss and a second boss adjacent the first boss; and wherein the biasing member comprises a torsion spring having a first loop portion encircling the first boss of the frame, a second loop portion extending from the first loop portion at the first end of the torsion spring and resting on the second boss of the frame, at least one coil, and a foot portion connected to the coil at the second end of the torsion spring and connected to the trigger bar.

7. A semiautomatic handgun according to claim 6; wherein the torsion spring has a first arm connecting the coil to the foot portion and a second arm connecting the coil to the first loop portion.

8. A semiautomatic handgun according to claim 6; wherein the semiautomatic handgun has a length in the range of about 4.9 to 5.2 inches, a height in the range of about 3.9 to 4.1 inches, and a thickness in the range of about 0.75 to 0.82 inches.

9. A semiautomatic handgun comprising: a frame; a trigger pivotally mounted on the frame for movement between a rest position and a depressed position;

a hammer pivotally mounted on the frame in spaced relation to the trigger; a trigger bar pivotally connected to the trigger and extending into operative relation with the hammer for cocking the hammer when the trigger is moved to the depressed position; and a biasing member having a first end connected to the frame and a second end connected to the trigger bar for biasing the trigger bar in a direction into operative relationship with the hammer and in a direction for returning the trigger to the rest position from the depressed position; wherein the semiautomatic handgun has a length of about 4.7 inches, a height of about 3.6 inches, and a thickness of about 0.94 inches.

10. A semiautomatic handgun according to claim 9; wherein the semiautomatic handgun is a 9 mm semiautomatic handgun.

11. A semiautomatic handgun according to claim 10; wherein the semiautomatic handgun has an unloaded weight of about 12.3 ounces.

12. A semiautomatic handgun according to claim 9; wherein the semiautomatic handgun has an unloaded weight in the range of about 12.0 to 12.5 ounces.

13. A semiautomatic handgun comprising: a frame having a forward end, a rear end, a first locating recess disposed between the forward end and the rear end, and a second locating recess disposed at the rear end; a trigger pivotally mounted in the first locating recess of the frame for movement between a rest position and a depressed position; a hammer pivotally mounted in the second locating recess of the frame; a trigger bar pivotally connected to the trigger and movable in a first direction toward the first locating recess of the frame in response to depression of the trigger to operatively engage the hammer for cocking the hammer; a biasing member for biasing the trigger bar in a second direction away from the first locating recess and into operative relationship with the hammer and for returning the trigger to the rest position from the depressed position; and a deflector for deflecting the trigger bar in a direction generally transverse to the first and second directions when the trigger is returned by the biasing member to the rest position from the depressed position; wherein the semiautomatic handgun has a length of about 4.7 inches, a height of about 3.6 inches, and a thickness of about 0.94 inches.

14. A semiautomatic handgun according to claim 13; wherein the semiautomatic handgun is a 9 mm semiautomatic handgun.

15. A semiautomatic handgun according to claim 14; wherein the semiautomatic handgun has an unloaded weight of about 12.3 ounces.

16. A semiautomatic handgun according to claim 13; wherein the semiautomatic handgun has an unloaded weight in the range of about 12.0 to 12.5 ounces.

* * * * *